US010253961B2

(12) United States Patent
Golle et al.

(10) Patent No.: US 10,253,961 B2
(45) **Date of Patent: *Apr. 9, 2019**

(54) HIGH-POWERED LED LIGHT MODULE WITH A BALANCED MATRIX CIRCUIT AND ASSOCIATED METHOD

(71) Applicant: Heilux, LLC, Eden Prairie, MN (US)

(72) Inventors: Aaron J. Golle, Farmington, MN (US); John T. Golle, Eden Prairie, MN (US); Walter J. Paciorek, Phoenix, AZ (US)

(73) Assignee: Heilux, LLC, Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/906,768

(22) Filed: Feb. 27, 2018

(65) Prior Publication Data

US 2018/0252398 A1 Sep. 6, 2018

Related U.S. Application Data

(63) Continuation of application No. 15/031,564, filed as application No. PCT/US2014/061594 on Oct. 21, 2014, now Pat. No. 9,903,574.

(60) Provisional application No. 61/894,495, filed on Oct. 23, 2013.

(51) Int. Cl.

| | |
|---|---|
| ***F21V 23/00*** | (2015.01) |
| ***F21K 9/90*** | (2016.01) |
| ***F21K 9/20*** | (2016.01) |
| ***F21K 9/60*** | (2016.01) |
| ***F21V 23/06*** | (2006.01) |
| *F21Y 115/10* | (2016.01) |

(52) U.S. Cl.

CPC ..... *F21V 23/005* (2013.01); *F21K 9/20* (2016.08); *F21K 9/60* (2016.08); *F21K 9/90* (2013.01); *F21V 23/06* (2013.01); *F21Y 2115/10* (2016.08)

(58) Field of Classification Search

CPC ..... F21V 23/005

USPC ..... 362/240, 246, 294, 800

See application file for complete search history.

(56) References Cited

U.S. PATENT DOCUMENTS

| | | | |
|---|---|---|---|
| 3,968,056 | A | 7/1976 | Bolon |
| 5,757,016 | A | 5/1998 | Dunn et al. |
| 6,095,661 | A | 8/2000 | Lebens et al. |
| 6,882,452 | B2 | 4/2005 | Decker et al. |
| 7,658,510 | B2 | 2/2010 | Russell |
| 7,746,418 | B2 | 6/2010 | Wakita |
| 8,704,448 | B2 | 4/2014 | Tischler et al. |
| 8,749,455 | B2 | 6/2014 | Koyama |
| 9,029,883 | B2 | 5/2015 | Chung |
| 9,155,149 | B2 | 10/2015 | Pan |

(Continued)

FOREIGN PATENT DOCUMENTS

| | | |
|---|---|---|
| WO | WO_2005051551 | 6/2005 |

*Primary Examiner* — Allyson Trail

(74) *Attorney, Agent, or Firm* — Charles A. Lemaire; Jonathan M. Rixen; Lemaire Patent Law Firm, P.L.L.C.

(57) ABSTRACT

Inventive embodiments include a device for distributing power to devices over an area, with a power density of at least one Watt per $ft^2$ (or 900 $cm^2$ if we go metric). The device includes a flexible substrate; a circuit comprising a thin-film conductor having a thickness of 400 nanometers or less, wherein the circuit is adhered to the substrate; a plurality of devices positioned on the sheet and attached to the circuit wherein each device of the plurality is driven at substantially the same voltage; and the power delivered to the devices is at least 90% of the input power of the energized circuit.

22 Claims, 44 Drawing Sheets

(56) References Cited

U.S. PATENT DOCUMENTS

| | | | |
|---|---|---|---|
| 9,411,203 | B2 | 8/2016 | Koyama |
| 2009/0053507 | A1 | 2/2009 | Hoey et al. |
| 2009/0155598 | A1 | 6/2009 | Bierwagen et al. |
| 2009/0173919 | A1 | 7/2009 | Webster et al. |
| 2012/0175667 | A1 | 7/2012 | Golle et al. |
| 2013/0169160 | A1 | 7/2013 | Kim et al. |
| 2014/0070074 | A1 | 3/2014 | Tachibana et al. |
| 2015/0048744 | A1 | 2/2015 | Shin et al. |

HIGH-POWERED LED LIGHT MODULE WITH A BALANCED MATRIX CIRCUIT AND ASSOCIATED METHOD

CROSS-REFERENCE TO RELATED APPLICATIONS

This application is a continuation of U.S. patent application Ser. No. 15/031,564, filed Apr. 22, 2016 by Aaron J. Golle et al. and titled "High powered LED light module with a balanced matrix circuit" (which issued as U.S. Pat. No. 9,903,574 on Feb. 27, 2018), which is a national-stage entry of PCT Application No. PCT/US2014/061594, filed Oct. 21, 2014 by Aaron J. Golle et al. and titled "High powered LED light module with a balanced matrix circuit," which claims the benefit of priority to U.S. Patent Application Ser. No. 61/894,495, filed on Oct. 23, 2013, each of which is hereby incorporated by reference herein in its entirety.

FIELD OF THE INVENTION

In various embodiments, the present invention generally relates to electronic devices, and more specifically to array-based electronic devices.

BACKGROUND OF THE INVENTION

Thermal management is a leading contributor to an LED lighting "cost penalty" that is limiting global market acceptance of the technology. Unlike incandescent light sources, which remove most of the waste heat by radiating in an infrared region, waste heat generated by LEDs must be removed via conduction and convection. Convection is often not possible because encapsulation prevents exposing a heated area to a medium that convects heat.

As the LED lighting industry seeks to generate the required luminous flux of each device, it has become standard practice to use either a single high-power packaged LED chip or a packaged LED array. In either case, the heat generated by the device is seemingly accepted as a fact of life by the industry that then focuses its investment on materials that are usable to dissipate that heat—sometimes in the device itself, sometimes in the LED luminaire, and sometimes in both.

SUMMARY OF THE INVENTION

Inventive embodiments include a device for distributing power to devices over an area, with a power density of at least one Watt per ft2 (~900 cm2). The device includes a flexible substrate; a circuit comprising a thin-film conductor having a thickness on the order of 400 nanometers or less, wherein the circuit is adhered to the substrate; a plurality of devices positioned on the sheet and attached to the circuit wherein each device or a group of devices of the plurality is driven at substantially the same voltage, and the power delivered to the devices is at least 90% of the input power of the energized circuit.

Another device embodiment for providing high-intensity illumination includes a flexible substrate and a circuit that includes a conductor having a thickness of 40 to 400 nanometers. The circuit is adhered to the substrate and the circuit displays a common voltage drop when energized. A sheet or printed layer can overlay the circuit and substrate. The device can include a plurality of low power light emitting diodes positioned on the sheet and attached to the circuit wherein each light emitting diode of the plurality has substantially the same voltage. The device also includes two or more connectors positioned symmetrically with respect to the circuit.

Inventive embodiments also include a method of making a high-power light module using additive print circuitry. The method includes obtaining a flexible substrate having circuitry printed on the substrate using an additive process and adding an overlay to the flexible substrate with circuitry. A solder paste is applied to the circuit. One or more packaged LEDs are placed onto the circuit and connected to the circuit. A connector is added to the circuit.

Another method embodiment is a method of making a high-power light module using additive print circuitry. The method includes obtaining a flexible substrate having circuitry printed on the substrate using an additive process. An overlay is added to the flexible substrate. An MACA (magnetically aligned anisotropic conductive adhesive) compound is applied to the circuit. One or more of packaged LEDs are placed onto the circuit. The one or more LEDs are connected to the circuit by curing the MACA in the presence of a magnetic field. A phosphor glob-top is added and a connector is added to the circuit.

Another embodiment for a method of making a high-power light module includes obtaining a flexible substrate having circuitry adhered to the substrate. The method also includes laying down one or more components; and positioning a component and connecting the component to the circuitry.

Another method embodiment for making a high-power light module includes obtaining a flexible substrate having circuitry adhered to the substrate, positioning a packaged LED, and attaching the packaged LED to the circuit. The method also includes curing an MACA used to electrically connect and mechanically adhere the LED to the circuit in the presence of a magnetic field.

Another method embodiment for making a high-power light module includes obtaining a flexible substrate having circuitry adhered to the substrate, positioning a bare die LED, and attaching the bare die LED to the circuit. The method also includes curing the module in the presence of a magnetic field, and optionally adding a glob-top top over the bare die LED.

Another device embodiment for providing high-intensity illumination includes a flexible substrate and a circuit that includes a conductor having a thickness of 40 to 400 nanometers, wherein the circuit is adhered to the substrate, and the circuit displays a common voltage drop when energized. The device also includes a plurality of low power light emitting diodes attached to the circuit wherein each light emitting diode of the plurality has substantially the same voltage. The device further includes two or more connectors positioned symmetrically with respect to the circuit.

Another embodiment includes a module for distributing power to devices over an area. The module includes a flexible substrate and a circuit that includes a thin-film conductor having a thickness of 400 nanometers or less, wherein the circuit is adhered to the substrate. The module also includes a plurality of devices positioned on the sheet and attached to the circuit wherein each device of the plurality is driven at its design voltage, and the power delivered to the devices is at least 90% of the input power of the energized circuit.

BRIEF DESCRIPTION OF THE FIGURES

FIG. 26A is an SEM image of glass micro-spheres coated with silver; FIG. 26B is an SEM image of silver flakes; FIG. 26C is an SEM image of silver acorns; and 26D is an SEM image of silver nanopowder, disclosed in US20090173919.

DETAILED DESCRIPTION OF THE INVENTION

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

In this document, the terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

Figure 1A:
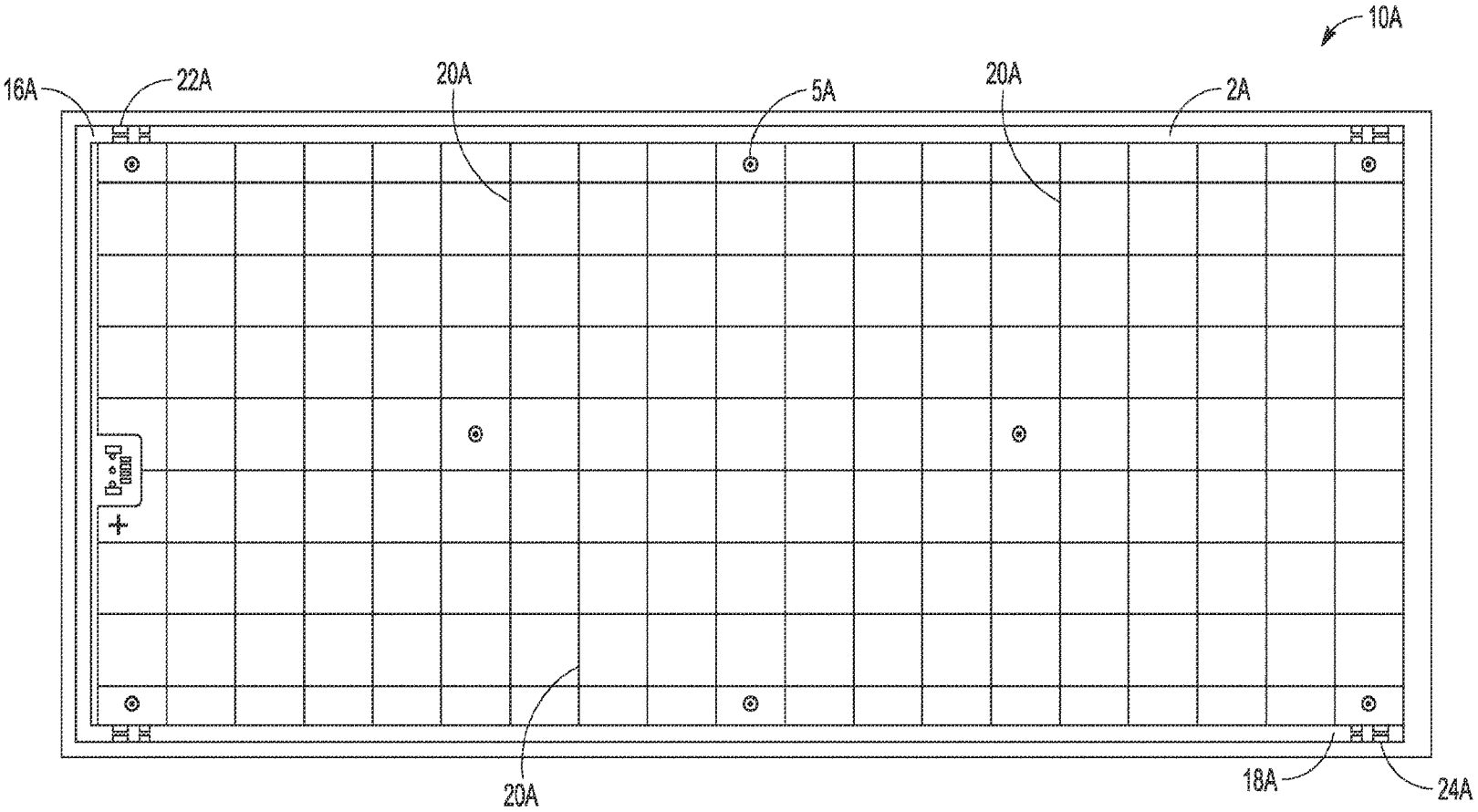
FIG. 1A is a top plan view of one device for providing high-intensity illumination.

The circuits, modules, and methods disclosed herein are configured or designed to address dissipation of waste heat generated by the LEDs, such as by reducing electrical resistance or reducing power density compared to conventional circuits. Module embodiments disclosed herein include a device for providing high-intensity illumination, illustrated generally at 10A in FIG. 1A. The device embodiment 10A includes a flexible substrate 5A and a circuit 2A that includes conductors 16A, and each of the conductors 16A can have a thickness of about 40 to 400 nanometers. In the example of FIG. 1A, the conductors 16A form a lattice or grid patterns, but other conductor arrangements can be used. The circuit 2A is adhered to the flexible substrate 5A. The circuit 2A displays a common voltage drop when energized. A first plurality of low power light emitting diodes (LEDs) 20A are attached to the circuit 2A. One or more of the plurality of LEDs is arranged substantially in-line or parallel with at least one of the conductors 16A. Each light emitting diode of the plurality can have substantially the same voltage when energized. In an example, when each LED in the plurality of LEDs has the same voltage, each LED can have substantially the same illumination. Two or more connectors 22A and 24A are positioned symmetrically with respect to the circuit 2A. In the example of FIG. 1A, the connectors 22A and 24A are positioned at farthest-apart or opposite corners of the circuit 2.

Figure 1B:
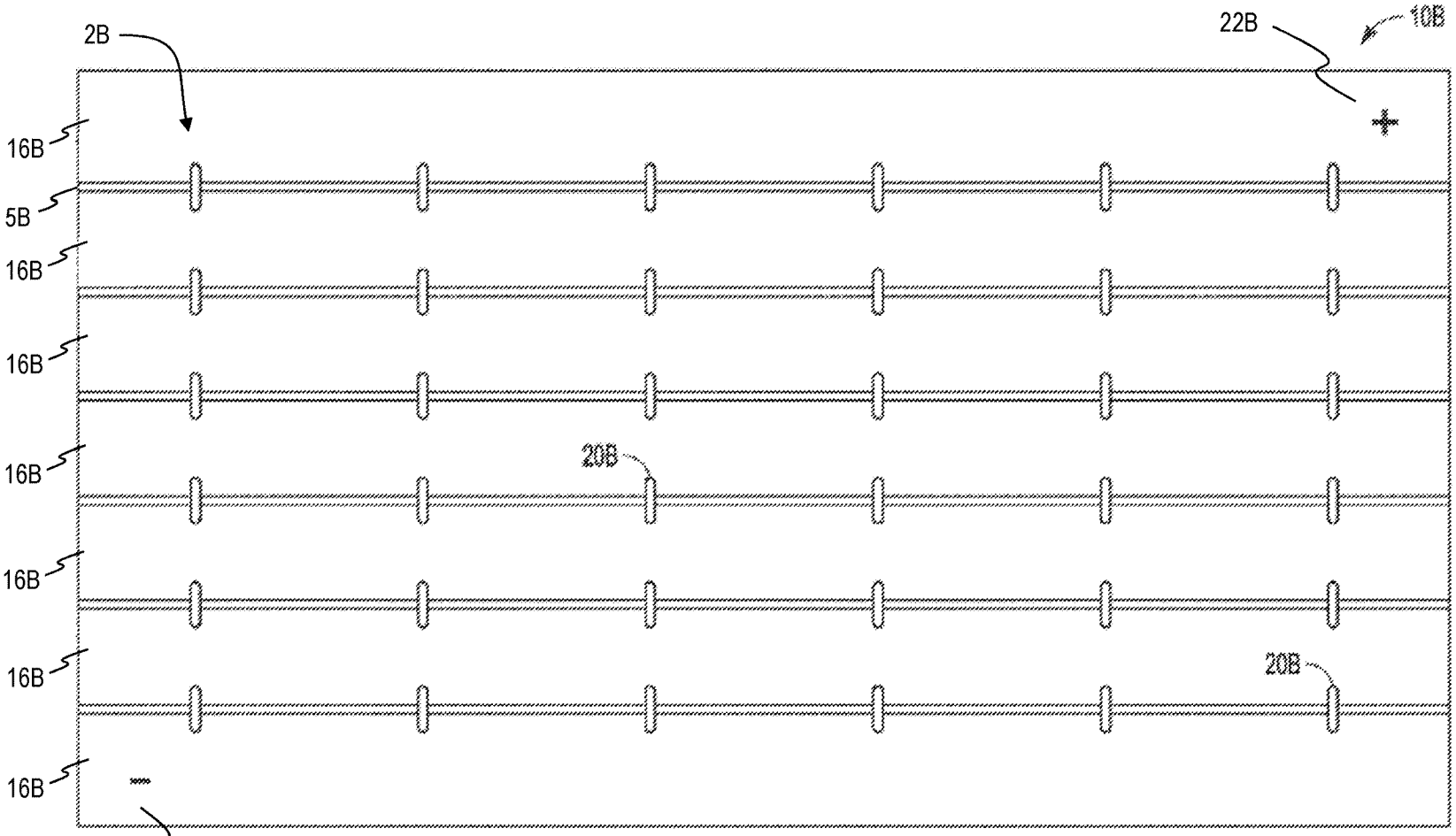
FIG. 1B is a top plan view of another device embodiment for providing high-intensity illumination.

Module embodiments disclosed herein can include a device for providing high-intensity illumination, illustrated generally at 10B in FIG. 1B. The device embodiment 10B includes a flexible substrate 5B and a circuit 2B that includes conductors 16B, and each of the conductors 16B can have a thickness of about 40 to 400 nanometers. The circuit 2B is adhered to the flexible substrate 5B. The circuit 2B displays a common voltage drop when energized. A plurality of low power light emitting diodes (LEDs) 20B are attached to the circuit 2B. Each LED of the plurality of LEDs 20B can have substantially the same voltage when energized. Two or more connectors 22B and 24B are positioned symmetrically with respect to the circuit 2B, for example, at opposite, farthest-apart corners of the module shown in FIG. 1B. The device embodiment 10B in FIG. 1B includes wide bus bars that feed narrow circuit elements including the LEDs 20B. The device embodiments 10A and 10B can optionally be manufactured or used with printed or deposited conductors.

For some embodiments, the device embodiments 10A and 10B are configured to distribute power to various devices, such as the respective plurality of LEDs 20A and 20B, over an area, such as with a power density of at least one Watt per ft2 (900 cm2). The power delivered to the devices can be at least 90% of the input power of the energized circuit.

For some embodiments, the device embodiments 10A and 10B can include one or more conductors having a thickness of 40 to 400 nanometers. For some embodiments, each device of the plurality is driven at its design voltage, and the power delivered to the devices is at least 90% of the input power of the energized circuit.

It has been found that the device embodiments 10A and 10B can be used to produce high light intensity, e.g., one Watt and above, such as in the form of an LED light sheet or a light panel module. A light panel module can include a regular or irregular array of low powered LEDs that are electrically and mechanically attached to a thin-film flexible circuit. In an example, the term "thin film" can refer to a film applied to a substrate wherein the film has a thickness within a range that is less than or equal to about 0.4 micrometer. For some embodiments considered herein, a thin film of a conductive metal such as copper, tin, gold, silver or aluminum is positioned on and adhered to a substrate of polyethylene terephthalate (PET), polyethylene naphthalate (PEN), or polyimide (PI), or PEEK (poly(ether ketone)), or one or more other materials suitable for use as a substrate for a flexible circuit.

Thus, a high-powered light module that includes an array of low powered LEDs electrically and mechanically attached to a thin-film circuit is achievable. Improved performance is achievable by enhancing bus bar conductivity characteristics. This can be accomplished by one or more of adding conductive tape, widening the bus bars, or, for some embodiments, folding or rolling the bus bars to reduce panel width. Bus-bar conductivity can be enhanced by tinning the circuit with solder, or printing a conductive material, such as including applying a silver-containing ink over a bus bar.

In one embodiment, conductivity of a bus bar is enhanced by attaching several connectors such as the AVX Insulation Displacing Connector, part number 009176, manufactured by AVX Corporation, of Fountain Inn S.C., such as spaced along the length of the bus bar. A single length of wire of appropriate gauge is then pressed into the connector, which displaces the insulation and makes a secure electrical and mechanical connection. By extending the wire beyond the beginning of the light sheet, the single wire is usable to connect the light sheet to one terminal of the LED power supply.

It is known that an increase in luminous efficacy occurs when an LED is driven at lower currents. It has been found that a constant luminous output is achievable using more LEDs with less total power. Further discussion of the device components is as follows herein.

The Flexible Substrate and Thin-Film Circuit

In an example, a flexible substrate that can be used in an LED light module is typically 2 to 10 mils thick. Other thickness embodiments are also contemplated, however. As discussed, the substrates can be made of PET, PEN, PI, PEEK, or one or more other materials suitable for use as a substrate for a flexible circuit.

Depending upon the application, the flexible substrate may be transparent, translucent or opaque. The melting point of PET is within a range of 255 to 260 degrees C. The maximum process temperature can be about 110 degrees C. The PET substrate may be transparent. For some embodiments, PET can be heat set. The maximum process temperature for the heat set PET can be about 150 degrees C.

PEN can be heat set. The melting point is about 270 degrees C. and the maximum process temperature can be 200 degrees C. The PEN substrate may be transparent.

PI does not have a melting point; instead, it chars. The maximum process temperature is over about 350 degrees C.

In one embodiment, a thin-film conductive metal is applied to the flexible substrate in a pattern to make an additive circuit. For some embodiments, an additive circuit is made by a physical vapor-deposition process. The physical vapor-deposition process for making an additive circuit includes a selective metallization on plastic films, such as to create both simple and complex circuit patterns. Selective metallization includes masking areas of a substrate that are to remain free of metal. This masking is achieved by applying a masking pattern immediately prior to the metal deposition. The masking prevents the metal from depositing in unintended spaces. One method for making this type of flexible substrate and thin-film circuit is disclosed in U.S. Pat. No. 6,882,452 ('452), which is incorporated by reference. The disclosure of the '452 reference can be found in the present application, under the heading, "Disclosure for U.S. Pat. No. 6,882,452".

In some embodiments, an additive circuit can be made by printing silver nano-ink onto a flexible substrate. One silver nano-ink for making an additive circuit by printing is Cabot conductive Ink, CCl-300, which is available from Cabot Printed Electronics Materials, of Albuquerque, N. Mex. The silver nano ink has a viscosity of 11-15 cP at 22 degrees C., and a surface tension of 30-33 mN/m at 25 degrees C. The ink has a silver loading of 19-21 wt %, a density of 1.23-1.24 gml, and an alcohol-based vehicle. An example of a module made with printing silver nanoink is shown at 10B in FIG. 1B. The module 10B has wide bus bars, such as compared to module 10A, that feed narrow circuit elements. A process employing jet printing can be slower than other processes disclosed herein, as using thinner internal conductors can reduce a time or cost of making a circuit. Another example of a suitable nanoink is Xerox Nanosilver Conductive Ink, available from Xerox Research Centre of Canada.

In some embodiments, an additive circuit is made by a NDSU (North Dakota State University) Micro Cold Spray Process. The NDSU Micro Cold Spray Process is described in U.S. Pat. Applications Nos. 20090173919 ('919), 20090155598 ('598) and 20090053507 ('507), which are herein incorporated by reference. Descriptions from these references are presented herein under the heading, "Micro Cold Spray Process". The Micro Cold Spray Process directly writes metallic lines on a substrate using metallic powder precursors in small, well defined areas, at high deposition rates, and can attain features as small as about 10 microns.

An example of an additive circuit is made by a thin-film process such as described in U.S. Pat. No. 6,882,452, disclosed herein. In this example, metal may be selectively deposited on one or both sides of a flexible substrate. Metal deposition thickness is controlled, and a thickness of a metal deposit can be at least about 20 nm for a solid conductor of greater than 200 nm, such as achieving levels of 1.0, 0.5, and 0.1 ohms per square of surface resistance, such as using copper or aluminum.

An example of a module made with either the thin-film process, Flashlamp imaging process, chemical etching, or laser ablation is shown generally at 10A in FIG. 1A. As discussed, benefits of the module 10A do not depend upon internal conductor width. However, wide internal conductors result in a module having slightly lower I2R losses.

Another type of circuit that can be used with a flexible substrate is a subtractive circuit. For a subtractive circuit, a thin metal film conductor can be coated with copper, tin, gold, silver, or aluminum. Excess conductive material can be removed to make the circuit, such as using laser ablation, chemical etching, or ablative Flashlamp imaging. More information about ablative Flashlamp imaging is disclosed in U.S. Pat. No. 5,757,016, which is herein incorporated by reference.

The LEDs

LEDs employed in the module embodiments can include off-the-shelf or commercially-available LEDs. In some embodiments, one or more LEDs can be selected to display one or more colors. For some embodiments, the LEDs are packaged LEDs. The packaged LEDs are connected to the circuit embodiments by solder for some embodiments, conductive adhesive for other embodiments, or anisotropic conductive adhesive that includes a pressure connection or is magnetically aligned.

Figure 5A:
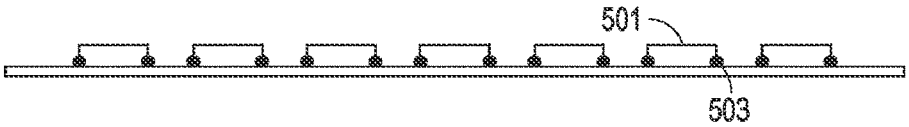
FIGS. 5A and 5B are side views of a packaged LED connected to a flexible thin-film circuit on a flexible substrate with a solder connection.
Figure 5B:
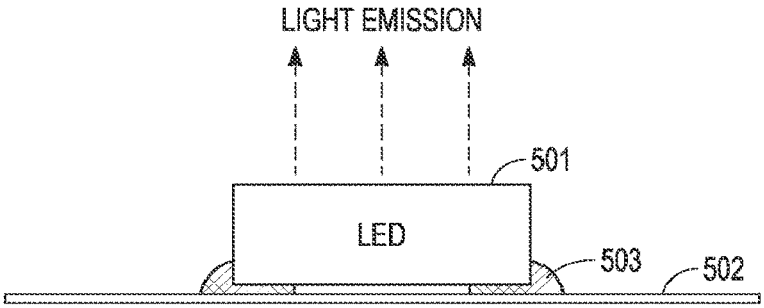
Figure 6A:
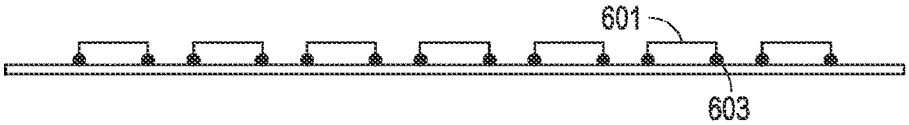
FIGS. 6A and 6B are side views of a packaged LED connected to a flexible thin-film circuit on a flexible substrate with a MACA connection.
Figure 6B:
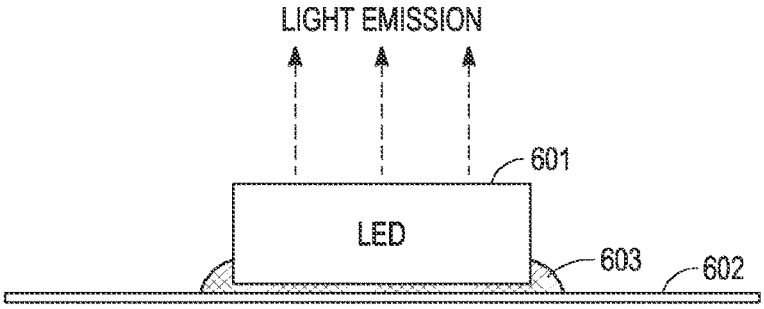

FIGS. 5A and 5B illustrate generally examples that include a packaged LED 501 that is connected to a flexible thin-film circuit on a flexible substrate 502 with a solder connection 503. FIGS. 6A and 6B illustrate generally examples that include a packaged LED 601 that is connected to a flexible thin-film circuit on a flexible substrate 602 with a MACA connection 603.

In other embodiments, the LEDs are bare die LEDs. The bare die LEDs are optionally connected to a circuit or circuit substrate using a print that includes one or more layers. For example, print acting as an insulator can be selectively laid down over one or more surfaces of an LED. The print can be made by jet printing, aerosol jet printing, or by using a Micro Cold Spray such as the NDSU Micro Cold Spray, discussed herein.

Figure 7A:
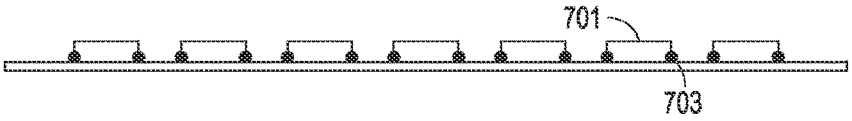
FIGS. 7A and 7B are side views of a bare die LED connected to a flexible thin-film circuit on a flexible substrate with a MACA connection.
Figure 7B:
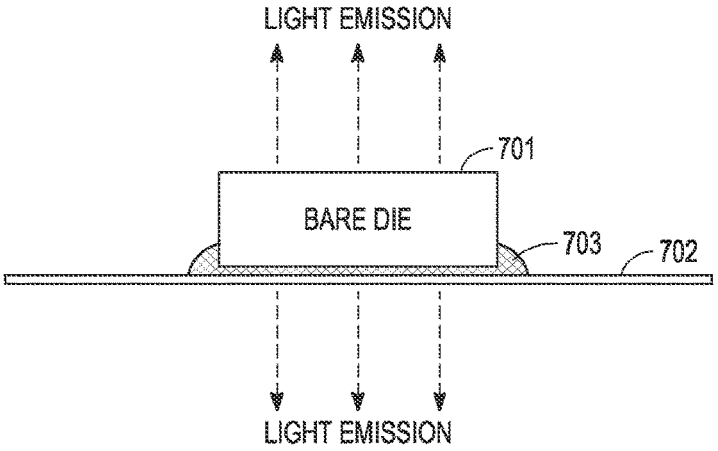

In some examples, a bare die LED can be connected to a circuit using a conductive adhesive or anisotropic conductive adhesive. The anisotropic conductive adhesive connection can be a pressure connection or can be magnetically aligned. FIGS. 7A and 7B illustrate generally examples of a bare die LED 701 that is connected to a flexible additive thin-film circuit on a flexible substrate 702 using a MACA connection 703.

Figure 8A:
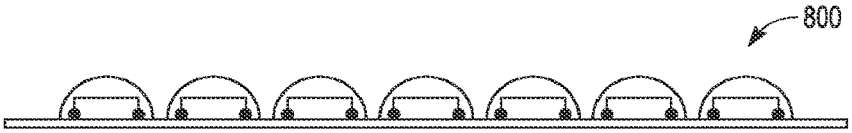
FIGS. 8A and 8B are side views of a glob-top applied to one or both sides of the flexible substrate.
Figure 8B:
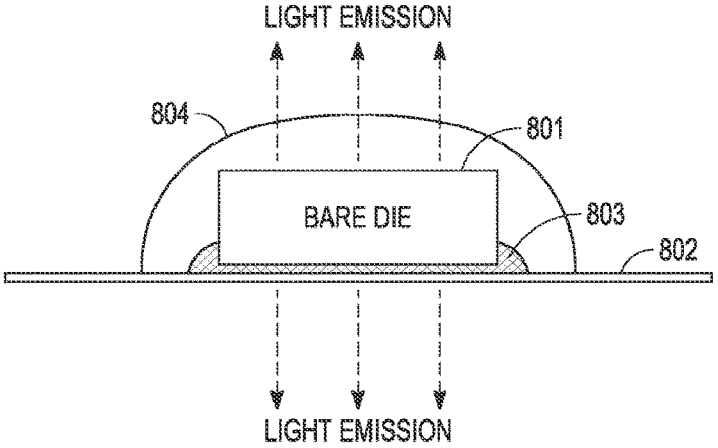

Some bare die LED embodiments can include two-sided emission through a transparent substrate. Some bare die LED embodiments can include a phosphor to produce white light. The phosphor includes a glob-top applied to one or both sides of the flexible substrate or a remote phosphor. One such embodiment is shown FIGS. 8A and 8B. FIG. 8A illustrates generally a serial arrangement 800 of multiple bare die LEDs having respective phosphor glob-tops. FIG. 8B illustrates generally an example of a bare die LED 801 that is connected to a flexible substrate 802, such as using MACA. The bare die LED 801 is covered with a phosphor glob-top 804.

The Module

A high-powered LED light module can include a high-intensity, one Watt or above, LED light-sheet module. In an example, such a module can have a single to double-digit Watt range, and can have a substantially uniform light output across a large area, and can be energy efficient. The efficiency and uniformity are achieved at least in part using an array of low powered, i.e., 100 mW or less, LEDs that are electrically and mechanically attached to a thin-film flexible circuit or substrate.

The high-powered LED light module embodiments disclosed herein can be less expensive to produce than traditional substrate/laminated copper flex circuits, by as much as an order of magnitude. Some embodiments include a thin-film metal circuit adhered to a flexible substrate to make a flexible thin-film circuit, and can be provided in roll form. In roll form, high speed pick-and-place and attachment processes can be used for LED attachment.

The module embodiments may have complex shapes. Individual modules may be connected together in series or parallel to provide large lit areas powered by a single driver. Using low-powered LEDs distributed over a large area distributes the heat generated by the LEDs, thus reducing or eliminating the need to provide expensive and design-limiting heat sinks.

In an example, with the high-powered LED light module embodiments disclosed herein, three circuit parameters that are managed include voltage drop, ohmic heating and current density. LEDs can be sensitive to voltage, with a small change leading to a large change in current and thus light output. A module sheet resistance of the conductor, conductor thickness and width, supply voltage, and circuit design or layout are variables which can be controlled to minimize ohmic heating and to create a uniform illumination or luminosity across all or most of the LEDs within the module.

Generally, $I^2R$ or power losses must be managed to avoid excessive reduction in system luminous efficacy and efficiency. Most ohmic heating occurs in the bus bars used to distribute current to series strings of LEDs. The maximum safe current density in the conductor to prevent electromigration and ultimately voids in the conductor is 105 $A/cm^2$. For some embodiments disclosed herein, ranges of some relevant parameters include: a sheet resistance of 1 ohm/square or lower; conductor thickness generally in a 40 to 400 nm range; conductor width, for bus bars, at about 1 cm for some embodiments; supply voltage having a maximum of about 50 VDC, although specific design requirements can dictate an actual or required voltage, with higher voltages corresponding to better or minimized ohmic heating. Another parameter can include the circuit design or layout itself. For example, a balanced or symmetrical circuit in which all branches can experience or receive the same voltage drop can provide the best results for both uniformity of light and luminous efficacy. Losses in luminous efficacy through ohmic heating can be tolerated up to about 10%.

Figure 2:
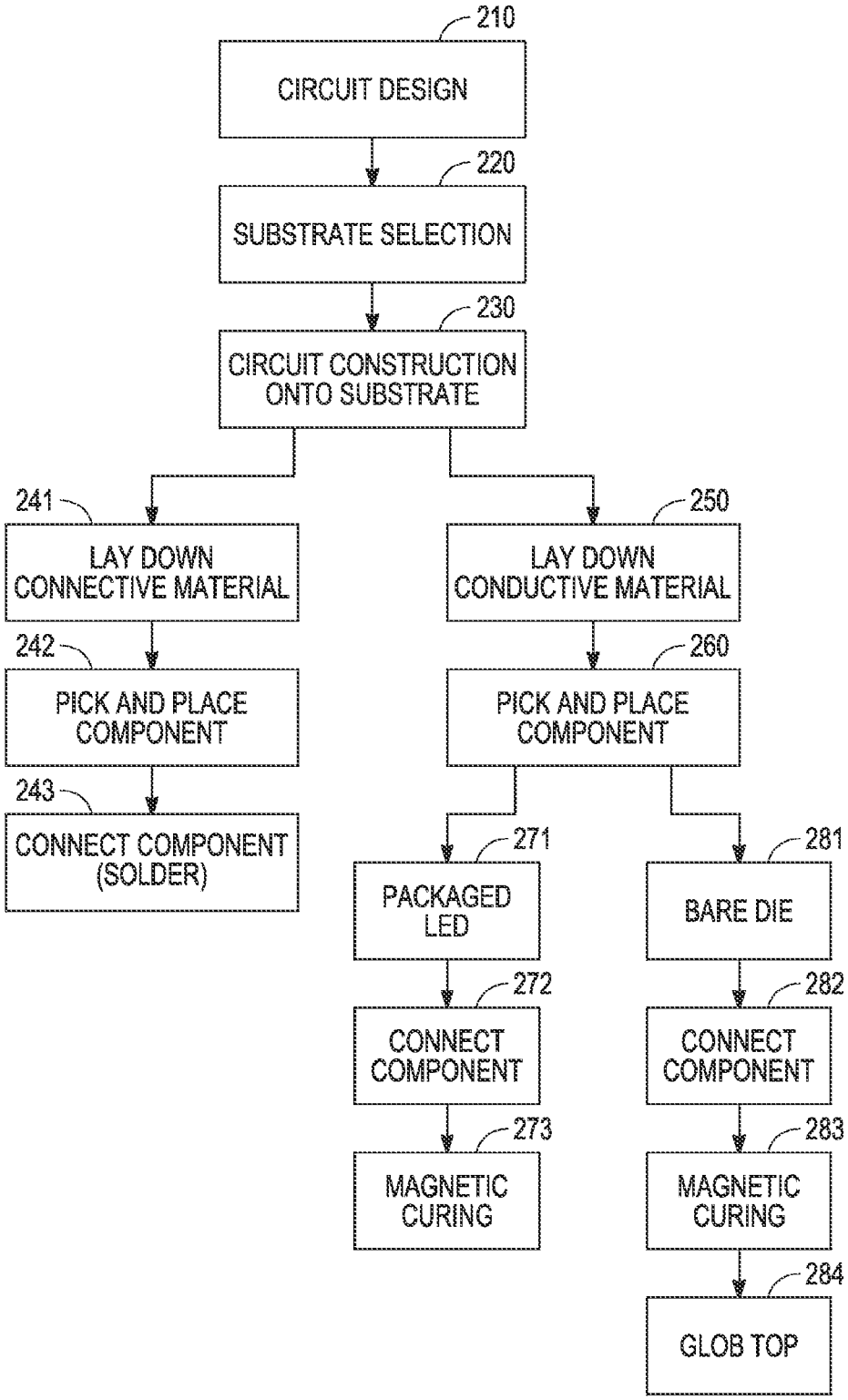
FIG. 2 is a schematic view of a method for making a device for providing high-intensity illumination.

One process embodiment, shown schematically in FIG. 2, for making a high-powered LED light module can include circuit design at 210, substrate selection at 220, and circuit construction at 230. At 240, connective material can be provided, and at 250, conductive material can be provided. In some examples, additive circuit construction and magnetic anisotropic conductive adhesive can be used. Circuit design at 210 can include considerations of flexibility of layout and material width and thickness. Circuit design at 210 can further include considerations for thermal tolerance, electrical balance, and optical or visual uniformity.

Substrate selection at 220 can include considerations for material flexibility, roll-to-roll, color or clear, or cost. Another consideration can be additive circuit construction. Criteria include the degree of cost reduction, design flexibility and yield. Another design consideration is the type of magnetic anisotropic conductive adhesive. The criteria include, among other things, cost, yield, performance and manufacturing capability.

In the example of FIG. 2, the process can include laying down connective material at 240. Once connective material is in place, components can be positioned, such as using pick-and-place techniques, at 242. At 243, a component can be connected, such as using solder or other conductive adhesive means.

In the example of FIG. 2, the process can include laying down conductive material at 250, and then positioning one or more components at 260. In an example, a component includes a packaged LED that can be positioned at 271, connected at 272, and cured (e.g., using MACA) at 273. In an example, a component includes a bare die LED that can be positioned at 281, connected at 282, adhered or cured at 283, and further processed at 284, such as to provide a phosphor glob-top.

Figure 3:
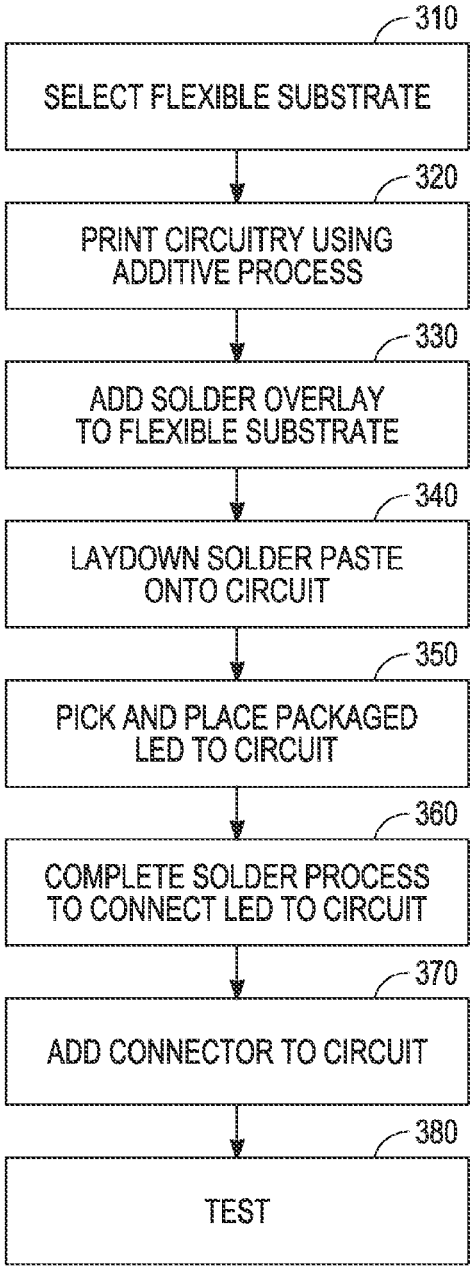
FIG. 3 is a schematic view of a method for making a device for providing high-intensity illumination and having additive print circuitry and packaged LEDs.

Another process example is illustrated in FIG. 3. The process can include, at 310, selecting a flexible substrate. At 320, the process includes printing circuitry using an additive manufacturing process. At 330, the process includes selectively applying an overlay or solder mask to the flexible substrate. At 340, the process can include providing a solder paste on to the printed circuitry. At 350, the process can include positioning an LED (e.g., packaged) on to the circuit. At 360, the LED can be adhered to the circuit, such as using solder. At 370, one or more connectors can be coupled to the circuit, and at 380, the circuit can be tested. The circuit can optionally be tested at one or more other points during the manufacturing process.

Figure 4:
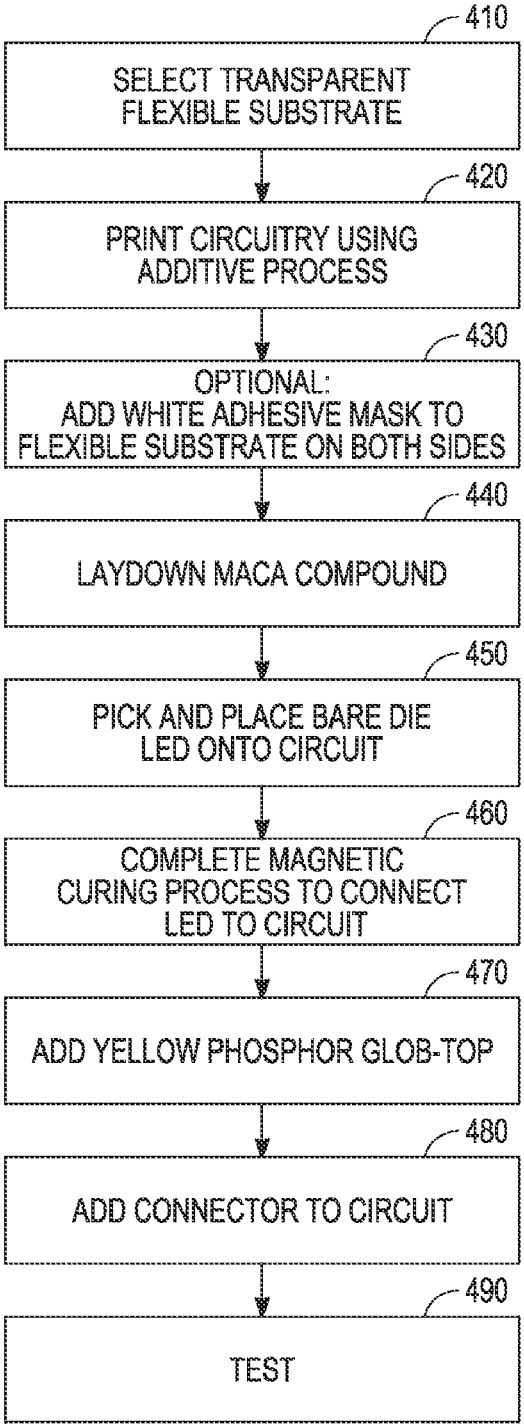
FIG. 4 is a schematic view of a method for making a device for providing high-intensity illumination and having additive print circuitry and bare die LEDs.

Another process example is illustrated in FIG. 4, which includes a process for making a high-power light module using additive print circuitry with bare die LEDs. At 410, the process can include selecting a transparent flexible substrate. At 420, the process can include printing circuitry on to the substrate using an additive or material deposition technique. At 430, the process can include adding an adhesive mask to one or both sides of the flexible substrate. At 440, MACA can be provided on the circuit and substrate. At 450, the process can include providing a bare die LED on to the circuit. At 460, the MACA can be magnetically cured to connect the LED to the circuit. At 470, a glob-top can be applied to the bare die LED. One or more connectors can be provided at 480, and the circuit can undergo testing at 490.

EXAMPLE

Referring again to FIG. 1B, the example 10B can include a nominal 1K lumen emitter, such as having 20 parallel strings of nine series LEDs in a 55 cm by 25 cm panel format. Regulation of total current supplied to the light module 10 is not sufficient to describe how current is distributed throughout the module. Distribution of current in the example 10B can be determined by, among other factors, resistance characteristics throughout the module and the corresponding voltage drop. In an example, resistance of the bus bars is approximately 48 cm by 1 cm=48 square×0.1 ohm/square=4.8 ohms. For an average current over the length of the bus bar of 360/2=180 mA, the voltage drop is about 0.86V. In this example, the target current of 18 mA per LED requires a $V_f$ of 3.2V. Based on the $v_f$ vs. $I_f$ curve for the R3014UWC10 LED, a constant current power supply would provide 3.2+0.86/2=3.63V to the circuit, with the forward current $I_f$=30 mA through the first and last LEDs in the first series string. The last LED on the bus bar would see a voltage of 3.2−0.86/2=2.77V and an $I_f$ of 8 mA. Based on the characteristic curves for this LED, the first LED on the bus bar would produce five times the luminous flux of the last LED.

Because of the wide shunts between the strings, the next seven LEDs in the 20 series strings can be treated as a resistor with 360 mA flowing through it and a voltage drop of 7×3.2=22.4V. All of the interior LEDs would be exposed to the same input voltage and current and have the same luminous flux, at least to a first approximation.

The return bus bar is the mirror image of the supply bus bar. The voltage supplied to the first nine LEDs is then 3.63+22.4+3.63=29.7V. The LEDs at the end of the bus bars would experience a voltage of 2.77+22.4+2.77=27.9V. The result is that the top and bottom rows of LEDs would show a five-to-one luminance gradient from one end to the other, 0.5 to 2.5 of the target luminous flux. The interior LEDs and those at the center of the bus bars would all be at the target luminous flux, about 1.0.

This problem is resolved if two connectors are placed diagonally, such as in the upper left and lower right corners of the rectangular circuit (see, e.g., FIG. 1A at 22A and 24A). In this configuration, power supposed at the connectors can power the bus bars in a balanced, symmetrical, manner, rather than connecting at one end of the panel. The voltage to the farthest-most string of LEDs becomes 2.77+22.4+3.63=28.8V. The same voltage is seen by LEDs at the center and at the ends of the bus bars. The driver achieves 360 mA at 28.8V. Power is 28.8V×0.36 A=10.4 W, compared to 29.7 V×0.36 A=10.7 W for the circuit as designed. That is, in addition to uniformity of lighting, the balanced connections reduce ohmic heating losses from about 7% to about 4%. Maximum bus bar current density is 0.36 A/(1 cm×2×$10^{-5}$ cm)=1.8×$10^4$ A/$cm^{-2}$, which is in the safe zone. Thus, the present example demonstrates that a high-powered light module that includes an array of low powered LEDs that are electrically and mechanically attached to a thin-film flexible circuit can be achieved.

Additional components that can be added to improve performance to enhance bus bar conductivity include adding conductive tape, making the bus bars wider, folding or rolling one or more of the bus bars to reduce the panel width, or tinning at least a portion of the circuit with solder to lower sheet resistance and increase reflectivity. When compatible with the manufacturing process, wire, foil or flat braid can be laminated to high current bus bars using solder or conductive adhesives.

Figure 9:
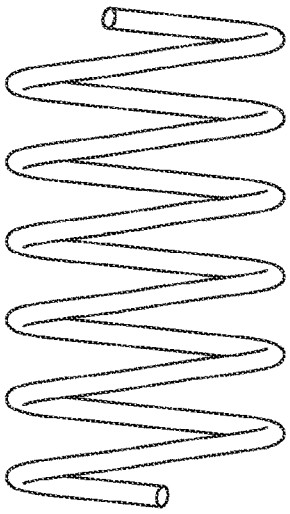
FIG. 9 is a perspective view of a spiral light emitter embodiment of the device for providing high-intensity illumination.
Figure 10:
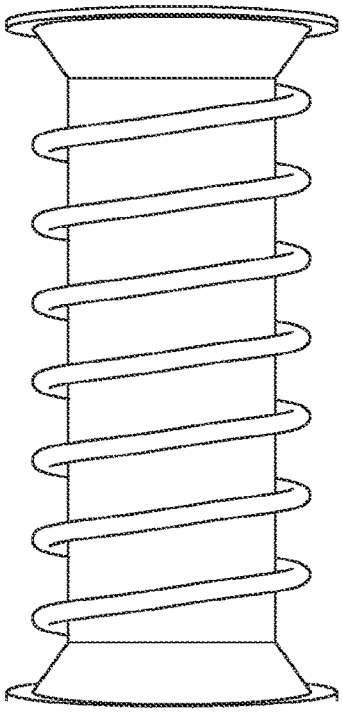
FIG. 10 is a side view of a column lighting device employing the device for providing high-intensity illumination.
Figure 11A:
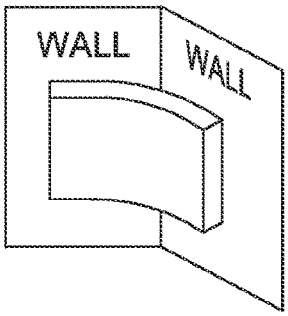
FIGS. 11A, 11B, 11C and 11D illustrate perspective and side views of light box embodiments that include the device for providing high-intensity illumination.
Figure 11B:
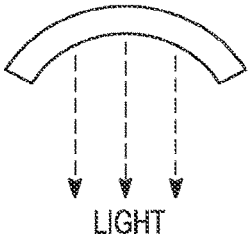
Figure 11C:
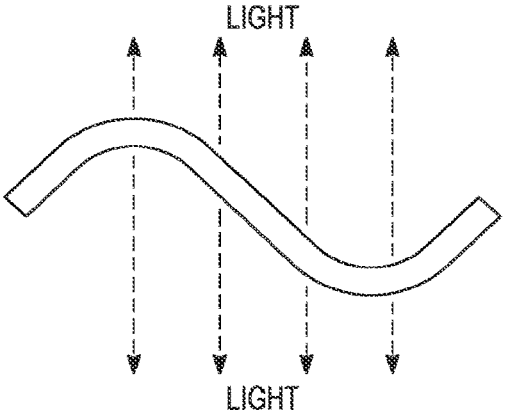
Figure 11D:
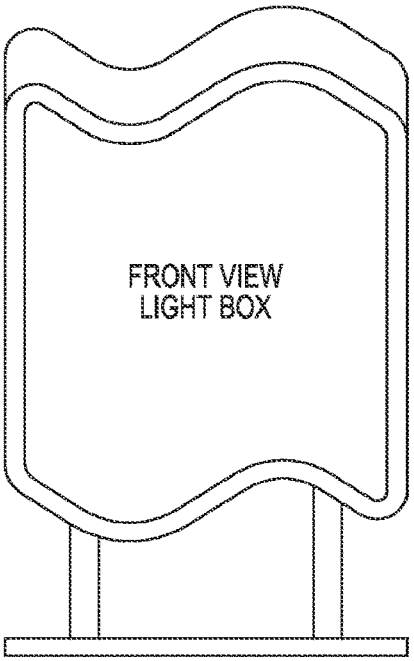
Figure 12A:
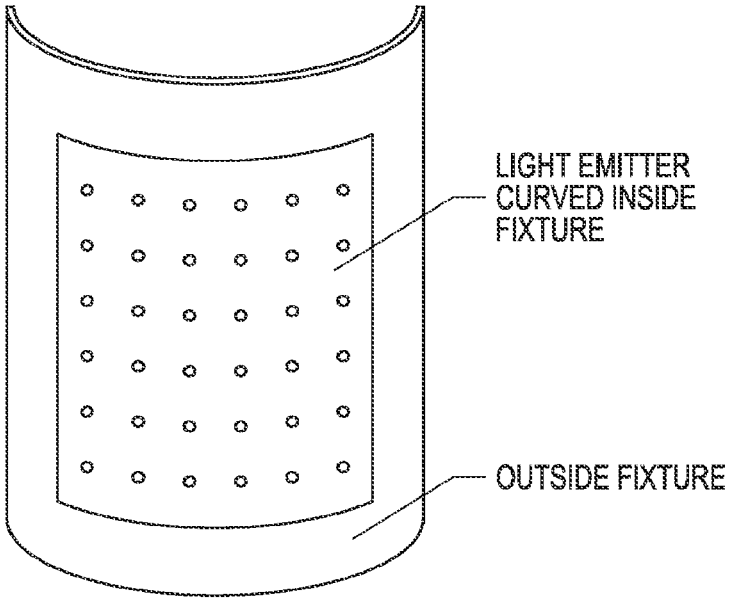
FIGS. 12A and 12B illustrate a perspective view and a side view of a wall sconce that includes the device for providing high-intensity illumination.
Figure 12B:
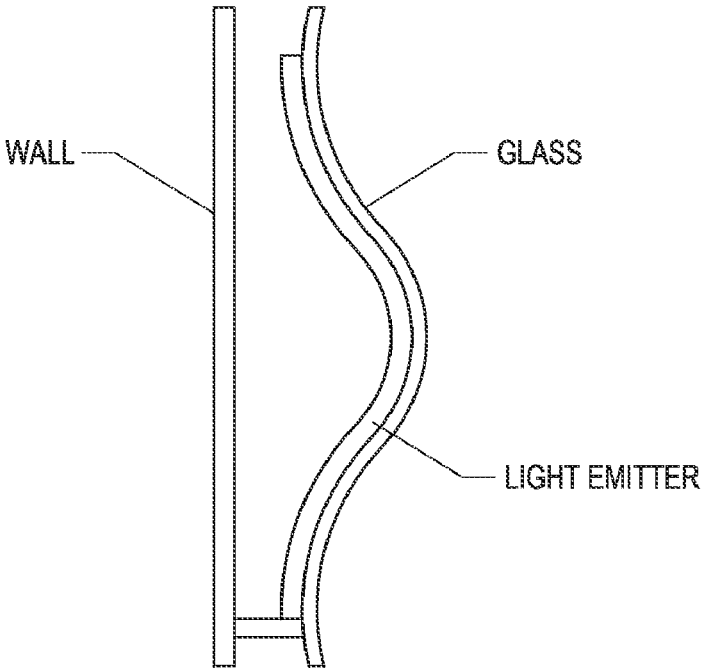
Figure 13A:
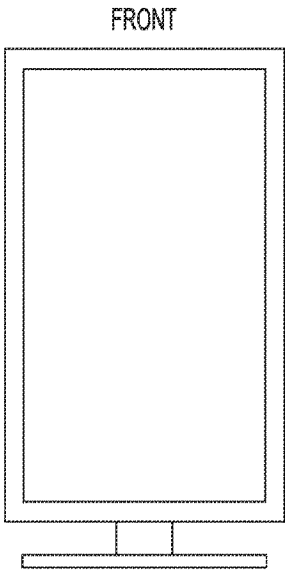
FIGS. 13A, 13B and 13C illustrate side views of street furniture that include the device for providing high-intensity illumination.
Figure 13B:
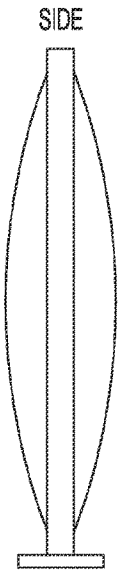
Figure 13C:
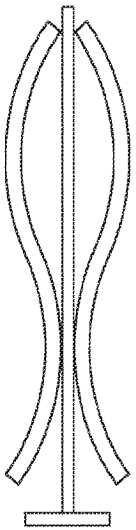
Figure 14:
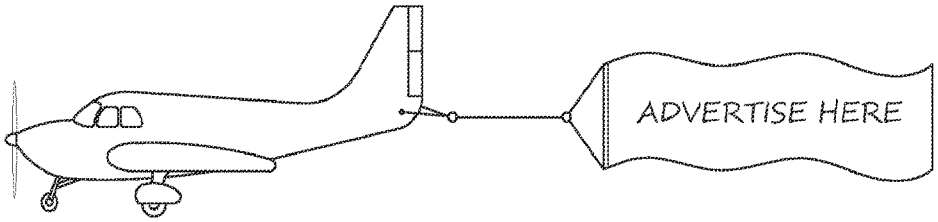
FIG. 14 illustrates a side view of an airplane banner that includes the device for providing high-intensity illumination.
Figure 15A:
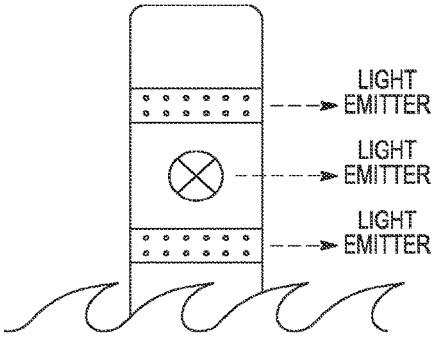
FIGS. 15A, 15B and 15C illustrate side views of a light emitting buoy that includes the device for providing high-intensity illumination.
Figure 15B:
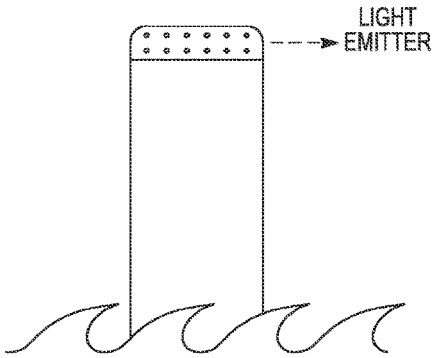
Figure 15C:
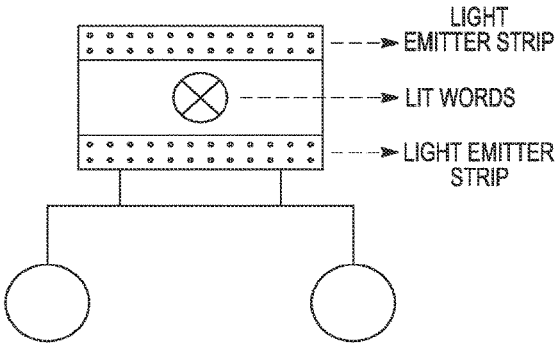
Figure 16A:
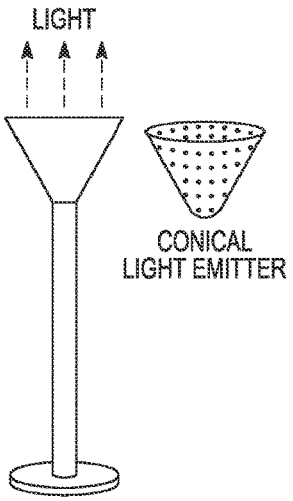
FIGS. 16A, 16B, 16C and 16D illustrate side views of standing upright lights that include the device for providing high-intensity illumination.
Figure 16B:
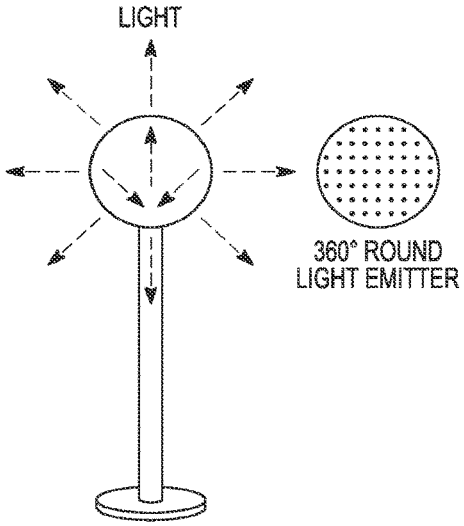
Figure 16C:
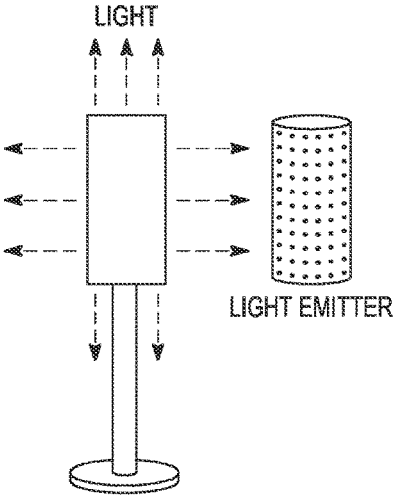
Figure 16D:
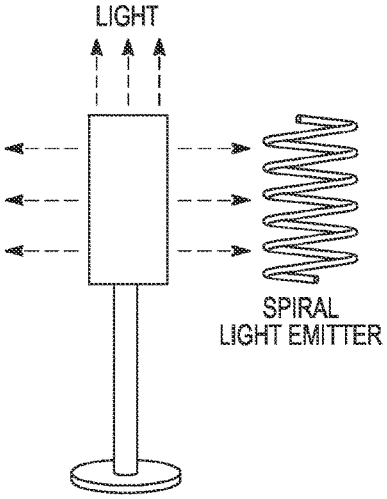

An LED light module as described herein can be used in multiple different configurations. For example, a light module can be used as a spiral light emitter shown in FIG. 9 and a column lighting device shown in FIG. 10. An LED light module can be used in a light box, such as shown in FIGS. 11A, 11B, 11C and 11D. An LED light module can be used in a wall sconce, such as shown in FIGS. 12A and 12B. Other embodiments include street furniture, FIGS. 13A, 13B and 13C; an airplane banner, FIG. 14; a buoy or floating sign, FIGS. 15A, 15B and 15C; and standing upright lights, FIGS. 16A, 16B, 16C, 16D.

Disclosure for U.S. Pat. No. 6,882,452:

In one embodiment, a diffractive grating that can be a uniform grating such as what is commonly referred to as a "rainbow" grating is applied to a polymer substrate by embossing the grating into the surface of the substrate. The transparent high refractive index coating is applied in a defined pattern on top of the grating. Subsequent processing, such as application of a heat or pressure sensitive adhesive, covers the complete areas including those areas that are coated with the high refractive index coating and those areas that are not coated with a high refractive index coating. The refractive index of the adhesive is preferably about the same as the embossed substrate, which causes the elimination of the diffractive effect in those areas that are not coated with a high refractive index coating.

The high reflection index coating is made from zinc sulfide (ZnS) that is applied in a vacuum coating process. The preferred thickness of the zinc sulfide coating is in the range of about 200 Angstrom to about 2500 Angstrom. The preferred method of applying the defined pattern of the zinc sulfide is to apply a material to the non-coated areas that prevents the deposition of zinc sulfide in these areas, yet does not pose any problem for subsequent processing. The choice of material for the deposition prevention is preferably chosen to not react with the zinc sulfide. A material that reacts with the zinc sulfide can cause the zinc sulfide to decompose and can cause unwanted deposition of metallic zinc, which lacks transparency. The applied pattern can contain features that add a level of security to the holographic device, such as alpha-numeric shapes.

In another embodiment, the application of the pattern is used to improve moisture resistance for laminated security holograms. The laminated holograms can be used on identification cards such as driver's licenses. The applied pattern provides frame like areas that are not coated with the high refractive index material such as zinc sulfide. The moisture driven corrosion of the high refractive index materials typically starts from the edges of the laminated sheet. An area without the corrosion sensitive high refractive index coating at the edges of the laminate provides an improved moisture barrier and reduces the corrosion and degradation of the high refractive index material.

Figure 17:
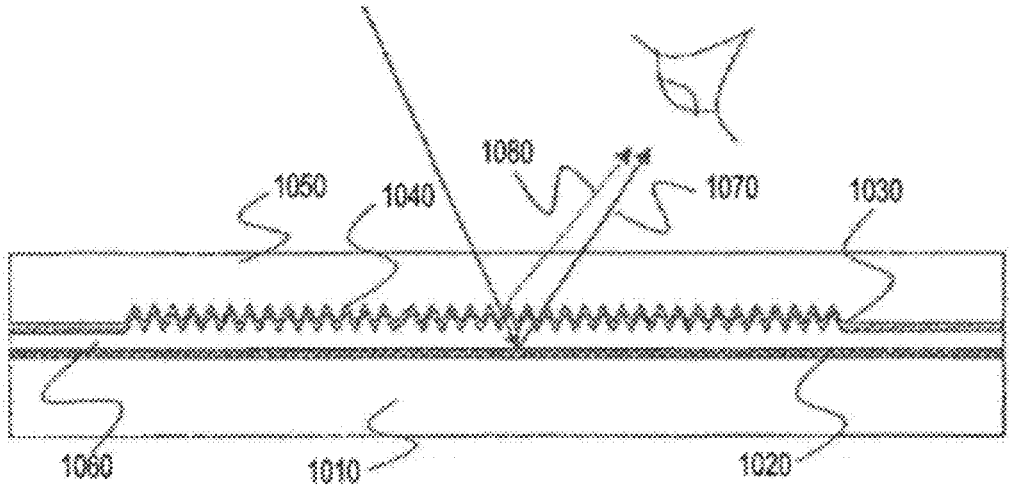
FIG. 17 PRIOR ART
FIG. 17 is a cross section of a prior art security device using diffractive gradings disclosed in U.S. Pat. No. 6,882,452.

FIG. 17 depicts a cross sectional view of an identity card prepared in accordance with this invention. A base 1010, made from polyvinyl chloride (PVC), carries printed information 1020. A transparent substrate 1050 is adhered to the base. The transparent substrate incorporates a holographic structure having a diffractive micro-grating 1040. Semi-transparent holographic image 1080 overlays over printed image 1070. An adhesive 1060 is used to bind the base substrate 1010 to the transparent structure 1050. The adhesive 1060 has a refractive index which is about the same as the micro-grated substrate. The refractive indices are within 0.2, more preferably within 0.15, most preferably within 0.1.

In order to achieve the diffracting effect within the grating, preferably there is a difference between the refractive index of the micro-grating and any subsequent layer. Preferably, the difference is at least 0.2, more preferably at least 0.5, most preferably at least 0.7. This difference can be achieved by applying a thin layer of high refractive index material 1030 on the micro-grated surface.

Figure 18:
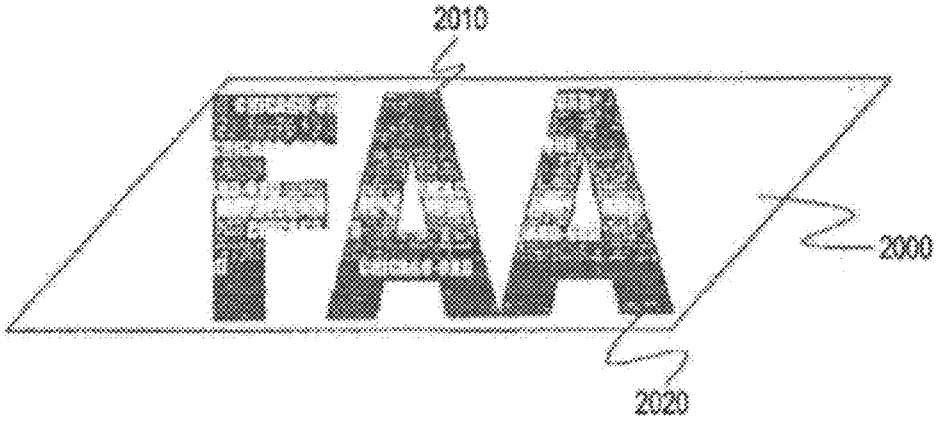
FIG. 18 PRIOR ART
FIG. 18 is a prior art vacuum coating device for the production of thin-film high-refractive-index coatings that include a device for the application of a pattern disclosed in U.S. Pat. No. 6,882,452.

In one embodiment, there are areas that purposely are not covered with high refractive index material. As previously stated, the close match of the refractive indices between the adhesive and the substrate carrying the diffractive grating minimizes diffraction at the interface. This makes it difficult to detect any holographic effect in these areas. FIG. 18 shows an example of this embodiment. In FIG. 18 holographic information exhibits the letters "FAA" based on a rainbow color diffraction pattern 2020. A pattern exhibiting the letters CHICAGO-ORD has been imposed on the substrate carrying the holographic structure so that deposition of the high refractive index material was prevented in these areas 2010. When this structure is laminated to the ID card, the non-coated areas become fully transparent, exposing information lying underneath, without exhibiting the holographic information.

Figure 19:
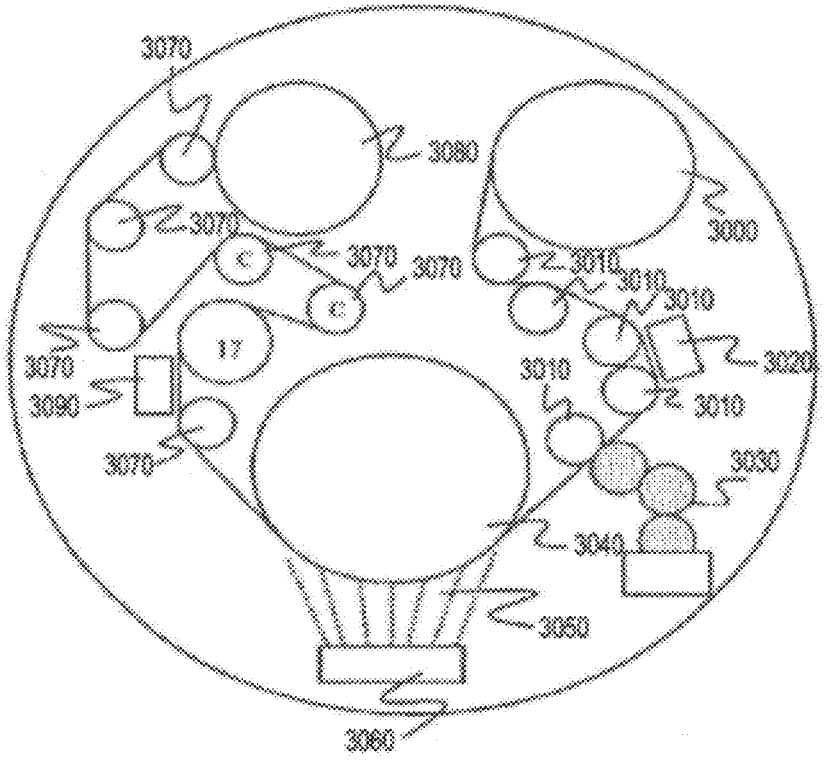
FIG. 19 PRIOR ART
FIG. 19 is a pattern application apparatus disclosed in U.S. Pat. No. 6,882,452.

The deposition of the high-refractive-index coating is preferably accomplished in a vacuum coating machine. A preferred machine is depicted in FIG. 19. The unwind roll 3000 contains a web like substrate, which can be either pre-embossed with the diffraction grating or non-embossed for direct embossing through the high refractive index coating. The unwound substrate is preferably guided through a surface treatment process 3020 using transport rollers 3010. The treatment process 3020 exposes the surface to a treatment with ionized gases. The substrate is then directed to evaporation roller 3040. An evaporator 3060 is used to apply a high refractive index material to substrate on roller 3040. The evaporator 3060 can be of any kind that is capable of creating a vapor cloud 3050 that is sufficient to condense the preferred high refraction index material onto the surface of the film at an appropriate speed. For example, resistively heated evaporators, electron beam evaporators or sputter sources can be used. The substrate is then rewound onto rewind roll 3080, using return rollers 3070. Subsequent processing that is not depicted here would include embossing (in case of direct-embossable substrates), application of the adhesive, slitting, die cutting and lamination to the ID.

The generation of a pattern free of high-refractive-index material can be achieved by applying a coating to the surface of the substrate that prevents the deposition of the high refractive index material. Preferable patterns for the pattern free of high-refractive-index material include letters, numerals and figures. The coating can be applied with a printing type system 3030 prior to the exposure of the surface to the evaporator 3060. The deposition prevention coating can include, for example, oils which are unreactive with the reflective material.

Some preferable oils start evaporating upon exposure to the heat generated by the evaporator, thus defeating condensation of material in the areas covered by these oils. Other preferable oils have a low surface energy preventing nucleation of the evaporated high refractive index materials on the substrate surface. The method of applying the deposition prevention coating in a pattern is commonly known as "pattern metallizing" in the zinc and aluminum metallizing industries, and is used for capacitor applications.

However, the technology used in other industries cannot be simply transferred to the deposition of high refractive index materials, as interactions between the high refractive index material and the oils, particularly if the high refractive index material is zinc sulfide, may occur. Chemical interaction between the evaporated oil and the zinc sulfide can lead to decomposition of the zinc sulfide. This can result in metallic zinc being deposited on the substrate, instead of zinc sulfide, destroying the transparency of the coating. Another problem is the low evaporation temperature of the high refractive index material as well as the low substrate speed, which can change the energy level to which the applied oil pattern is exposed. This can change the evaporation behavior of the deposited oil and how easily the oil can be removed.

Preferably, the deposition prevention coating is completely removed prior to further processing, as it may interfere with some of the functions of the subsequent processes. For example, oil from the deposition prevention coating may interfere with the adhesives used in the lamination processes. Removal of the oil preferably occurs during the vapor-coating process itself, since the oil may, as described above, evaporate upon exposure to the heat from the evaporator. In another embodiment, a post treatment with ionized gases 3090 may remove, react or cross-link the oils to a degree that they do not interfere with the functionality of subsequent processes.

Figure 20:
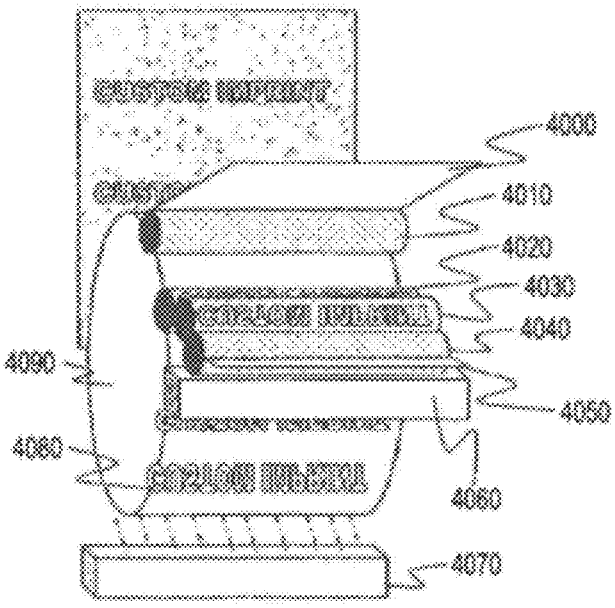
FIG. 20 PRIOR ART
FIG. 20 is an example of a holographic device exposing an applied pattern disclosed in U.S. Pat. No. 6,882,452.

FIG. 20 depicts one embodiment of an apparatus used to apply the coating that prevents deposition of the high-reflective-index material. A pickup roller 4040 picks up oil that is used to prevent the deposition of the high refractive index material. A doctor blade 4050 controls the amount of oil transported by the pickup roller 4040. The oil is then transferred to the pattern roller 4030 bears the pattern for the oil to be applied to the substrate 4000. The pattern roller 4030 transfers the oil to print roller 4020. The print roller 4020 in turn applies the patterned oil 4080 to the web substrate 4000 on coating drum 4090. Evaporator 4070 is then used to deposit a high refractive index coating onto substrate 4000 containing the patterned oil 4080. In another embodiment, the pattern roller 4030 has the function of the print roller.

Using print rollers to apply a pattern to holographic areas can be used to more easily create unique holograms. Creating original holograms, and producing the embossing tools to reproduce the holograms, is generally much more complicated than the production of high end print rollers. Therefore, it is possible to use a less sophisticated diffraction pattern and add complexity to the item by applying varying patterns of non-coated areas. Further, it is possible to use a highly sophisticated pattern and still add another level of security by applying another sophisticated pattern of non-deposited areas. For example, the aforementioned ID card with the FAA hologram could be customized for use at different airports by applying an airport specific pattern of non-deposited areas to the hologram. Yet another level of complexity can be achieved if the pattern of non-deposited areas exhibits a micro-structure in itself that can only be read with high magnification.

Figure 21:
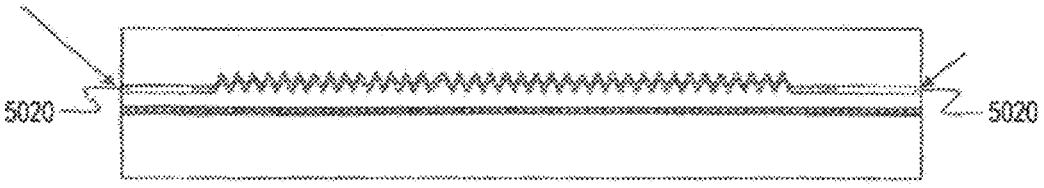
FIG. 21 PRIOR ART
FIG. 21 is a cross sectional view of a hologram exposed to moisture disclosed in U.S. Pat. No. 6,882,452.
Figure 22:
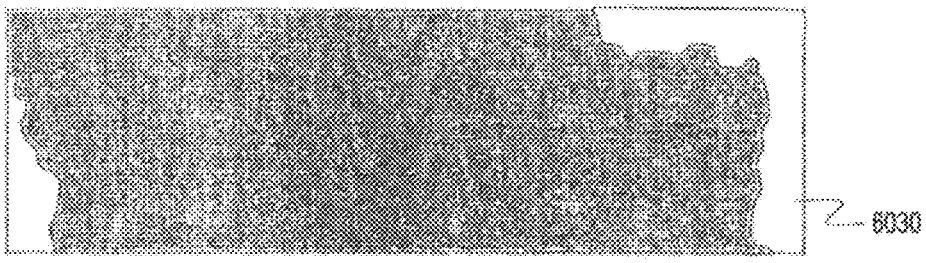
FIG. 22 PRIOR ART
FIG. 22 is a top plan view of a hologram exposed to moisture disclosed in U.S. Pat. No. 6,882,452.

Another aspect of this invention is the increased resistance to moisture corrosion of semi-transparent holograms. Zinc sulfide, which is commonly used in semi-transparent holograms, is water-soluble. Exposure of the holographic structure to increased humidity, therefore, can slowly destroy the holographic features as the zinc sulfide starts decomposing with exposure to moisture. Typically, the corrosion of the zinc sulfide starts at the edges of the laminate, as shown in FIGS. 21 and 22. FIG. 21 is a cross-sectional view of a hologram exposed to moisture. FIG. 22 is a top plan view of a hologram exposed to moisture. The zinc sulfide is most prominently exposed at the edges of the laminate, whereas in other areas the coating is better protected by the water vapor resistance of the hologram carrying substrate. Once corrosion at the edge begins, it opens a diffusion path for water vapor through which the corrosion can spread into the structure 5020. A side effect of this phenomenon is delamination of the holographic structure from the carrier substrate starting at the edge where corrosion begins 6030.

In an embodiment of this invention a pattern of a coating that prevents deposition of the high refractive index material is applied in a frame-like pattern. The holographic substrate is then cut in such a way that the frame-like area having no high refractive index material defines the edge of the structure being laminated to the ID card. The absence of high refractive index material on the edge of the laminate reduces the risk of corrosion and early delamination at the edges.

Micro Cold Spray Process

A description of the '919 process is as follows:

One aspect of the present invention relates to a conductive ink composition that includes at least one monomer containing exactly one ethylenically unsaturated group, one or more thermoplastic polymers, one or more initiators, and conductive particles.

Any monomer containing exactly one double bond can be used in this invention. Examples of such monomers are those that contain exactly one double bond and that have low vapor pressure at ambient temperatures. Suitable monomers containing exactly one double bond include, for example, tetrahydrofurfuryl acrylate, methacrylic acid, isobornyl acrylate, alkoylated tetrahydrofurfuryl acrylate, acrylate ester glycol, cyclic trimethylol propane formal acrylate, N-vinyl pyrrolidone, acrylic acid, 2-(ethoxy ethoxy) ethyl acrylate, ethoylated phenol acrylate, and the like. Combinations of these and other monomers containing exactly one double bond can also be employed. For example, the conductive ink composition can include exactly one monomer containing exactly one ethylenically unsaturated group, exactly two monomers containing exactly one ethylenically unsaturated group, exactly three monomers containing exactly one ethylenically unsaturated group, exactly four monomers containing exactly one ethylenically unsaturated group, etc.

In addition to containing at least one monomer containing exactly one ethylenically unsaturated group, the conductive ink composition of the present invention also includes one or more thermoplastic polymers. Suitable thermoplastic polymers include those having a molecular weight of from about 1000 to about 1,000,000 g/mole, such as from about 2000 to about 500,000 g/mole, from about 5000 to about 300,000 g/mole, from about 10,000 to about 200,000 g/mole, etc.; those having a glass transition temperature in the range of −75° C. to 120° C., such as from about −75° C. to about 120° C., from −75° C. to 120° C., from about −50° C. to about 100° C., from −50° C. to 100° C., from about −30° C. to about 80° C., from 30° C. to 80° C., from about −10° C. to about 60° C., from −10° C. to 60° C., etc.; and/or those having a molecular weight of from about 1000 to about 1,000,000 g/mole and having a glass transition temperature in the range of −75° C. to 120° C. The thermoplastic polymer should be chosen such that it is compatible with the monomer. Illustratively, suitable thermoplastic polymers include poly(methyl methacrylate), poly(styrene), poly(butyl methacrylate), poly(butyl acrylate), etc. Combinations of these and other thermoplastic polymers can also be employed. For example, the conductive-ink composition can include exactly one thermoplastic polymer, exactly two thermoplastic polymers, exactly three thermoplastic polymers, exactly four thermoplastic polymers, etc.

As noted above, the conductive ink composition of the present invention also includes one or more initiators. The initiator can be any initiator used in free radical polymerizations.

In certain embodiments, at least one initiator is a photoinitiator. In other embodiments, at least one initiator is a photoinitiator, and the conductive ink composition is substantially free from thermal initiators. In still other embodiments, at least one initiator is a thermal initiator. In yet other embodiments, at least one initiator is a thermal initiator, and the conductive ink composition is substantially free from photoinitiators. In still other embodiments, the conductive ink composition includes at least one photoinitiator and at least one thermal initiator.

Suitable photoinitiators include those that are active with ultraviolet as well as those that are active with visible light. Examples of suitable photoinitiators that can be used in the conductive ink compositions of the present invention include Irgacure 369 (2-benzyl-2-(dimethylamino)-1-[4-(4-morphonyl)phenyl]); Sarcure SR1135 (2,4,6-trimethylbenzodiphenyl phosphine oxide; 2,4,6-trimethylbenzophenone; 4-methyl bezophenone; oligo(2-hydroxy-2-methyl-1-(4-(1-methylvinyl)phenyl)propanone)); Darocur 1173 (2-hydroxy-2-methyl-1-phenyl-1-propanone); benzophenone; Irgacure 184 (1-hydroxycyclohexyl phenyl ketone); Irgacure819 (phosphine oxide, phenylbis(2,4,6-trimethyl benzoyl), and the like. Bimolecular photoinitiators, such as those composed of an initiator (e.g., benzophenone) and amine synergist (e.g., an amine acrylate) can also be employed. Combinations of these and other photoinitiators can also be employed. For example, the conductive ink composition can include exactly one photoinitiator, exactly two photoinitiators, exactly three photoinitiators, etc.

Suitable thermal initiators include benzoyl peroxide, di-t-butyl peroxide, t-butyl peroctoate, t-amyl-peroxy-2-ethyl hexanoate, hydrogen peroxide, potassium or ammonium peroxydisulfate, dibenzoyl peroxide, lauryl peroxide, 2,2'-azobisisobutyronitrile, 2,2'-azobisisovaleronitrile t-butylperoxide, t-butyl hydroperoxide, sodium formaldehyde sulfoxylate, cumenehydroperoxide, dicumylperoxide, and the like. Combinations of these and other thermal initiators can also be employed. For example, the conductive ink composition can include exactly one thermal initiator, exactly two thermal initiators, exactly three thermal initiators, etc.

The conductive ink composition of the present invention also includes conductive particles, such as conductive metal particles. Examples of suitable conductive metal particles include metal powders, metal flakes, metal-coated beads, and combinations thereof. The conductive metal particles can include any suitable metal, such as aluminum, silver, gold, copper, and mixtures, alloys, and other combinations thereof. The conductive particles can be non-metallic, for example, as in the case where the conductive particles are made from or otherwise contain conductive polymeric materials. Specific examples of suitable conductive particles include silver flake, silver nanopowder, silver acorn, and silver-coated beads, such as silver-coated glass beads.

The conductive ink composition of the present invention can, optionally, include other components. The other components can be chosen to optimize the rheological and other properties of the conductive ink composition. However, they should be selected such that they do not adversely affect the conductivity of the ink composition. Moreover, the other components should be selected such that the conductive ink composition, after polymerization, forms a thermoplastic polymer and/or a polymer that flows and/or deforms upon application of heat and/or pressure.

For example, the conductive ink composition of the present invention can also include one or more monomers containing more than one ethylenically unsaturated group. When employed, the amount of monomer(s) containing more than one ethylenically unsaturated group should be limited such that the conductive ink composition, after polymerization, is a thermoplastic and not a thermoset. Illustratively, the conductive ink composition of the present invention can further include one or more monomers containing more than one ethylenically unsaturated group, wherein the weight ratio of monomers containing more than one ethylenically unsaturated group to monomers containing exactly one ethylenically unsaturated group is less than 1:5, such as less than 1:10, less than 1:20, less than 1:30, less than 1:40, less than 1:50, less than 1:60, less than 1:70, less than 1:80, less than 1:90, and/or less than 1:100. Alternatively, the conductive ink composition can be substantially free of monomers containing more than one ethylenically unsaturated group.

As further illustration, the conductive ink compositions of the present invention can also include a volatile organic solvent, such as butyl acetate, or other solvent. Alternatively, the conductive ink compositions of the present invention can be substantially free of volatile organic solvent.

It is preferred that the conductive ink compositions be formulated such that the conductive ink composition hardens to a tack-free material upon polymerization.

In the case where the conductive ink compositions contain at least one photoinitiator, it is preferred that the conductive ink compositions be formulated such that the conductive ink composition hardens to a tack-free material upon exposure to radiation, for example, upon exposure to radiation for less than 1 hour at an intensity of less than 100 mW/cm2. It is also preferred that the conductive ink compositions be formulated such that the conductive ink composition harden to a tack-free, thermoplastic material (e.g., a conductive, tack-free, thermoplastic material) upon exposure to radiation, for example, upon exposure to radiation for less than 1 hour at an intensity of less than 100 mW/cm2. As one skilled in the art will appreciate, the type of radiation to which the conductive ink composition should be exposed to effect curing depends on the nature of the monomer(s) present in the formulation and the kind(s) of photoinitiators employed. For example, curing can be effected by exposure to electromagnetic radiation of a suitable wavelength or range of wavelengths, such as visible radiation or UV radiation.

In the case where the conductive ink compositions contain at least one thermal initiator, it is preferred that the conductive ink compositions be formulated such that the conductive ink composition hardens to a tack-free material upon exposure to heat, for example, upon exposure to temperatures of less than 160° C. for less than 1 hour. It is also preferred that the conductive ink compositions be formulated such that the conductive ink composition harden to a tack-free, thermoplastic material (e.g., a conductive, tack-free, thermoplastic material) upon exposure to heat, for example, upon exposure to temperatures of less than 160° C. for less than 1 hour. As one skilled in the art will appreciate, the temperatures and duration of heating to which the conductive ink composition should be exposed to effect curing depends on the nature of the monomer(s) present in the formulation and the kind(s) of thermal initiators employed.

As one skilled in the art will appreciate, the selection of specific monomers (monomer(s) containing exactly one ethylenically unsaturated group and optional monomer(s) containing more than one ethylenically unsaturated group), specific thermoplastic polymers(s), specific conductive particles, and specific volatile organic solvent (if employed) and the relative amounts of each of these components will depend on the intended use of the conductive ink composition and the manner in which it is to be delivered. For example, the conductive ink composition can be formulated for ink-jet printing, or it can be formulated for screen printing.

The conductive ink compositions of the present invention can be produced by any suitable method. For example, the monomers (monomer(s) containing exactly one ethylenically unsaturated group and optional monomer(s) containing more than one ethylenically unsaturated group) can be mixed together with the thermoplastic polymer(s), with optional gentle heating and/or stirring, until a solution (e.g., a clear solution) is achieved. The initiators (e.g., photoinitiator(s), thermal initiator(s), or combinations thereof) can then be added to produce an organic binder for the conductive ink. The desired amount of conductive particles can then be slowly added to and mixed (e.g., using a mortar and pestle) with the organic binder to form a paste, preferably, a homogeneous paste (e.g., a paste that appears uniform to the unaided eye). Again, depending on how the conductive ink composition is to be employed, viscosity can be adjusted, for example, by adding a suitable volatile organic solvent, such as butyl acetate.

Once the conductive ink composition is produced, for example, by using the method discussed above, it can be applied a substrate (e.g., by ink-jet printing, screen printing, etc.) or it can be cast into a desired shape or formed into a film, etc., and then cured or otherwise polymerized into a thermoplastic material, to which thermoplastic material the present invention also relates. As noted above, depending on the kinds of initiators employed, polymerization of the conductive ink composition can be effected by exposure to suitable radiation, such as visible radiation or UV radiation for a suitable period of time (e.g., for from 1 second to 1 hour, such as from about 5 seconds to about 30 minutes, from 5 seconds to 30 minutes, from about 10 seconds to about 20 minutes, from 10 seconds to 20 minutes, from about 30 seconds to about 10 minutes, from 30 seconds to 10 minutes, from about 40 seconds to about 10 minutes, from 40 seconds to 10 minutes, from about 1 minute to about 5 minutes, and/or from 1 minute to 5 minutes; for less than 5 minutes, such as less than about 3 minutes, less than 3 minutes, less than about 2 minutes, less than 2 minutes, less than about 1 minute, less than 1 minute, less than about 45 seconds, less than 45 seconds, less than about 30 seconds, less than 30 seconds, less than about 15 seconds, less than 15 seconds; etc.) at a suitable intensity (e.g., from about 5 mW/cm2 to about 300 mW/cm2, such as from 5 mW/cm2 to 300 mW/cm2, from about 10 mW/cm2 to about 200 mW/cm2, from 10 mW/cm2 to 200 mW/cm2, from about 20 mW/cm2 to about 100 mW/cm2, from 20 mW/cm2 to 100 mW/cm2, from about 30 mW/cm2 to about 60 mW/cm2, from 30 mW/cm2 to 60 mW/cm2, and/or at about 40 mW/cm2); by heating at a suitable temperature (e.g., at from about 40° C. to about 180° C., such as from 40° C. to 180° C., from about 50° C. to about 175° C., from 50° C. to 175° C., from about 60° C. to about 170° C., from 60° C. to 170° C., from about 70° C. to about 165° C., and/or from 70° C. to 165° C.; at from about 50° C. to about 70° C., from 50° C. to 70° C., from about 70° C. to about 80° C., from 70° C. to 80° C., from about 80° C. to about 90° C., from 80° C. to 90° C., from about 90° C. to about 100° C., from 90° C. to 100° C., from about 100° C. to about 110° C., from 100° C. to 110° C., from about 110° C. to about 120° C., from 110° C. to 120° C., from about 120° C. to about 130° C., from 120° C. to 130° C., from about 130° C. to about 140° C., from 130° C. to 140° C., from about 140° C. to about 150° C., from 140° C. to 150° C., from about 150° C. to about 160° C., from 150° C. to 160° C., from about 170° C. to about 170° C., from 160° C. to 170° C., from about 170° C. to about 180° C., from 170° C. to 180° C.; etc.) for a suitable period of time (e.g., for from 20 seconds to 3 hours, such as from about 30 seconds to about 2 hours, from 30 seconds to 2 hours, from about 1 minute to about 90 minutes, from 1 minute to 90 minutes, from about 1 minute to about 60 minutes, from 1 minute to 60 minutes, from about 2 minutes to about 60 minutes, from 2 minutes to 60 minutes, from about 5 minutes to about 45 minutes, from 5 minutes to 45 minutes, from about 5 minutes to about 30 minutes, and/or from 5 minutes to 30 minutes; for less than 3 hours, such as less than about 2 hours, less than 2 hours, less than about 1 hour, less than 1 hour, less than about 45 minutes, less than 45 minutes, less than about 30 minutes, and/or less than 30 minutes; etc.), such as by heating at about 160° C. for about 20 minutes; or by a combination of exposure to radiation and heating.

The present invention, in another aspect thereof, relates to a conductive thermoplastic material that includes at least one thermoplastic polymer produced by polymerization of one or more monomers containing exactly one ethylenically unsaturated group; and conductive particles dispersed in the thermoplastic polymer.

In some embodiments, the at least one thermoplastic polymer is one that is produced by photopolymerization of one or more monomers containing exactly one ethylenically unsaturated group. In some embodiments, the at least one thermoplastic polymer is one that is produced by photopolymerization of one or more monomers containing exactly one ethylenically unsaturated group, and the conductive thermoplastic material is substantially free of thermoplastic polymers produced by thermal polymerization of one or more monomers containing exactly one ethylenically unsaturated group. In some embodiments, the at least one thermoplastic polymer is one that is produced by thermal polymerization of one or more monomers containing exactly one ethylenically unsaturated group. In some embodiments, the at least one thermoplastic polymer is one that is produced by thermal polymerization of one or more monomers containing exactly one ethylenically unsaturated group, and the conductive thermoplastic material is substantially free of thermoplastic polymers produced by photopolymerization of one or more monomers containing exactly one ethylenically unsaturated group. In some embodiments, the conductive thermoplastic material includes at least one thermoplastic polymer produced by simultaneous thermal and photo polymerization of one or more monomers containing exactly one ethylenically unsaturated group. In some embodiments, the conductive thermoplastic material comprises at least one thermoplastic polymer produced by photopolymerization of one or more monomers containing exactly one ethylenically unsaturated group and at least one thermoplastic polymer produced by thermal polymerization of one or more monomers containing exactly one ethylenically unsaturated group.

Illustratively, the thermoplastic polymer can be produced by polymerization of one or more of the following monomers: tetrahydrofurfuryl acrylate, methacrylic acid, isobornyl acrylate, alkoylated tetrahydrofurfuryl acrylate, acrylate ester glycol, cyclic trimethylol propane formal acrylate, N-vinyl pyrrolidone, acrylic acid, 2-(ethoxy ethoxy) ethyl acrylate, ethoylated phenol acrylate, and the like. Thermoplastic polymers that are produced by polymerization of combinations of these and other monomers containing exactly one double bond can also be employed. For example, the thermoplastic polymer can be the polymerization product of exactly one monomer containing exactly one ethylenically unsaturated group, of exactly two monomers containing exactly one ethylenically unsaturated group, of exactly three monomers containing exactly one ethylenically unsaturated group, of exactly four monomers containing exactly one ethylenically unsaturated group, etc.

The thermoplastic materials of the present invention also include conductive particles (e.g., conductive metal particles) dispersed in the thermoplastic polymer. Examples of suitable conductive metal particles include metal powders, metal flakes, metal-coated beads, and combinations thereof. The conductive metal particles can include any suitable metal, such as aluminum, silver, gold, copper, and mixtures, alloys, and other combinations thereof. The conductive particles can be non-metallic, for example, as in the case where the conductive particles are made from or otherwise contain conductive polymeric materials. Specific examples of suitable conductive particles include silver flake, silver nanopowder, silver acorn, and silver-coated beads, such as silver-coated glass beads.

The thermoplastic materials of the present invention can, optionally, include other components. The other components can be chosen, for example, the stability of the thermoplastic material or its glass transition temperature. However, the other components should be selected such that they do not adversely affect the conductivity of the thermoplastic materials. Moreover, the other components should be selected such that the thermoplastic material retains its thermoplasticity (i.e., its ability to flow and/or deform upon application of heat and/or pressure).

For example, in addition to containing the aforementioned at least one thermoplastic polymer produced by polymerization of one or more monomers containing exactly one ethylenically unsaturated group, the thermoplastic material of the present invention can also include one or more additional thermoplastic polymers. The additional thermoplastic polymer can be one that is produced by photopolymerization, or it can be one that is not produced by photopolymerization; the additional thermoplastic polymer can be one that is produced by thermal polymerization, or it can be one that is not produced by thermal polymerization; and/or the additional thermoplastic polymer can be one that is produced by a combination of photopolymerization and thermal polymerization. Illustratively, the thermoplastic material of the present invention can further include a second thermoplastic polymer having, for example, having a molecular weight of from about 1000 to about 1,000,000 g/mole, such as from about 2000 to about 500,000 g/mole, from about 5000 to about 300,000 g/mole, from about 10,000 to about 200,000 g/mole, etc.; having a glass transition temperature in the range of −75° C. to 120° C., such as from about −75° C. to about 120° C., from −75° C. to 120° C., from about −50° C. to about 100° C., from −50° C. to 100° C., from about −30° C. to about 80° C., from −30° C. to 80° C., from about −10° C. to about 60° C., from −10° C. to 60° C., etc.; and/or having a molecular weight of from about 1000 to about 1,000,000 g/mole and having a glass transition temperature in the range of −75° C. to 120° C. The second thermoplastic polymer should be chosen such that it is compatible with the first thermoplastic polymer (i.e., the thermoplastic polymer produced by polymerization of one or more monomers containing exactly one ethylenically unsaturated group). Illustratively, suitable additional thermoplastic polymers that can be incorporated into the thermoplastic material of the present invention include poly(methyl methacrylate), poly(styrene), poly(butyl methacrylate), poly(butyl acrylate), etc. Combinations of these and other thermoplastic polymers can also be employed. For example, the thermoplastic materials can include exactly one additional thermoplastic polymer, exactly two additional thermoplastic polymers, exactly three additional thermoplastic polymers, exactly four additional thermoplastic polymers, etc.

Additionally, or alternatively, the conductive thermoplastic materials of the present invention can also include one or more thermoset polymers. When employed, the amount of thermoset polymers should be limited such that the thermoplastic material is a thermoplastic and not a thermoset. Illustratively, the conductive thermoplastic materials of the present invention can further include one or more thermoset polymers, wherein the weight ratio of thermoset polymers to thermoplastic polymers is less than 1:5, such as less than 1:10, less than 1:20, less than 1:30, less than 1:40, less than 1:50, less than 1:60, less than 1:70, less than 1:80, less than 1:90, and/or less than 1:100. Alternatively, the conductive thermoplastic materials can be substantially free of thermoset polymers.

The thermoplastic materials of the present invention and those produced in accordance with the above-described method (e.g., by polymerization of a conductive ink composition of the present invention) can be used in the production of electronic devices, and the present invention, in yet another aspect thereof, relates to such electronic devices.

More particularly, such electronic devices of the present invention include two or more electronic components in electrical communication with one another via one or more conductive traces and/or interconnects, where at least some of the conductive traces and/or interconnects include a thermoplastic material of the present invention or a thermoplastic material produced by polymerization of a conductive ink composition of the present invention. The electronic components that are in electrical communication with one another via the one or more conductive traces and/or interconnects can be the same or different, and they can be selected from resistors, capacitors, transistors, integrated circuits or other electronic chips, diodes, antennae, and grounds (e.g., grounding straps, grounding bars, etc.).

As used herein, "electronic devices" are meant to include any device that includes electronic components. Illustratively, they are meant to include, circuit boards, computers, cell phones, PDAs, electronic games, data storage and retrieval devices, cameras, radio frequency identification ("RFID") devices, and the like.

As is evident from the above discussion, the thermoplastic materials of the present invention and those produced in accordance with the above-described method (e.g., by polymerization of a conductive ink composition of the present invention) provide an electrical connection between at least two electronic components of the electronic device. The thermoplastic material can also provide a mechanical bond with at least one of the electronic components. This can be achieved, for example, by applying heat and/or pressure sufficient to cause the thermoplastic material to flow and/or deform to produce a mechanical bond with the electronic component.

It will be appreciated that electronic devices frequently include non-electronic components (e.g., insulating layers, encapsulation layers, plastic structural components, insulating housings etc.), and the above-described thermoplastic materials can also provide a mechanical bond with one or more such non-electronic components of the electronic device. This can be achieved, for example, by bringing the thermoplastic material into contact with the non-electronic component and applying heat and/or pressure sufficient to cause the thermoplastic material to deform and produce a mechanical bond with the non-electronic component.

Figure 23A:
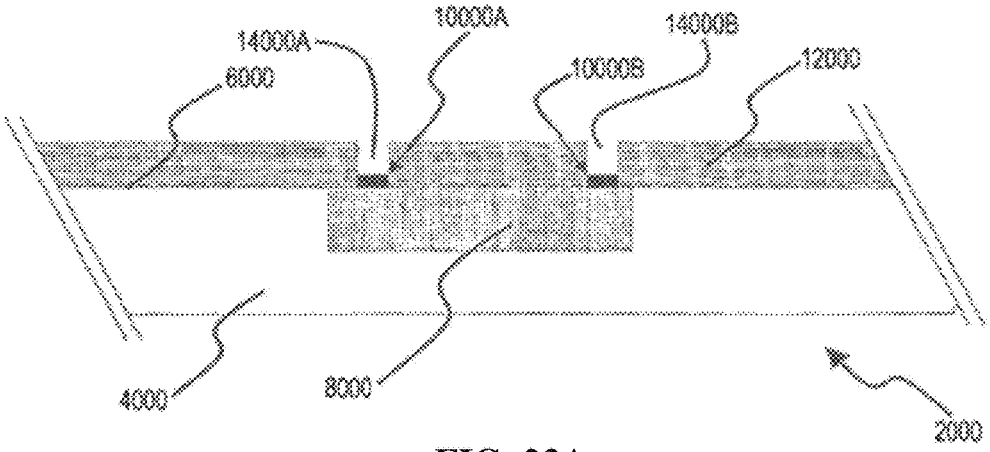
FIG. 23A PRIOR ART
FIGS. 23A-23C are schematic drawings of a method of using a conductive ink composition of the present invention for the manufacture of a radiofrequency identification electronic device, disclosed in U.S. Application No. US 20090173919A1.
Figure 23B:
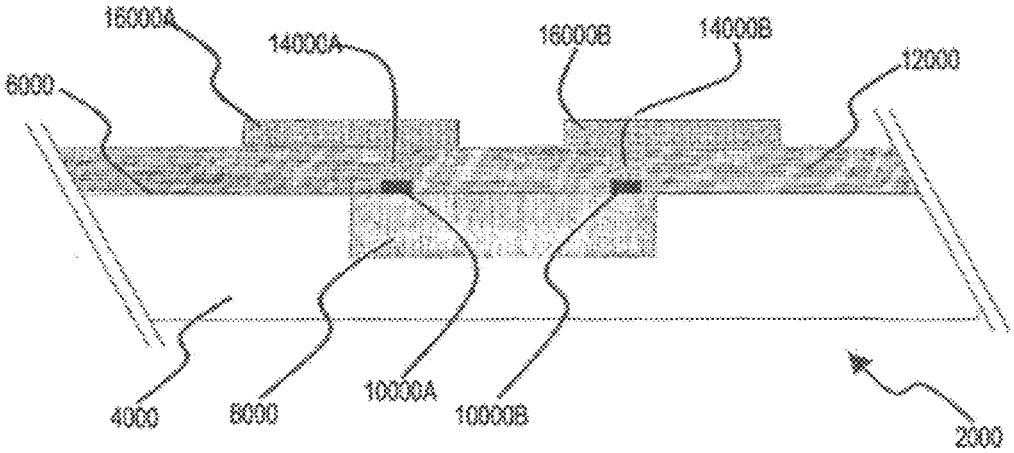
FIG. 23B PRIOR ART

One method for using a conductive ink composition of the present invention to produce a thermoplastic material useful in the fabrication of electronic devices is schematically illustrated in FIGS. 23A-1C and is described below. While the method illustrated in FIGS. 23A-23C shows how remnant thermoplasticity in the cured conductive ink composition can be used to form electrical interconnects between electronic components that are disposed on two separate flexible webs, it will be appreciated that the method can be used to form electrical interconnects between electronic components disposed on other substrates (e.g., rigid circuit boards) or between electronic components that are not disposed on a substrate.

Referring to FIG. 23A, there is shown web 2 in an unrolled state. Web 2000 includes flexible web-based substrate 4000 having surface 6000. Integrated circuit 8000 includes bond pads 10000*a* and 10000*b* and is embedded in flexible web-based substrate 4000. Web 2000 further includes encapsulation layer 12000 disposed on surface 6 of flexible web-based substrate 4000. Encapsulation layer 12000 includes vias 14000*a* and 14000*b* which are aligned with and provide access to integrated circuit 8000's bond pads 10000*a* and 10000*b*. In RFID fabrication technology, this roll is commonly referred to as a "strap roll"

Conductive ink composition 16000 is deposited (e.g., via high-speed screen printing) onto specific sites on web 2000. More particularly, in the embodiment illustrated in FIG. 23B, conductive ink composition sites 16000*a* and 16000*b* are printed through vias 14000*a* and 14000*b* to make connection to integrated circuit 8000's bond pads 10000*a* and 10000*b*. Curing of conductive ink composition sites 16000*a* and 16000*b* renders the surfaces of conductive ink composition sites 16000*a* and 16000*b* tack-free. After curing, web 2000 can be used immediately in a second manufacturing step (described below), or it can be rolled for storage prior to being used in the second manufacturing step.

Figure 23C:
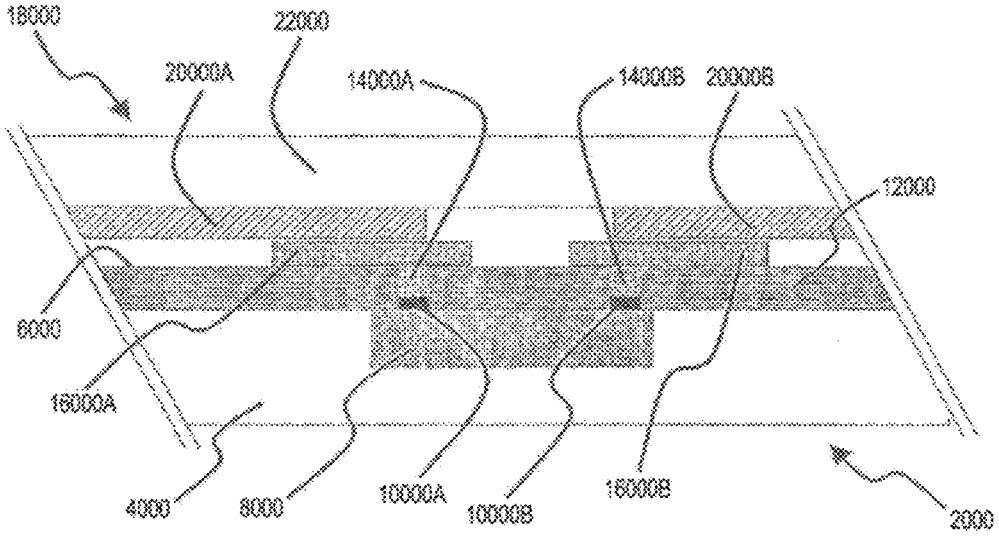
FIG. 23C PRIOR ART

In a second manufacturing step, illustrated in FIG. 23C, web 2000 is placed in contact with antenna web (web 18000), which includes a radiofrequency dipole antenna (20000*a* and 20000*b*) attached to flexible substrate 22000. More particularly, radiofrequency dipole antenna components 20000*a* and 20000*b* on antenna web 18000 are aligned over are brought into contact with conductive ink composition sites 16000*a* and 16000*b* on web 2000. Radiofrequency dipole antenna components 20000*a* and 20000*b* on antenna web 18000 are then bonded both electrically and mechanically to conductive ink composition sites 16000*a* and 16000*b* on web 2000, for example by a moderate thermal treatment (e.g., T<150° C.) in air with roller-pressure being applied between the two webs. Following the pressure/thermal treatment, the bonded strap/antenna can be taken up onto a single roll.

As illustrated in FIGS. 23A-23C, a first electronic component can be bonded or otherwise connected, both electrically and mechanically, to a second electronic component with a single application of the conductive ink composition of the present invention, for example, by application of heat and/or pressure to the solidified (tack-free) thermoplastic polymer produced by polymerization of the conductive ink composition, the mechanical bond to the first electronic component being formed prior to the conductive ink composition's being hardened to a tack-free state (e.g., by photopolymerization, thermal polymerization, etc.,) and the mechanical bond to the second electronic component being formed after the conductive ink composition's being hardened to a tack-free state. In the context of RFID fabrication, for example, straps can thus be connected electrically and mechanically to antennae using a single deposition (or strike) of conductive ink.

The present invention is further illustrated by the following examples.

EXAMPLES

Example 1

Preparation and Characterization of Solvent-Free UV-Curable Conductive Inks

This Example 1 and the following Examples 2-3 describe screen-printable conductive inks that are hardened using UV radiation. The binder system consists of low volatility monofunctional acrylate monomer, a thermoplastic polymer, and a photoinitiator. Conductivity is provided by silver particles. The polymerizable monomer functions as a reactive diluent for the thermoplastic polymer and, upon exposure to UV radiation, polymerizes to a linear polymer. Thus, the final ink remains thermoplastic and can be heat bonded to another conductive material.

The monomers, photoinitiators, their respective suppliers' names, and the abbreviations used in these Examples are shown in Table 1. Solid PMMA resin having a MW=120,000 was purchased from Aldrich. Silver flakes having dimensions less than 10 micron were purchased from Aldrich. Glass spheres coated with silver and having average diameter 14 micron were purchased from Potters Industries. Silver nano-powder having average diameter 150 nm, and raspberry shaped silver particles (silver acorns) were obtained from Inframat Advanced Materials. The average dimension of the latter was 0.7-1.5 μm. All of the materials were used as received. For comparison purposes, two different commercial conductive inks were selected, namely, Acheson Electrodag 479SS and Allied Chemical UVAG0010, designated as "Commercial Ink 1" and "Commercial Ink 2", respectively.

TABLE 1

| Monomer/Photoinitiator | Commercial Name | Supplier's Name | Abbreviation Used |
|---|---|---|---|
| Tetrahydrofurfuryl acrylate | SR 285 | Sartomer | THFA |
| Isobornyl acrylate | SR 506D | Sartomer | IBA |
| Alkoxylated tetrahydrofurfuryl acrylate | CD 611 | Sartomer | ATHFA |
| Acrylate ester | CD 277 | Sartomer | ACES |
| Cyclic trimethylol propane formal acrylate | SR 531 | Sartomer | CTMPFA |
| Oxyethylated phenol acrylate | Ebecryl 110 | UCB Chemicals | OEPA |
| 2-(2 ethoxyethoxy)ethyl acrylate | SR 256 | Sartomer | EOEOEA |
| Combination of phosphine oxide, trimethyl benzophenone, methyl benzophenone and other oligomeric ketone based compounds | SR 1135 | Sartomer | PI 1 |
| Combination of alpha-amino ketones and blends | Irgacure 369 | Ciba | PI 2 |

TABLE 1-continued

| Monomer/Photoinitiator | Commercial Name | Supplier's Name | Abbreviation Used |
|---|---|---|---|
| 1-Hydroxycyclohexyl phenyl ketone | Irgacure 184 | Ciba | PI 3 |
| Benzophenone | Darocur BP | Ciba | Benzophenone |
| Reactive amine acrylate synergist | CN 373 | Sartomer | AASYN |

The binder formulation recipes containing monomer(s), photoinitiators and with or without polymer were prepared by mixing using a magnetic stirrer with occasional heating to accelerate the dissolution of the polymer. The silver-containing ink paste formulations were prepared by mixing the respective ingredients using a mortar and pestle until a visibly homogeneous mixture was obtained.

For the solidification/tack-free time study, the liquid binder mixture was cast onto glass panels with a doctor blade having a 4-mil (101.6 μm) gap. Curing was accomplished by Dymax EC-20 lamp at 365 nm, and 35 mW/cm2. For studying the tack-free time of the ink pastes, films were cast on glass panels using a 2-mil (50.8 μm) gap doctor blade and curing was done as before. For the composition containing silver nano powder and silver flakes (formulation E4), the film was cured by 10 minutes UV curing followed by 10 minutes oven curing at 125° C.

Glass transition temperatures of the polymers were determined using differential scanning calorimetry ("DSC"). Tests were carried out by heating the samples at a rate of 10° C./minute in a TA Instruments Q-1000. Thermogravimetric analysis ("TGA") was carried out under nitrogen, at a heating rate of 10° C./minute up to 300° C. in TA Instruments Q-500. Dynamic mechanical analysis was carried out using a TA Instruments Q-800 DMA. The samples were tested under tension from −70° C. to 110° C. at a heating rate of 3° C./minute.

For measuring surface resistivity (Ω/square), the following procedure was used. First, a rectangle was scribed using a razor blade on the cured ink film (glass panel), and its length and width were measured in mm. Approximate dimensions of the scribed area were 50 mm length by 1-2 mm in width. The length divided by the width gives the number of "squares". Resistance of the rectangle was measured at its two ends using probes and a Wavetek meterman multimeter. Finally, surface resistivity was obtained by dividing the resistance value by the number of squares. Multiplication of the surface resistivity value by the thickness of the film (in mil) would give the volume resistivity (Ω/square/mil). All the volume resistivity values presented in this paper were measured on screen printed lines.

For scanning electron microscopy ("SEM") experiments, samples were mounted on aluminum mounts and coated with gold using a Technics Hummer II sputter coater. Images were obtained using a JEOL JSM-6300 scanning electron microscope.

Screen printing was carried out using a Milara Semitouch Semiautomatic Screen Printer using the following parameters: squeegee speed of 1.5 to 3.0 in/sec; squeegee pressure of 15 to 25 lb./square inch; snap off of 0-10 mils; and squeegee hardness of 70-90 durometers. The substrate for screen printing was an FR4 board.

Example 2

Studies and Characterization of Binder Systems

A typical binder system for a UV curable coating or ink composition includes a multifunctional oligomer, multifunctional diluent(s), and a photoinitiator. Upon exposure to UV light, the photoinitiator initiates polymerization and, since the oligomers and diluents are typically multifunctional, a highly crosslinked film is produced. Due to the crosslinking, the ink film will not reflow on the application of heat; thus, in applications where it is desired to thermally bond the ink to another conductive material, a good bond cannot be formed. In view of this, a new type of binder system is needed that will initially be liquid for deposition using printing (e.g., screen printing, ink-jet printing, etc.), rapidly harden to a tack-free ink following exposure to UV radiation, but then maintain thermoplasticity so that it can be thermally attached to another conductive material.

While a number of binder system designs were considered, a system where the photopolymerization of a liquid monofunctional monomer to a linear polymer having a sufficient Tg to be tack free appeared to be a reasonable approach. A large number of potential monomers are available; however, commonly used monomers, such as butyl acrylate or methyl methacrylate, while having extremely low viscosity, are also highly volatile at ambient temperatures. Thus, these may not be ideal for this application. In addition, these monomers have noxious odor. Several monomers, however, were identified that have low volatility. These are illustrated below:

Since these monomers have relatively low viscosities, a material that can impart a higher viscosity to the ink is also desired as a component of the binder system. Thermoplastic acrylic copolymers are readily available commercially. Thus, the binder system consists of a blend of a thermoplastic polymer, PMMA in this case, along with the monomer(s) and the necessary free radical photoinitiator(s).

In the following discussion, the time taken by the liquid monomers to form solid film under the influence of UV radiation has been described as tack-free time or solidification time, rather than the commonly used phrase "cure time". While the term curing generally indicates that a liquid coating or ink has been converted to a dry material, often the term indicates that a cross-linking reaction has occurred. In this case, however, the system undergoes photoinitiated linear free radical polymerization giving a thermoplastic polymer chain. Thus "tack-free time" indicates the time needed by the system when the monomers have reacted enough to give solid film.

Initial formulations were prepared to determine the effect of monomer and photoinitiator combinations on the solidification or tack-free time of the binder system. These formulations are summarized in Table 2.

TABLE 2

| | Monomer | | Polymer (PMMA) | Photoinitiator | | |
|---|---|---|---|---|---|---|
| No | Type | Amount (g) | Resin (g) | Type | Amount (%) | Solidification time(s) |
| 1 | THFA | 10 | 1.0 | PI 2 | 5.17 | 30 |
| 2 | THFA | 10 | 2.5 | Benzo-phenone | 2.84 | 5 |
| | | | | AASYN | 5.68 | |
| | | | | PI 2 | 2.84 | |

TABLE 2-continued

| Monomer No | Type | Polymer (PMMA) Amount (g) | Resin (g) | Photoinitiator Type | Amount (%) | Solidification time(s) |
|---|---|---|---|---|---|---|
| 3 | THFA | 10 | 2.5 | Benzo-phenone | 2.84 | 25 |
| | | | | AASYN | 5.68 | |
| | | | | PI 3 | 2.84 | |
| 4 | THFA | 10 | 2.5 | PI 1 | 2.84 | 3 |
| | | | | AASYN | 5.68 | |
| | | | | PI 2 | 2.84 | |
| 5 | IBA | 5.0 | — | PI 1 | 5.0 | 10 |
| | | | | AASYN | 8.33 | |
| | | | | PI 2 | 3.33 | |
| 6 | ATHFA | 5.0 | — | PI 1 | 5.0 | 15 |
| | | | | AASYN | 8.33 | |
| | | | | PI 2 | 3.33 | |
| 7 | ACES | 5.0 | — | PI 1 | 5.0 | 10 |
| | | | | AASYN | 8.33 | |
| | | | | PI 2 | 3.33 | |
| 8 | CTMPFA | 5.0 | — | PI 1 | 5.0 | 6 |
| | | | | AASYN | 8.33 | |
| | | | | PI 2 | 3.33 | |
| 9 | THFA | 5.0 | — | PI 1 | 5.0 | 2 |
| | | | | AASYN | 8.33 | |
| | | | | PI 2 | 3.33 | |
| 10 | OEPA | 5.0 | — | PI 1 | 5.0 | 15 |
| | | | | AASYN | 8.33 | |
| | | | | PI 2 | 3.33 | |
| 11 | EOEOEA | 5.0 | — | PI 1 | 5.0 | 30 |
| | | | | AASYN | 8.33 | |
| | | | | PI 2 | 3.33 | |

It can be readily seen that the photoinitiator system consisting of PI 1, PI 2, and the amine acrylate synergist gave the shortest tack free time compared to the other combinations. It is also apparent that among different monomers THFA polymerizes faster than the other monomers under the test conditions. Also, IBA and CTMPFA showed reasonably fast tack-free times. In the studies of the binder system alone, we wanted to achieve an extremely short tack free time since it was believed that the addition of the silver particles would serve to scatter the UV light and extend the time for curing.

Five different binder systems were developed based on the results of the screening experiments to be used with the silver particles. The binder system compositions are listed in Table 3.

TABLE 3

| Formulation ID* | Monomer(s) | Wt. % of monomer | Wt % of PMMA resin | Wt % of photo-initiator combination | Tack free time (s) | DSC Tg (° C.) |
|---|---|---|---|---|---|---|
| A | THFA | 76.27 | 8.47 | 15.26 | 6 | −24.42 |
| B | THFA | 31.75 | 7.94 | 12.69 | 5 | −23.52 |
| | CTMPFA | 31.75 | | | | |
| | ACES | 15.87 | | | | |
| C | THFA | 55.11 | 7.87 | 13.40 | 10 | −28.67 |
| | IBA | 11.81 | | | | |
| | ACES | 11.81 | | | | |
| D | THFA | 31.50 | 7.87 | 13.39 | 5 | −22.78 |
| | CTMPFA | 31.50 | | | | |
| | ATHFA | 15.74 | | | | |
| E | THFA | 28.22 | 6.45 | 12.91 | 10 | −2.77 |
| | CTMPFA | 32.26 | | | | |
| | IBA | 20.16 | | | | |

*A mixture of PI 1, PI 2, and AASYN was used.

Figure 24:
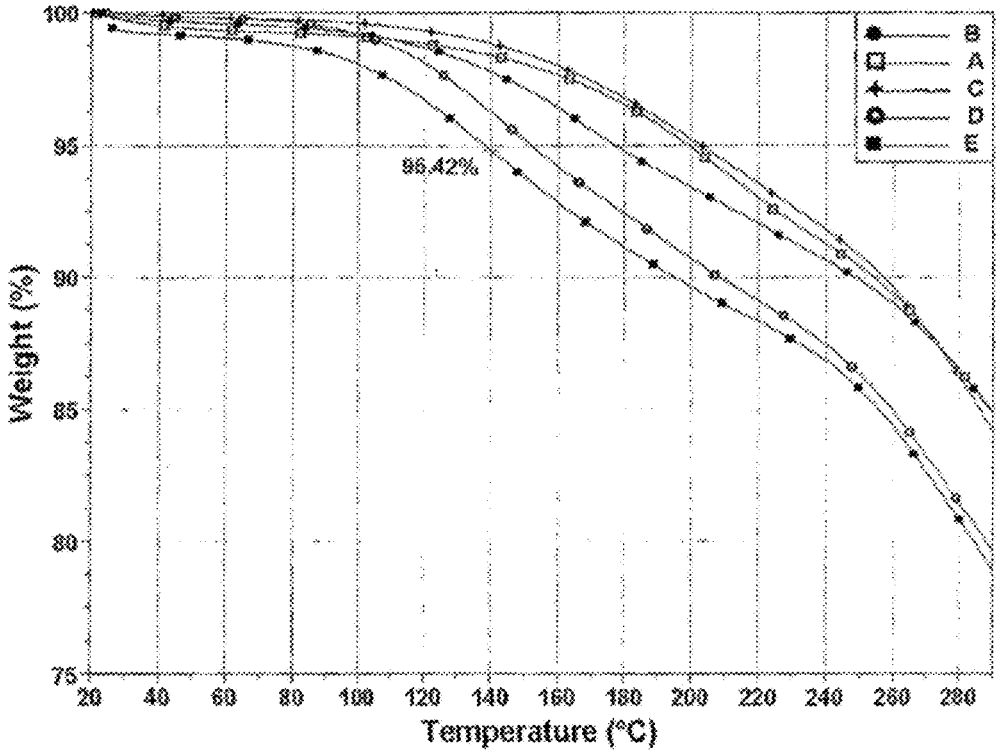
FIG. 24 PRIOR ART
FIG. 24 is a graph showing the thermogravimetric analysis curves in N(2) of different films formed from organic binders that are useful in the conductive ink compositions and thermoplastic materials, disclosed in U.S. Application No. US 20090173919A1.
Figure 25A:
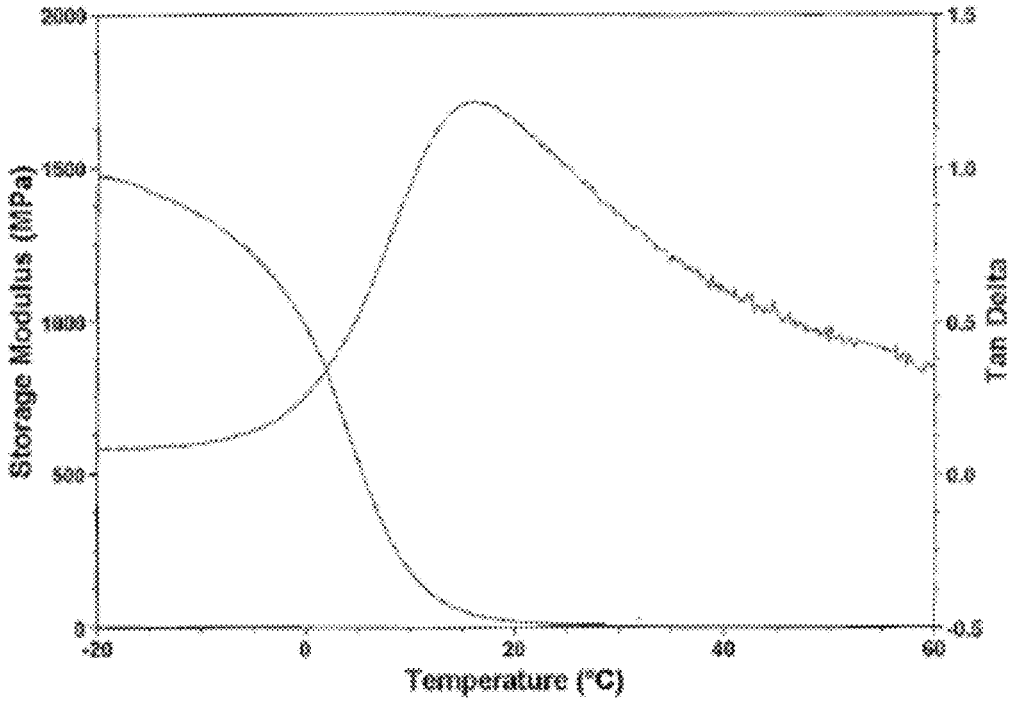
FIG. 25A PRIOR ART
FIGS. 25A and 25B are graphs showing the dynamic mechanical analysis curves of two films formed from organic binders that are useful in the conductive ink compositions and thermoplastic materials disclosed in U.S. Application No. 2090173919A1.
Figure 25B:
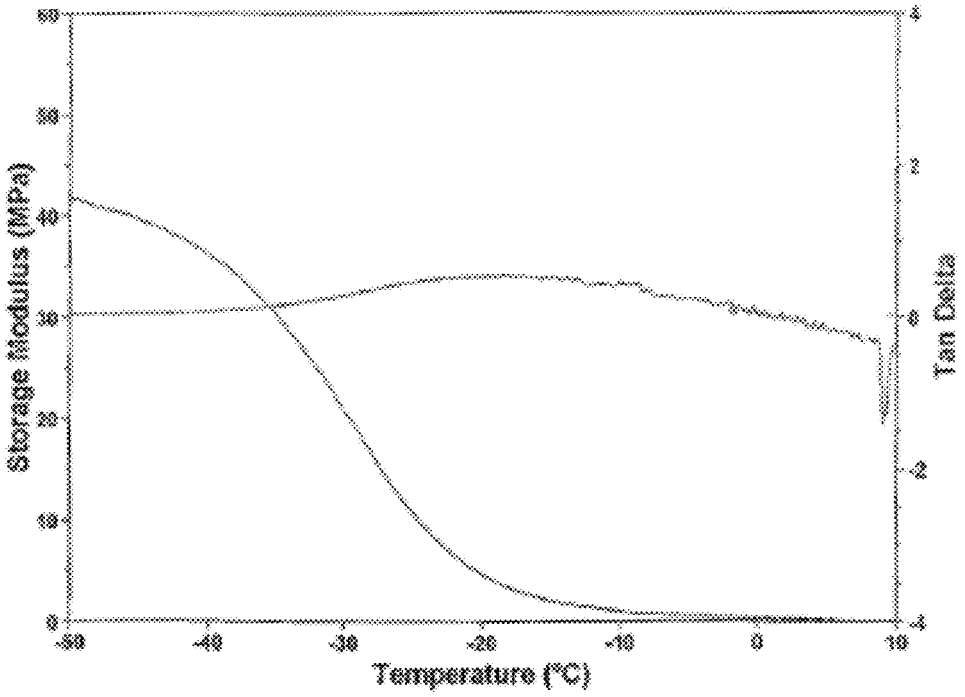
FIG. 25B PRIOR ART
Figure 26A:
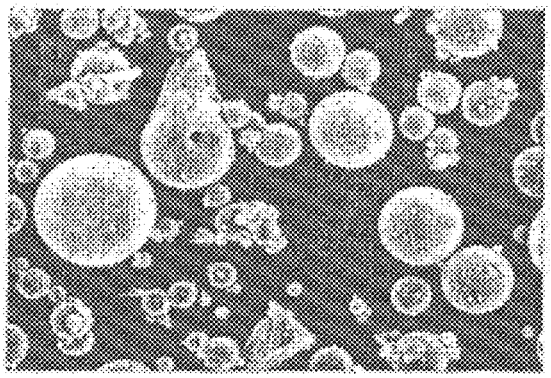
FIG. 26A PRIOR ART
FIGS. 26A-26D are scanning electron microscopy ("SEM") images of conductive fillers that are useful in the conductive ink compositions and thermoplastic materials.
Figure 26B:
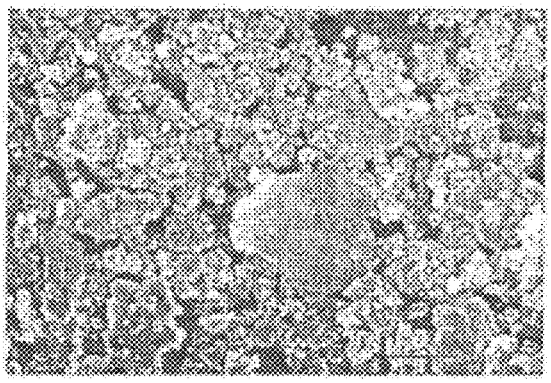
FIG. 26B PRIOR ART
Figure 26C:
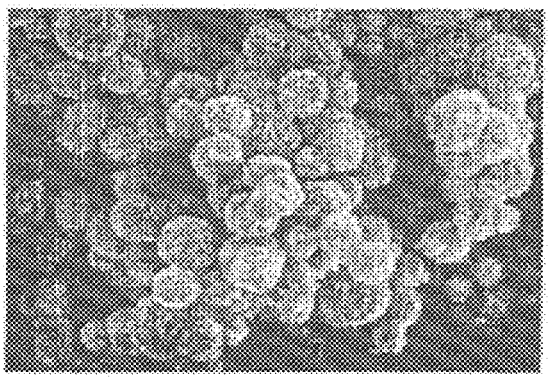
FIG. 26C PRIOR ART
Figure 26D:
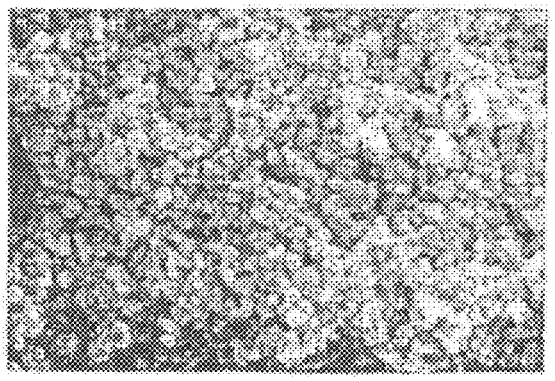
FIG. 26D PRIOR ART

A range of tack free times and glass transition values of the binders was achieved depending on the composition of the binder. Comparatively higher Tgs were observed when the CTMPFA was present in the formulation. FIG. 24 shows the thermal stability of the hardened binder systems from the TGA experiments under nitrogen. Comparison of the monomer combinations in Table 3 and the TGA curves in FIG. 24 readily indicates that the binder film has less thermal stability when CTMPFA was present in the formulation. However, even the least thermally stable polymer also retained more than 95% of its original weight at temperature around 140° C., which is the proposed processing temperature of the hardened inks.

The thermo-mechanical properties of representative binder films C and E are illustrated in FIGS. 3A and 3B, respectively. Comparison of the two curves indicates that, for the lower Tg polymer, the modulus of the system at ambient temperature is also lower. Additionally, it can be seen for both the curves that above the Tg, the elastic modulus quickly dropped to zero indicating melt flow and verifying the inherent thermoplastic nature of the polymer binder system.

Example 3

Conductive Inks and Properties Thereof

While making conductive ink with different binder formulations, the main objective was to obtain the highest possible conductivity, good screen printability at a minimum tack free time. Four types of conductive silver particles were evaluated and SEM micrographs are shown in FIGS. 26A-26D. The silver-coated glass microspheres (FIG. 26A) range from 8 to 20 μm in diameter, have a mean particle diameter of 14 μm and possess a density of 2.7 g/cm3 with an overall silver content of 12 weight percent. The silver flakes (FIG. 4B) are irregular in shape with diameters less than 10 μm and thickness estimated at 100 nm to give an aspect ratio of 100:1. The acorn-shaped silver nanopowders (FIG. 4C) appear to be sub 100 nm particles in micron-sized agglomerates. Finally, the silver nanopowder (FIG. 4D) has particles sizes ranging from 100 nm to 1 μm with some 2-μm agglomerates present.

Table 4 shows ink paste formulations where glass microspheres coated with silver and silver flakes were used as the major conductive fillers.

TABLE 4

| Ink ID* | Vol. % of organic phase | Vol. % of Ag-glass beads | Vol. % of silver flakes | Vol. % of silver acorn | Surface resistivity (Ω/square) |
|---|---|---|---|---|---|
| A1 | 64.63 | 28.09 | 7.28 | — | 1.21 |
| B1 | 65.00 | 28.00 | 7.00 | — | 5.74 |
| B2 | 64.37 | 27.73 | 7.90 | — | 2.00 |
| C1 | 65.38 | 27.48 | 7.13 | — | 7.46 |
| C2 | 64.84 | 27.96 | 7.20 | — | 2.55 |
| C3 | 63.65 | 29.93 | 6.42 | — | 4.13 |
| E1 | 63.40 | 30.10 | 6.50 | — | 0.53 |
| E2 | 63.00 | 30.00 | 7.00 | — | 0.80 |
| E3 | 63.00 | 30.00 | 6.40 | 0.60 | 0.42 |

*The letter in the ID refers to the binder system in Table 3.

The formulation E3 also contains silver acorn-shaped particles as an additional conductive filler. It can be said that the electrical properties of the final composite film depend both on the type and amount of individual filler and also on the binder composition. The tack free time for the compositions described in Table 4 varied between 15 seconds and 60 seconds. It has been reported that flake-shaped fillers impart unsatisfactory cure (U.S. Pat. No. 3,968,056 to Bolon et al., which is hereby incorporated by reference). Hence, in each case a combination different types, shapes, and sizes of fillers were evaluated. However, the main disadvantage of the conductive composites containing glass micro-spheres coated with silver as one of the conductive filler was that resistance value was always too high for the required application for all the formulations. None of the systems explored provided the level of conductivity desired for this application.

Since the silver-coated glass spheres did not provide sufficient conductivity, a formulation was developed that eliminated these as the conductive material. Table 5 shows an ink composition containing silver nano powder and silver flakes as the conductive particles with the binder formulation E and the overall composition is designated as E4.

TABLE 5

| Composition | Wt. % | Vol % |
|---|---|---|
| Binder formulation E | 19.0 | 71.0 |
| Benzoyl peroxide | 0.5 | |
| Silver nanopowder | 37.9 | 14.5 |
| Silver flakes | 37.9 | 14.5 |
| Butyl acetate | 4.7 | |

Due to the very high viscosity of the system, a solvent needed to be included in the formulation to reduce the viscosity to a level where screen printing could be carried out. In addition to UV-radiation curing, oven heating was also used to evaporate the solvent as well as to get the residual monomers to polymerize, initiated by thermal initiator benzoyl peroxide.

This ink was printed on an FR4 board using screen printing along with formulation C3 and commercial solvent-borne and UV curable inks. Although here the tack free time was prolonged, the conductivity was greatly improved. Table 6 shows some of the key properties of the experimental formulations compared to few commercial formulations. The conductivity of the formulation containing the silver flakes and nanopowder is significantly better than that of the commercial UV cured ink and similar to the commercial solvent-borne ink.

TABLE 6

| Properties | Commercial Ink 1 | Commercial Ink 2 | Ink Formulation C3 | Ink Formulation E4 |
|---|---|---|---|---|
| Curing method | Heat | UV curing | UV curing | UV + heat |
| Presence of solvent | Yes | Solventless | Solventless | Low |
| Screen printability | Very good | — | Good | Needs optimization |
| Resistivity (Ω/sq./mil) | <0.02 | 0.285 | 0.856 | 0.074 |

Example 4

Preparation and Characterization of Solvent-Free Heat-Curable Conductive Inks

An illustrative binder system for heat-curable conductive inks is set forth in Table 7.

TABLE 7

| Formulation ID | Monomer (s) | Wt. % of monomer | Wt % of PMMA resin | Wt % of thermal initiator |
|---|---|---|---|---|
| 59 | THFA<br>CTMPFA<br>IBA | 31.67<br>36.20<br>22.34 | 7.24 | 2.26 |

The average molecular weight of the solid PMMA resin is 120,000 g/mol. Table 8 shows ink paste formulations for heat-curable conductive inks where silver nanopowder and silver flakes are used as the major conductive fillers.

TABLE 8

| Ink ID* | Wt. % of organic phasea | Wt. % of silver flakes | Wt. % of silver nanopowder | t-butyl acetate |
|---|---|---|---|---|
| 59a | 19.04 | 38.10 | 38.10 | 4.76 |
| 59b | 18.39 | 36.78 | 36.78 | 8.05 |

*Binder formulation ID 59 from Table 8 is used as the organic phase.

The silver flakes are <10 micron (Aldrich), and the silver nanopowder is of 150 nm average diameter (Inframat Advanced Materials).

Although preferred embodiments have been depicted and described in detail herein, it will be apparent to those skilled in the relevant art that various modifications, additions, substitutions and the like can be made without departing from the spirit of the invention and these are therefore considered to be within the scope of the invention, as defined in the claims which follow.

A description of the '598 patent application is as follows:

The present invention relates to methods of treating a metal to improve the metal's corrosion resistance. In one aspect of the present invention, the method includes applying, to the surface of the metal, a coating which includes magnesium powder and a radiation-curable binder. In another aspect of the present invention, the method includes applying, to the surface of the metal, a coating which includes magnesium powder and an inorganic binder. In yet another aspect of the present invention, the method includes applying, to the surface of the metal, a coating which includes a magnesium alloy powder and a binder, where the magnesium alloy powder has a corrosion potential that is from about 0.01 volt to about 1.5 volt more negative than the metal's corrosion potential.

A variety of metals can be protected using the methods of the present invention.

For example, the methods of the present invention can be used to protect aluminum and aluminum alloys. Illustratively, the methods of the present invention can be used to treat aluminum alloys which contain copper (which is meant to include heterogeneous microstructures formed from intermetallic compounds containing copper) and one or more other metals, such as Mg, Fe, and Mn. For example, the methods of the present invention can be used to treat copper-containing aluminum alloys which are commonly used in airplanes and other aircraft, such as Al 2024 alloys (e.g., Al 2024 T-3) and Al 7075 alloys (e.g., Al 7075 T-6). Other aluminum alloys that can be treated using the methods of the present invention include Al 5052 and Al 6061, as well as Al 2011, Al 2014, Al 2017, Al 3003, Al 5005, Al 5083, Al 5086, and Al 6063.

Other metals that can be protected using the methods of the present invention include ferrous metals, e.g., iron and iron alloys (such as galvanized steel and other kinds of steel); copper and copper alloys (such as brass and bronze); tin and tin alloys; metals or metal alloys that are less reactive than magnesium; metals or metal alloys that are less reactive than aluminum; and/or metals or metal alloys that are less reactive than Al 2024 T-3 and/or Al 7075 T-6.

It will be appreciated that the metal being protected can be part of a structure that is made of a number of different metal components. Many such structures include components made of different metals (or alloys) in physical contact with one another. The point or points where different metals are in physically connected is a place where galvanic corrosion is enhanced by the contact of the metals. The high activity of magnesium used in the methods of the present invention, when compared to the activities of most other metals, permits the method of the present invention to be used on substrates made of two or more components of different metals in contact with one another (e.g., an aluminum component in contact with a steel component) without the risk of improving the corrosion resistance of one component while promoting corrosion of another component. As an illustration of such structures containing two or more metals in contact with one another, there can be mentioned a structure that comprises a component made of a first metal (e.g., a metal sheet, such as a sheet made of aluminum or aluminum alloy) and one or more fasteners (e.g., rivets, bolts, nails, cotter pins or other pins, studs, etc.) made of second metal that is different than the first metal, for example, as in the case where the fastener is used to secure the metal sheet or other component to a substrate (e.g., a plastic, wood, metal or other substructure; another sheet of metal; etc.). For example, in one illustrative embodiment, a sheet made of aluminum or aluminum alloy can be fastened with fasteners made of steel, copper, copper alloys, or other metals or metal alloys other than aluminum or aluminum alloy. The point of physical contact between the component and the fastener is a place where galvanic corrosion is enhanced. Frequently, such enhanced galvanic corrosion is reduced by physically isolating the fastener(s) from the metal sheet or other component(s) being fastened, for example, by using a non-conducting material (e.g., plastic, rubber, etc.). Using the method of the present invention, such enhanced galvanic corrosion can be further reduced by applying the coating to the surface of both the sheet and the fastener (e.g., such that the coating applied to the surface of the sheet is unitarily formed with the coating applied to the surface of the fastener) and, in some cases, sufficiently reduced so that physical isolation of the fastener(s) from the metal sheet (e.g., by use of the non-conducting material) is not required.

As used herein, the phrase "improve the metal's corrosion resistance" is meant to be broadly construed and can be ascertained by any suitable qualitative or quantitative method know to those skilled in the art. Illustratively, a metal's corrosion resistance can be determined by Prohesion™ exposure, for example, in accordance with ASTM D5894-96, which is hereby incorporated by reference. Any increase in the metal's corrosion resistance is to be deemed to "improve" its corrosion resistance. Increases in corrosion resistance can be determined, for example, visibly by comparing test samples coated in accordance with the method of the present invention to uncoated test samples or to test samples coated only with topcoat. As indicated above, the level of corrosion resistance can be ascertained qualitatively, as by the visual observation of blistering, peeling, curling, bubbling, or other indicia of coating failure or delamination or by the visual observation of pitting and other indicia of corrosion of the metal. Such observations can be made a single point in time (e.g., after Prohesion™ exposure in accordance with ASTM D5894-96 for about 100 hours, about 200 hours, about 300 hours, about 500 hours, about 800 hours, about 1000 hours, about 1300 hours, about 1500 hours, about 1800 hours, about 2000 hours, about 2500 hours, about 3000 hours, about 3500 hours, about 4000 hours, about 4500 hours, about 5000 hours, etc.), or they can be made over a period of time.

As discussed above, the method of the present invention is carried out by applying, to the surface of the metal, a coating which comprises magnesium powder.

"Magnesium powder", as used herein is meant to refer to a collection of micron-sized particles (e.g., particles having a diameter of about 1-1000 microns, such as of about 10-100 microns, etc.). Illustratively, the micron-sized particles can be particles having a diameter of about 5 microns, of about 8 microns, of about 10 microns, of about 11 microns, of about 12 microns, of about 13 microns, of about 14 microns, of about 15 microns, of about 16 microns, of about 17 microns, of about 18 microns, of about 19 microns, of about 20 microns, of about 21 microns, of about 22 microns, of about 23 microns, of about 24 microns, of about 25 microns, of about 26 microns, of about 27 microns, of about 28 microns, of about 29 microns, of about 30 microns, of about 31 microns, of about 32 microns, of about 33 microns, of about 34 microns, of about 35 microns, of about 38 microns, of about 40 microns, etc. The particles contained in the magnesium powder can be of substantially uniform particles size or not. The particles can be of any suitable shape, such as spherical, ellipsoidal, cuboidal, flake, etc., or combinations thereof.

The particles which contain magnesium metal and/or the oxides thereof can further include one or more other metals or oxides of other metals, as in the case where the magnesium powder is a collection of micron-sized particles of a magnesium alloy (e.g., a magnesium alloy containing (in addition to magnesium) calcium, manganese, lithium, carbon, zinc, potassium, aluminum, silicon, zirconium, tantalum, and/or a rare earth metal (e.g., cerium).

The selection of alloying elements can be used to optimize corrosion resistance. For example, in the case where the metal being protected is aluminum, the magnesium alloy can be chosen so as to be more reactive than aluminum; in the case where the metal being protected is Al 2024 T-3, the magnesium alloy can be chosen so as to be more reactive than Al 2024 T-3; and in the case where the metal being protected is Al 7075 T-6, the magnesium alloy can be chosen so as to be more reactive than Al 7075 T-6.

Corrosion resistance of the metal to be coated can be further optimized by selecting alloying elements such that the magnesium alloy powder has a corrosion potential that is from about 0.01 volt to about 1.5 volt more negative than the corrosion potential of the metal to be coated. In this regard, as used herein, a metal or metal alloy's corrosion potential is to be deemed to be its potential vs. a standard hydrogen electrode under standard conditions. As one skilled in the art will appreciate, a metal or metal alloy's corrosion potential can be (and, in many cases, typically will be) measured against a different electrode (e.g., measured in sea water (3% NaCl) vs. a standard calomel electrode) and then converted to a potential vs. a standard hydrogen electrode using methods known to those skilled in the art. Illustratively, the magnesium alloy powder can have a corrosion potential that is from 0.01 volt to 1.5 volt, from about 0.02 volt to about 1.4 volt, from about 0.03 volt to about 1.3 volt, from about 0.04 volt to about 1.2 volt, from about 0.05 volt to about 1.1 volt, from about 0.07 volt to about 1.1 volt, from about 0.1 volt to about 1 volt, from 0.1 volt to 1 volt, from about 0.2 volt to about 1 volt, and/or from 0.2 volt to 1 volt more negative than the magnesium alloy's corrosion potential. As further illustration, the magnesium alloy powder can have a corrosion potential that is from 0.3 volt to 0.9 volt more negative than the metal's corrosion potential. As further illustration, the magnesium alloy powder can have a corrosion potential that is from 0.4 volt to 0.8 volt more negative than the metal's corrosion potential. As yet further illustration, the magnesium alloy powder can have a corrosion potential that is from 0.6 volt to 0.8 volt more negative than the metal's corrosion potential. As still further illustration, the magnesium alloy powder can have a corrosion potential that is about 0.01 volt, about 0.02 volt, about 0.03 volt, about 0.04 volt, about 0.05 volt, about 0.06 volt, about 0.07 volt, about 0.08 volt, about 0.09 volt, about 0.1, about 0.15 volt, about 0.2 volt, about 0.25 volt, about 0.3 volt, about 0.35 volt, about 0.4 volt, about 0.45 volt, about 0.5 volt, about 0.55 volt, about 0.6 volt, about 0.65 volt, about 0.7 volt, about 0.75 volt, about 0.8 volt, about 0.85 volt, about 0.9 volt, about 0.95 volt, about 1.05 volt, about 1.1 volt, about 1.15 volt, about 1.2 volt, about 1.25 volt, about 1.3 volt, about 1.35 volt, about 1.4 volt, about 1.45 volt, or about 1.5 volt more negative than the metal's corrosion potential.

For example, where the metal to be coated is a ferrous metal (e.g., iron or steel or another iron alloy) having a corrosion potential of from −0.55 volt to −0.75 volt, the magnesium alloy powder can be selected so that it has a corrosion potential of from −0.56 volt to −2.3 volt. As further illustration, where the metal to be coated is titanium or a titanium alloy having a corrosion potential of from 0.1 volt to −0.1 volt, the magnesium alloy powder can be selected so that it has a corrosion potential of from −0.6 volt to −1.6 volt. As still further illustration, where the metal to be coated is aluminum or an aluminum alloy having a corrosion potential of from −0.6 volt to −1 volt, the magnesium alloy powder can be selected so that it has a corrosion potential of from −0.61 volt to −2.5 volt.

Examples of magnesium alloys that can be used in the practice of the present invention include: (i) those which comprise magnesium and manganese, with or without calcium, lithium, carbon, zinc, potassium, aluminum, and/or a rare earth metal (e.g., cerium) being present; (ii) those which comprise magnesium and up to about 6%, by weight, of calcium, manganese, lithium, carbon, zinc, potassium, aluminum, and/or a rare earth metal (e.g., cerium); (iii) those which contain magnesium and up to about 6%, by weight, of manganese; (iv) those which comprise magnesium and up to about 50% (e.g., up to about 45%, up to about 40%, up to about 35%, up to about 30%, up to about 25%, up to about 20%, up to about 18%, up to about 16%, up to about 14%, up to about 12%, up to about 10%, about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, about 50%) by weight, of one or more alloying elements (e.g., calcium, manganese, lithium, carbon, zinc, potassium, aluminum, silicon, zirconium, tantalum, and/or a rare earth metal (e.g., cerium)); and/or (v) those which comprise magnesium and from more than about 6% to about 50% (e.g., from more than 6.5% to about 50%, from 7% to about 50%, from about 7% to about 50%, from about 8% to about 50%, from about 9% to about 50%, from about 10% to about 50%, from more than 6.5% to about 40%, from 7% to about 40%, from about 7% to about 40%, from about 8% to about 40%, from about 9% to about 40%, from about 10% to about 40%, from more than 6.5% to about 30%, from 7% to about 30%, from about 7% to about 30%, from about 8% to about 30%, from about 9% to about 30%, from about 10% to about 30%, from more than 6.5% to about 20%, from 7% to about 20%, from about 7% to about 20%, from about 8% to about 20%, from about 9% to about 20%, from about 10% to about 20%, from more than 6.5% to about 10%, from 7% to about 10%, from about 7% to about 10%, from about 8% to about 10%, and/or from about 9% to about 10%), by weight, of one or more alloying elements (e.g., calcium, manganese, lithium, carbon, zinc, potassium, aluminum, silicon, zirconium, tantalum, and/or a rare earth metal (e.g., cerium)). Examples of suitable magnesium alloy powders include those containing (in addition to magnesium) aluminum; manganese; aluminum and manganese; aluminum, manganese, and zinc; aluminum, manganese, and zirconium; zirconium; zirconium and zinc; cerium and/or other rare earth metals; zirconium and cerium; zirconium and other rare earth metals; etc.

The aforementioned magnesium alloy powders can be substantially free of one or more other elements. Illustratively, the magnesium alloy powders can be substantially free of one or more (e.g., one, two, three, more than three, more than four, all but two, all but one, all, etc.) of Be, Ca, Sr, Ba, Ra, Sc, Y, Ce, Pr, Nd, Pm, Sm, Eu, Gd, Tb, Dy, Ho, Er, Tm, Yb, Lu, Th, Pa, U, Np, Pu, Am, Ti, Zr, Hf, V, Nb, Ta, Cr, Mo, X, Mn, Tc, Re, Fe, Ru, Os, Co, Rh, Ir, Ni, Pd, Pt, Cu, Ag, Au, Zn, Cd, Hg, B, Al, Ga, In, Tl, C, Si, Ge, Sn, Pb, N, P, As, Sb, Bi, S, Se, Te, and Po. As further illustration, the magnesium alloy powders can contain less than about 5% (e.g., less than 5%, less than about 4%, less than 4%, less than about 3%, less than 3%, less than about 2%, less than 2%, less than about 1%, less than 1%, less than about 0.5%, less than 0.5%, less than about 0.1%, less than 0.1%, less than about 0.05%, less than 0.05%, less than about 0.01%, less than 0.01%, less than about 0.005%, less than 0.005%, less than about 0.001%, less than 0.001%, about zero, and/or zero) of one or more (e.g., one, two, three, more than three, more than four, all but two, all but one, all, etc.) of Be, Ca, Sr, Ba, Ra, Sc, Y, Ce, Pr, Nd, Pm, Sm, Eu, Gd, Tb, Dy, Ho, Er, Tm, Yb, Lu, Th, Pa, U, Np, Pu, Am, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, Hg, B, Al, Ga, In, Tl, C, Si, Ge, Sn, Pb, N, P, As, Sb, Bi, S, Se, Te, and Po.

Specific examples of suitable magnesium alloys include those made form magnesium alloy AM60, those made form magnesium alloy AZ91B, and those made form magnesium alloy LNR91.

Mixtures of particles containing magnesium metal and particles containing magnesium alloys can also be employed and are meant to be encompassed by the term "magnesium powder", as used herein. "Magnesium powder", as used herein, is also meant to refer to mixtures of particles containing a first magnesium alloy and particles containing a second magnesium alloy. Illustratively, particles which make up the magnesium powder can include a magnesium metal core or a magnesium alloy core and a coating of magnesium oxide on the surface of the core.

It should be noted, in this regard, that reference here to "diameter" is not to imply that the particles which make up the magnesium powder are necessarily spherical: the particles can be spherical, ellipsoidal, cubical, rod-shaped, disk-shaped, prism-shaped, etc., and combinations thereof. In the case where a particle is other than spherical, "diameter" is meant to refer to the diameter of a hypothetical sphere having a volume equal to that of the particle. Thus, as used herein, "magnesium powder" is meant to include magnesium flake. "Magnesium flake", as used herein, is meant to refer to two-dimensional forms (i.e., forms having two large dimensions and one small dimension) of magnesium particles.

The particles contained in the magnesium powder can be of substantially uniform particle size or not. For example, the magnesium powder can include a mixture of two or more magnesium particle powders, each having different mean particle size distributions, such as in the case where the magnesium powder includes a first magnesium particle powder and a second magnesium particle powder, where the first magnesium particle powder and a second magnesium particle powder have substantially different mean particle size distributions. As used in this context, two mean particle size distributions, X and Y, are to be deemed to be "substantially different" when either the ratio of X:Y or the ratio Y:X is greater than about 1.5, such as greater than about 1.6, greater than about 1.7, greater than about 1.6, greater than about 1.8, greater than about 1.9, greater than about 2, from about 1.1 to about 4, from about 1.5 to about 3, from about 2 to about 2.5, from about 2.1 to about 2.5, and/or from about 2.2 to about 2.4. Additionally or alternatively, the first magnesium particle powder and the second magnesium particle powder can be selected such that the mixture's bulk density is greater than the first magnesium particle powder's bulk density and such that the mixture's bulk density is greater than the second magnesium particle powder's bulk density, for example, as in the case where the mixture's bulk density is at least about 2% greater (e.g., at least about 5% greater, at least about 8% greater, etc.) than the first magnesium particle powder's bulk density and such that the mixture's bulk density is at least about 2% greater (e.g., at least about 5% greater, at least about 8% greater, etc.) than the second magnesium particle powder's bulk density.

As further illustration, the magnesium powder used in the practice of the present invention can include a mixture of a first magnesium particle powder having a mean particle size distribution of from about 25 μm to about 35 μm (such as in the case where first magnesium particle powder has a mean particle size distribution of from about 27 μm to about 33 μm and/or as in the case where the first magnesium particle powder has a mean particle size distribution of about 30 μm) and a second magnesium particle powder having a mean particle size distribution of from about 65 μm to about 75 μm (such as in the case where second magnesium particle powder has a mean particle size distribution of from about 67 μm to about 73 μm and/or as in the case where the second magnesium particle powder has a mean particle size distribution of about 70 μm).

As yet further illustration, the magnesium powder used in the practice of the present invention can include a mixture of a first magnesium particle powder having a mean particle size distribution of from about 25 μm to about 35 μm and a second magnesium particle powder having a mean particle size distribution of from about 65 μm to about 75 μm, where the volume ratio of first magnesium particle powder to second magnesium particle powder is from about 40:60 to about 60:40, for example, as in the case where the volume ratio of first magnesium particle powder to second magnesium particle powder is from about 45:55 to about 55:45; as in the case where the volume ratio of first magnesium particle powder to second magnesium particle powder is from about 50:50 to about 55:45; and/or as in the case where the volume ratio of first magnesium particle powder to second magnesium particle powder is about 58:42.

As yet further illustration, the magnesium powder used in the practice of the present invention can include a mixture of a first magnesium particle powder having a mean particle size distribution of about 30 μm and a second magnesium particle powder having a mean particle size distribution of about 70 μm, where the volume ratio of first magnesium particle powder to second magnesium particle powder is from about 40:60 to about 60:40, for example, as in the case where the volume ratio of first magnesium particle powder to second magnesium particle powder is from about 45:55 to about 55:45; as in the case where the volume ratio of first magnesium particle powder to second magnesium particle powder is from about 50:50 to about 55:45; and/or as in the case where the volume ratio of first magnesium particle powder to second magnesium particle powder is about 58:42.

As discussed above, the method of the present invention is carried out by using a coating which (i) includes the aforementioned magnesium powder and (ii) a binder. The coating can include one or more other materials, such as other metal particles, solvents, and the like, Alternatively, the coating can be free of such one or more other materials. For example, the coating can be substantially free of chromium. As used herein, a coating is to be deemed to be "substantially free of chromium" if the ratio of the weight of chromium metal or ion in the coating to the weight of magnesium metal or ion in the coating is less than 20%, such as less than about 18%, less than about 15%, less than about 12%, less than about 10%, less than about 5%, less than about 2%, less than about 1%, less than about 0.5%, and/or about zero. Additionally, or alternatively, the coating can be formulated so as not to contain added chromium.

As discussed above, the coating further (i.e., in addition to the magnesium powder) includes a binder.

"Binder", as used herein, is meant to include any polymeric material (e.g., a polymer or copolymer) or any prepolymer (e.g., a monomer or oligomer) or combination of prepolymers which, upon polymerization or copolymerization, forms a polymer or copolymer. Illustratively, the binder can include a hybrid polymeric matrix or a plurality of hybrid polymeric matrices or other polymer composites or alloys that contain a polymer backbone with at least two types of reactive groups that can take part in crosslinking and network formation under at least two different mechanisms; and/or the binder can contain a prepolymer or combination of prepolymers which, upon polymerization or copolymerization, forms the aforementioned hybrid polymeric matrix, hybrid polymeric matrices, or other polymer composites or alloys.

For example, in one embodiment of the method of the present invention, the binder includes a polyisocyanate prepolymer and an epoxy prepolymer, examples and other details of which are described in International Publication No. WO 2005/051551, which is hereby incorporated by reference.

Other binders that can be used in the practice of the present invention include conducting binders, such as described in International Publication No. WO 2005/051551, which is hereby incorporated by reference.

Other suitable binders include epoxy polyamide polymeric binders. Still other suitable binders include those which polyesters, polyamides, alkyds, acrylics, polyurethanes, and combinations of two or more of these or other polymers.

Still other suitable binders include radiation-curable binders and inorganic binders, as discussed further below.

As discussed above, one aspect of the present invention relates to a method of treating a metal to improve the metal's corrosion resistance in which the method includes applying, to the surface of the metal, a coating which includes magnesium powder and a radiation-curable binder.

As used herein, "radiation-curable binder" is meant to refer to any polymeric material (e.g., a polymer or copolymer) that is formed by radiation curing or a prepolymer (e.g., a monomer or oligomer) or combination of prepolymers that, upon polymerization or copolymerization by exposure to radiation, form a polymer or copolymer. Examples of suitable radiation-curable binders include, for example, binders that can be cured, in whole or in part, by exposure to electromagnetic radiation, such as UV light or visible light. For example, UV-curable binders can be employed. Examples of suitable UV-curable binders include those that which contain one or more acrylic and/or vinyl functional groups, such as acrylic acid esters, examples of which include alkyl acrylates (e.g., methyl acrylate), alkyl methacrylates (e.g., methyl methacrylate), and the like. The UV-curable binder can be a UV-curable binder that is polymerized via a free radical process, a UV-curable binder that is polymerized via a cationic initiation process, or a UV-curable binder that is polymerized via some combination of these or other processes. Examples of suitable UV-curable binders include polyester UV-curable polymers or prepolymers; acrylic UV-curable polymers or prepolymers; epoxy UV-curable polymers or prepolymers; and urethane UV-curable polymers or prepolymers. Mixtures of the aforementioned UV-curable binders and copolymers thereof can also be used, and such mixtures and copolymers are meant to be encompassed by the term "UV-curable binder". Illustratively, suitable UV-curable binders also include aromatic urethane acrylates, aliphatic urethane acrylates, polyester acrylates, and epoxy acrylates. It will be appreciated that the UV-curable binder can also include other materials, for example, materials that can aid in processing or influence the properties of the binder. Examples of such other materials include reactive diluents (e.g., mono- di-, or tri-functional reactive diluents), polymerization initiators, polymerization retarders, and the like.

As discussed above, another aspect of the present invention relates to a method of treating a metal to improve the metal's corrosion resistance in which the method includes applying, to the surface of the metal, a coating which includes magnesium powder and an inorganic binder.

Suitable inorganic binders which can be used in the practice of the present invention include those described in Klein, "Inorganic Zinc-rich" in L. Smith ed., Generic Coating Types: An Introduction to Industrial Maintenance Coating Materials, Pittsburgh, Pa.: Technology Publication Company (1996), which is hereby incorporated by reference. For example, inorganic binders having a modified $SiO_2$ structure (e.g., produced from silicates or silanes that hydrolyze upon exposure to atmospheric moisture) can be used as inorganic binders.

Examples of suitable inorganic binders include those which are based, in whole or in part, on tetraorthosilicate chemistries. Inorganic binders are meant to include tetraalkoxysilanes (such as tetramethoxysilane and tetraethoxysilane); monoalkyltrialkoxysilanes (such as methyl trimethoxy silane and methyl triethoxy silane); and combinations thereof.

In certain embodiments, the inorganic binder includes one or more of (trialkoxysilyl)alkyl acrylate or methacrylate (e.g., 3-(trimethoxysilyl)propyl methacrylate); a bis((trialkoxysilyl)alkyl)amine (e.g., bis(3-(trimethoxysilyl)propyl)amine; a tris((trialkoxysilyl)alkyl)amine (e.g., tris(3-(trimethoxysilyl)propyl)amine; a tetraalkyl orthosilicate (e.g., tetraethyl orthosilicate, tetramethyl orthosilicate, diethyl dimethyl orthosilicate, etc.); a dialkylphosphatoalkyl-trialkoxysilane (e.g., diethylphosphatoethyl-triethoxysilane); a 1-((trialkoxysilyl)alkyl)urea (e.g., 1-(3-(trimethoxysilyl)propyl)urea); a tris((trialkoxysilyl)alkyl) isocyanurate (e.g., tris((trimethoxysilyl)propyl) isocyanurate; a (glycidoxyalkyl)trialkoxysilane (e.g., .gamma.-(glycidoxypropyl)trimethoxysilane; a (mercaptoalkyl)trialkoxysilane (e.g., (mercaptopropyl)trimethoxysilane; a bis(trialkoxysilyl)alkane (e.g., bis(triethoxysilyl)ethane; and a bis((trialkoxysilyl)alkyl) tetrasulfide (e.g., bis (3-(triethoxysilyl)propyl) tetrasulfide.

In certain embodiments, the inorganic binder includes one or more trialkoxy monoalkyl silanes and one or more tetraalkyl orthosilicates, for example, where the trialkoxy monoalkyl silanes and the tetraalkyl orthosilicates are present in a volume ratio of from about 1:10 to about 10:1 (e.g., from about 1:5 to about 10:1, from about 1:3 to about 10:1, from about 1:2 to about 10:1, from about 1:1 to about 10:1, from about 1:1 to about 8:1, from about 1:1 to about 7:1, from about 1:1 to about 6:1, from about 1:1 to about 5:1, etc.).

As further illustration, in certain embodiments, the inorganic binder includes two or more (e.g., 2, 3, 4, etc.) trialkoxy monoalkyl silanes (e.g., 2, 3, 4, etc.) and one or more (e.g., 1, 2, 3, 4, etc.) tetraalkyl orthosilicates. For example, in one such embodiment, at least one of the trialkoxy monoalkyl silanes can be an amine-containing trialkoxy monoalkyl silane (e.g., bis(3-(trimethoxysilyl)propyl)amine and/or other bis((trialkoxysilyl)alkyl)amines); tris(3-(trimethoxysilyl)propyl)amine and/or other tris((trialkoxysilyl)alkyl)amines); etc.). In another such embodiment, at least one of the trialkoxy monoalkyl silanes is an acrylate-containing or methacrylate-containing trialkoxy monoalkyl silane (e.g., 3-(trimethoxysilyl)propyl methacrylate and/or other (trialkoxysilyl)alkyl acrylates or methacrylates). In yet another such embodiment, at least one of the trialkoxy monoalkyl silanes can be an amine-containing trialkoxy monoalkyl silane (e.g., bis(3-(trimethoxysilyl)propyl)amine and/or other bis((trialkoxysilyl)alkyl)amines); tris(3-(trimethoxysilyl)propyl)amine and/or other tris((trialkoxysilyl)alkyl)amines); etc.) and another of the trialkoxy monoalkyl silanes is an acrylate-containing or methacrylate-containing trialkoxy monoalkyl silane (e.g., 3-(trimethoxysilyl)propyl methacrylate and/or other (trialkoxysilyl)alkyl acrylates or methacrylates).

The present invention also relates to a method of treating a ferrous metal to improve the ferrous metal's corrosion resistance. The method includes applying, to the surface of the ferrous metal, a coating which includes magnesium/aluminum alloy powder and a binder, in which the magnesium/aluminum alloy powder includes from about 50% to about 97% by weight of magnesium and from about 3% to about 50% by weight of aluminum. Illustratively, the magnesium/aluminum alloy powder can include from more than about 6% to about 50% by weight of aluminum; from about 7% to about 50% by weight of aluminum; from about 3% to about 30% by weight of aluminum; from more than about 6% to about 30% by weight of aluminum; from about 7% to about 30% by weight of aluminum; from about 3% to about 15% by weight of aluminum; from more than about 6% to about 15% by weight of aluminum; and/or from about 7% to about 15% by weight of aluminum. The magnesium/aluminum alloy powder can include other alloying elements, such as calcium, manganese, lithium, carbon, zinc, potassium, silicon, zirconium, and/or a rare earth metal. Examples of suitable magnesium/aluminum alloy powders include those containing (in addition to magnesium and aluminum): manganese; manganese and zinc; manganese and zirconium; manganese, zinc, and zirconium; etc.

The aforementioned magnesium/aluminum alloy powders can be substantially free of one or more other elements. Illustratively, the magnesium/aluminum alloy powder can be substantially free of one or more (e.g., one, two, three, more than three, more than four, all but two, all but one, all, etc.) of Be, Ca, Sr, Ba, Ra, Sc, Y, Ce, Pr, Nd, Pm, Sm, Eu, Gd, Tb, Dy, Ho, Er, Tm, Yb, Lu, Th, Pa, U, Np, Pu, Am, Ti, Zr, Hf, V, Nb, Ta, Cr, Mo, W, Mn, Tc, Re, Fe, Ru, Os, Co; Rh, Ir, Ni, Pd, Pt, Cu, Ag, Au, Zn, Cd, Hg, B, Ga, In, Tl, C, Si, Ge, Sn, Pb, N, P, As, Sb, Bi, S, Se, Te, and Po. As further illustration, the magnesium/aluminum alloy powder can contain less than about 5% (e.g., less than 5%, less than about 4%, less than 4%, less than about 3%, less than 3%, less than about 2%, less than 2%, less than about 1%, less than 1%, less than about 0.5%, less than 0.5%, less than about 0.1%, less than 0.1%, less than about 0.05%, less than 0.05%, less than about 0.01%, less than 0.01%, less than about 0.005%, less than 0.005%, less than about 0.001%, less than 0.001%, about zero, and/or zero) of one or more (e.g., one, two, three, more than three, more than four, all but two, all but one, all, etc.) of Be, Ca, Sr, Ba, Ra, Sc, Y, Ce, Pr, Nd, Pm, Sm, Eu, Gd, Tb, Dy, Ho, Er, Tm, Yb, Lu, Th, Pa, U, Np, Pu, Am, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, Hg, B, Ga, In, Ti, C, Si, Ge, Sn, Pb, N, P, As, Sb, Bi, S, Se, Te, and Po. Additionally or alternatively, the magnesium/aluminum alloy powder can be selected so as to have a corrosion potential that is from about 0.01 volt to about 1.5 volt (e.g., from 0.01 volt to 1.5 volt, from about 0.02 volt to about 1.4 volt, from about 0.03 volt to about 1.3 volt, from about 0.04 volt to about 1.2 volt, from about 0.05 volt to about 1.1 volt, from about 0.07 volt to about 1.1 volt, from about 0.1 volt to about 1 volt, from 0.1 volt to 1 volt, from about 0.2 volt to about 1 volt, from 0.2 volt to 1 volt, from 0.3 volt to 0.9 volt, from 0.4 volt to 0.8 volt, from 0.6 volt to 0.8 volt, about 0.01 volt, about 0.02 volt, about 0.03 volt, about 0.04 volt, about 0.05 volt, about 0.06 volt, about 0.07 volt, about 0.08 volt, about 0.09 volt, about 0.1, about 0.15 volt, about 0.2 volt, about 0.25 volt, about 0.3 volt, about 0.35 volt, about 0.4 volt, about 0.45 volt, about 0.5 volt, about 0.55 volt, about 0.6 volt, about 0.65 volt, about 0.7 volt, about 0.75 volt, about 0.8 volt, about 0.85 volt, about 0.9 volt, about 0.95 volt, about 1.05 volt, about 1.1 volt, about 1.15 volt, about 1.2 volt, about 1.25 volt, about 1.3 volt, about 1.35 volt, about 1.4 volt, about 1.45 volt, and/or about 1.5 volt) more negative than the ferrous metal's corrosion potential, for example, as in the case where the magnesium/aluminum alloy powder has a corrosion potential of from about −0.6 volt to about −1.7 volt (e.g., a corrosion potential of from −0.6 volt to −1.7 volt, a corrosion potential of from about −0.6 volt to about −1 volt, a corrosion potential of from −0.6 volt to −1 volt, etc.).

Specific examples of suitable magnesium/aluminum alloy powders include those made form magnesium alloy AM60, those made form magnesium alloy AZ91B, and those made form magnesium alloy LNR91.

Suitable binders for use in the practice of this aspect of the present invention include those discussed above. For example, the binder can be a polymeric binder, an epoxy polyamide polymeric binder, an epoxy-polyurethane polymeric binder, a radiation-curable binder, an inorganic binder, or combinations thereof.

The present invention also relates to a method of treating a magnesium alloy to improve the magnesium alloy's corrosion resistance. The method includes applying, to the surface of the magnesium alloy, a coating which includes magnesium powder and a binder, in which the magnesium powder includes from about 94% to about 100% by weight of magnesium As noted above, the magnesium powder used to treat magnesium alloys to improve magnesium alloys' corrosion resistance includes from about 94% to about 100% by weight of magnesium. For example, the magnesium powder can include from 94% to 100% by weight of magnesium, from about 94.5% to about 100% by weight of magnesium, from about 95% to about 100% by weight of magnesium, from about 95.5% to about 100% by weight of magnesium, from about 96% to about 100% by weight of magnesium, from about 96.5% to about 100% by weight of magnesium, from about 97% to about 100% by weight of magnesium, from 97% to 100% by weight of magnesium, from about 97.5% to about 100% by weight of magnesium, from about 98% to about 100% by weight of magnesium, from about 98.5% to about 100% by weight of magnesium, from about 99% to about 100% by weight of magnesium, from about 99.5% to about 100% by weight of magnesium, about 99.5% by weight of magnesium, substantially no metal other than magnesium, no added metal other than magnesium, and or about 100% by weight of magnesium. In certain embodiments, the magnesium powder is substantially free from one or more of calcium, manganese, lithium, carbon, zinc, potassium, silicon, zirconium, and rare earth metals. In other embodiments, the magnesium powder is substantially free from calcium, manganese, lithium, carbon, zinc, potassium, silicon, zirconium, and rare earth metals. In certain embodiments, the magnesium powder has a corrosion potential that is from about 0.01 volt to about 1.5 volt (e.g., from 0.01 volt to 1.5 volt, from about 0.02 volt to about 1.4 volt, from about 0.03 volt to about 1.3 volt, from about 0.04 volt to about 1.2 volt, from about 0.05 volt to about 1.1 volt, from about 0.07 volt to about 1.1 volt, from about 0.1 volt to about 1 volt, from 0.1 volt to 1 volt, from about 0.2 volt to about 1 volt, from 0.2 volt to 1 volt, from 0.3 volt to 0.9 volt, from 0.4 volt to 0.8 volt, from 0.6 volt to 0.8 volt, about 0.01 volt, about 0.02 volt, about 0.03 volt, about 0.04 volt, about 0.05 volt, about 0.06 volt, about 0.07 volt, about 0.08 volt, about 0.09 volt, about 0.1, about 0.15 volt, about 0.2 volt, about 0.25 volt, about 0.3 volt, about 0.35 volt, about 0.4 volt, about 0.45 volt, about 0.5 volt, about 0.55 volt, about 0.6 volt, about 0.65 volt, about 0.7 volt, about 0.75 volt; about 0.8 volt, about 0.85 volt, about 0.9 volt, about 0.95 volt, about 1.05 volt, about 1.1 volt, about 1.15 volt, about 1.2 volt, about 1.25 volt, about 1.3 volt, about 1.35 volt, about 1.4 volt, about 1.45 volt, and/or about 1.5 volt) more negative than the magnesium alloy's corrosion potential.

A variety of magnesium alloys can be treated in accordance with the method of the present invention. For example, the magnesium alloy can be one that includes from about 2% to about 15% of aluminum and from about 85% to about 97% of magnesium; the magnesium alloy can be one that includes from about 3% to about 10% of aluminum and from about 90% to about 97% of magnesium; the magnesium alloy can be one that includes from about 5% to about 10% of aluminum and from about 90% to about 95% of magnesium. Specific examples of magnesium alloys that can be treated in accordance with the method of the present invention include AM60, AZ31, AZ61, AZ63, AZ80, AZ91, EZ33, ZM21, HK31, HZ32, QE22, QH21, ZE41, ZE63, ZK40, AND ZK60. In one embodiment, the magnesium alloy to be treated is AM60. In another embodiment, the magnesium alloy to be treated is AZ91. In still other illustrative embodiments, the magnesium alloy to be treated has a corrosion potential of from about −1.3 volt to about −1.75 volt, such as from about −1.4 volt to about −1.75 volt, from about −1.3 volt to about −1.7 volt, from about −1.4 volt to about −1.75 volt, from −1.3 volt to −1.75 volt, from −1.4 volt to −1.75 volt, from −1.3 volt to −1.7 volt, from −1.4 volt to −1.75 volt, etc.

Suitable binders for use in the practice of this aspect of the present invention include those discussed above. For example, the binder can be a polymeric binder, an epoxy polyamide polymeric binder, an epoxy polyurethane polymeric binder, a radiation-curable binder, an inorganic binder, or combinations thereof.

As discussed above, the methods of the present invention are carried out by applying the coatings discussed above to the surface of the metal whose corrosion resistance is to be improved.

The coating can be applied in the form of a suspension, dispersion, or solution in a suitable solvent or combination of solvents, examples of which include ketones (e.g., acetone, methyl ethyl ketone, etc.), aromatic hydrocarbon solvents (e.g., toluene, xylenes, etc.), alkane solvents (e.g., hexane, pentane, etc.), polypropylene carbonate, ethyl-3-ethoxypropionate ("EEP"), and combinations thereof. Application can be carried, out for example, by any suitable technique, such as spraying (e.g., airless spraying or spraying with the use of air), brushing, rolling, flooding, immersion, etc., to achieve a suitable coating thickness, such as from about 10 to about 200 microns, from about 10 to about 150 microns, from about 10 to about 100 microns, from about 30 to about 150 microns, from about 30 to about 100 microns, from about 30 to about 80 microns, from about 40 to about 150 microns, from about 40 to about 100 microns, from about 40 to about 60 microns, from about 40 to about 60 microns, about 120 microns, about 110 microns, about 100 microns, about 90 microns, about 80 microns, and/or about 50 microns.

The coating can be applied directly to the metal's surface, or it can be applied indirectly to the metal's surface, for example, as discussed in International Publication No. WO 2005/051551, which is hereby incorporated by reference.

The methods of the present invention can also include contacting the binder with a crosslinker. Examples of suitable crosslinkers and methods for their use are described in and other details of which are described in International Publication No. WO 2005/051551, which is hereby incorporated by reference.

Once applied to the metal surface, for example, as described above, the coating (i.e., the coating formulation containing magnesium powder, binder, etc.) can be cured, for example, for from about 1 hour to about 1 month (such as for about 2 hours, for about 8 hours, for about 12 hours, for about 18 hours, for overnight, for about a day, for about two days, for about a week, for about two weeks, etc.) at a temperature of from about room temperature to about 50° C., such as at from about 30° C. to about 40° C. and/or at about 35° C. In the case where a radiation-curable binder is used, the coating (i.e., the coating formulation containing magnesium powder, binder, etc.) can be cured by exposing the coating to suitable radiation (e.g., UV light, such as UV light having a wavelength or wavelengths in the range from 100 nm to 405 nm for from about 1 second to about 5 minutes (such as for about 2 seconds, for about 5 seconds, for about 10 seconds, for about 30 seconds, for about 1 minute, for from about 10 seconds to about 1 minute, for about 2 minutes, for about 3 minutes, etc.) at any suitable temperature, such as at room temperature. In the case where an inorganic binder is employed, the coating (i.e., the coating formulation containing magnesium powder, binder, etc.) can be cured by an suitable technique, such as by exposing the coating to temperatures of from about 70° C. to about 150° C. (e.g., of from about 90° C. to about 120° C. or of about 100° C.) for from about 1 hour to about 1 month (e.g., for from about 8 hours to about 1 week, for about 4 hours, for about 8 hours, for about overnight, for about 12 hours, for about 16 hours, for about 1 day, for about 2 days, for about 3 days, for about 5 days, for about 1 week, etc.); such as by exposing the coating to a temperature of about 100° C. for about 12-20 hours or overnight; and/or such as by exposing the coating to about room temperature for about a week.

The coating can be top coated using any compatible topcoat formulation, such as Extended Lifetime™ Topcoat, for example by spraying or brushing to achieve a topcoat thickness of from about 20 to about 200 microns, such as from about 50 to about 150 microns, from about 80 to about 120 microns, and/or about 100 microns.

The coating can include, in addition to magnesium powder and binder, other materials, such as various organic or inorganic materials. Illustratively, the coating can include other metals or metal-containing compounds. In certain embodiments, the coating can include other metals or metal-containing compounds that include one or more (e.g., one, two, three, more than three, more than four, all but two, all but one, all, etc.) of Be, Ca, Sr, Ba, Ra, Sc, Y, Ce, Pr, Nd, Pm, Sm, Eu, Gd, Tb, Dy, Ho, Er, Tm, Yb, Lu, Th, Pa, U, Np, Pu, Am, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, Hg, B, Al, Ga, In, Tl, C, Si, Ge, Sn, Pb, N, P, As, Sb, Bi, S, Se, Te, and Po. In certain other embodiments, the coating can be substantially free of such other metals or metal-containing compounds. Illustratively, the coating can be substantially free of other metals or metal-containing compounds (except for metals or metal-containing compounds (if any) that may be alloyed with the magnesium in the magnesium powder) that contain one or more (e.g., one, two, three, more than three, more than four, all but two, all but one, all, etc.) of Be, Ca, Sr, Ba, Ra, Sc, Y, Ce, Pr, Nd, Pm, Sm, Eu, Gd, Tb, Dy, Ho, Er, Tm, Yb, Lu, Th, Pa, U, Np, Pu, Am, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, Hg, B, Al, Ga, In, Tl, C, Si, Ge, Sn, Pb, N, P, As, Sb, Bi, S, Se, Te, and Po. As further illustration, other than metals or metal-containing compounds (if any) that may be alloyed with the magnesium in the magnesium powder, the coating can contain less than about 5% (e.g., less than 5%, less than about 4%, less than 4%, less than about 3%, less than 3%, less than about 2%, less than 2%, less than about 1%, less than 1%, less than about 0.5%, less than 0.5%, less than about 0.1%, less than 0.1%, less than about 0.05%, less than 0.05%, less than about 0.01%, less than 0.01%, less than about 0.005%, less than 0.005%, less than about 0.001%, less than 0.001%, about zero, and/or zero) of one or more (e.g., one, two, three, more than three, more than four, all but two, all but one, all, etc.) of Be, Ca, Sr, Ba, Ra, Sc, Y, Ce, Pr, Nd, Pm, Sm, Eu, Gd, Tb, Dy, Ho, Er, Tm, Yb, Lu, Th, Pa, U, Np, Pu, Am, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, Hg, B, Al, Ga, In, Tl, C, Si, Ge, Sn, Pb, N, P, As, Sb, Bi, S, Se, Te, and Po. In one embodiment, the coating further includes a rare earth metal, such as cerium. The cerium can be present in the form of cerium metal, cerium oxides, cerium salts, or combinations thereof. The cerium can be applied to the magnesium powder or a portion thereof, for example in the form cerium nitrate or other cerium salt. For example, in cases where the magnesium powder includes a mixture of two or more magnesium particle powders, each having different mean particle size distributions, such as in the case where the magnesium powder includes a first magnesium particle powder and a second magnesium particle powder, where the first magnesium particle powder's mean particle size distributions is less than 20 μm and where the second magnesium particle powder's mean particle size distributions is greater than 20 μm, the cerium can be applied to the surface of the first magnesium particle powder but not to the second magnesium particle powder. Additionally, or alternatively, the cerium metal, oxide, or salt can be dispersed in a binder used in the coating. Still additionally or alternatively, the cerium metal, oxide, or salt can be applied to the metal surface, e.g., in the form of cerium nanoparticles, prior to applying the coating thereto, for example, as in the case where the method of the present invention further includes a step of pretreating the surface of the metal with cerium ion. These and further details with regard to the use of cerium can be found in International Publication No. WO 2005/051551, which is hereby incorporated by reference.

Certain aspects of the present invention are further illustrated with the following examples.

EXAMPLES

Example 1

Preparation and Characterization of Magnesium-Rich Radiation Curable Coatings

An unsaturated polyester was used as a UV-curable binder for two magnesium-rich primer formulations (20% PVC and 40% PVC).

The polyester UV-curable magnesium-rich primer formulations were prepared from 2.66 g of unsaturated polyester, 1.01 g triethyleneglycoldivinylether (BASF, TEG DVE), 0.13 g of photoinitiator (Ciba, Darocur 1173), and either 0.68 g (20% PVC) or 1.37 g (40% PVC) of Mg powder (Ecka granules, Mg 3820).

The 20% PVC and 40% PVC polyester formulations were coated on Al 2024 T3 panels and cured by exposure to UV radiation. Despite the heavy loading of magnesium, both polyester formulations cured, and mechanically stable films of thicknesses of about 100 microns were obtained.

Figure 27A:
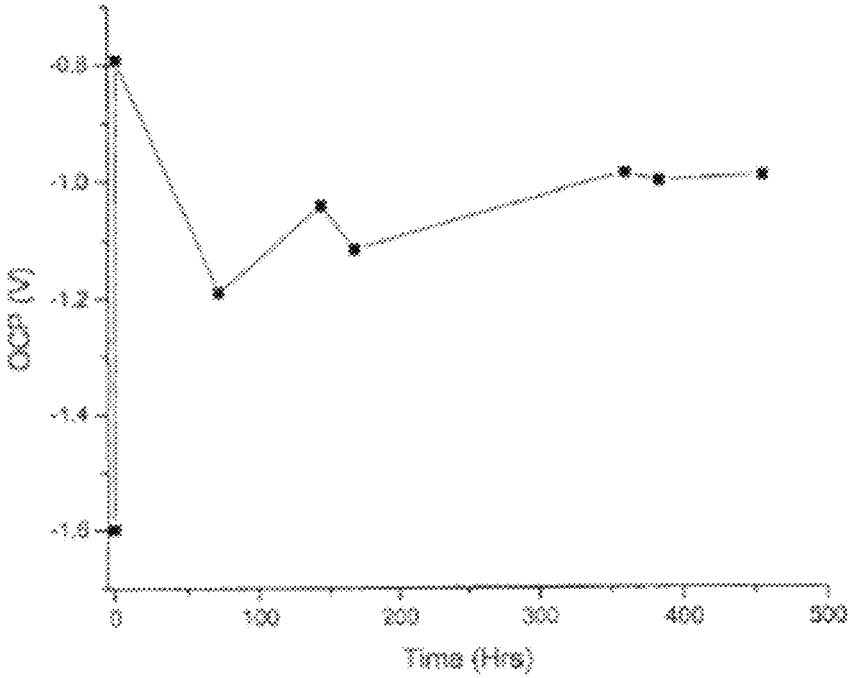
FIG. 27A PRIOR ART
FIG. 27A is a graph of open circuit potential ("OCP") as a function of time in constant immersion in Dilute Harrison's Solution for a UV-Curable Mg-rich primer coating formulation.
Figure 27B:
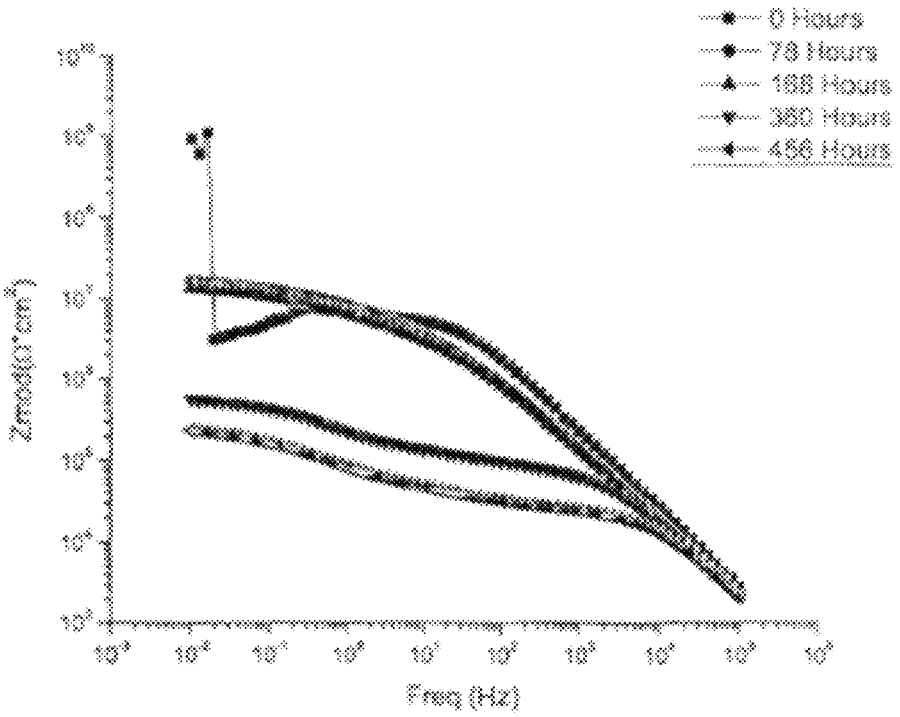
FIG. 27B PRIOR ART
FIG. 27B is a graph showing [Z] modulus as a function of frequency at various times of a UV-curable Mg-rich primer coating formulation in constant immersion in Dilute Harrison's Solution. Both figures were disclosed in US 20090155598.
Figure 28A:
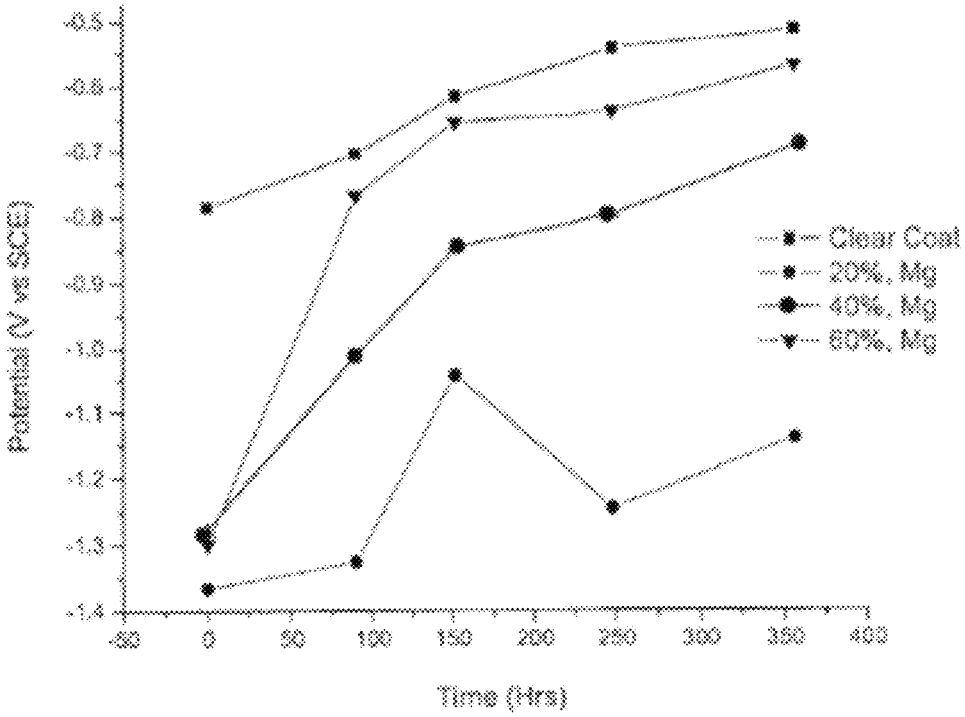
FIG. 28A PRIOR ART
FIGS. 28A and 28B are graphs showing changes in OCP that occurred during exposure of various Mg-rich primer coating formulations containing inorganic binders in Prohesion, FIG. 28A and B117, FIG. 28B corrosion chambers, disclosed in U.S. Application 20090155598.
Figure 28B:
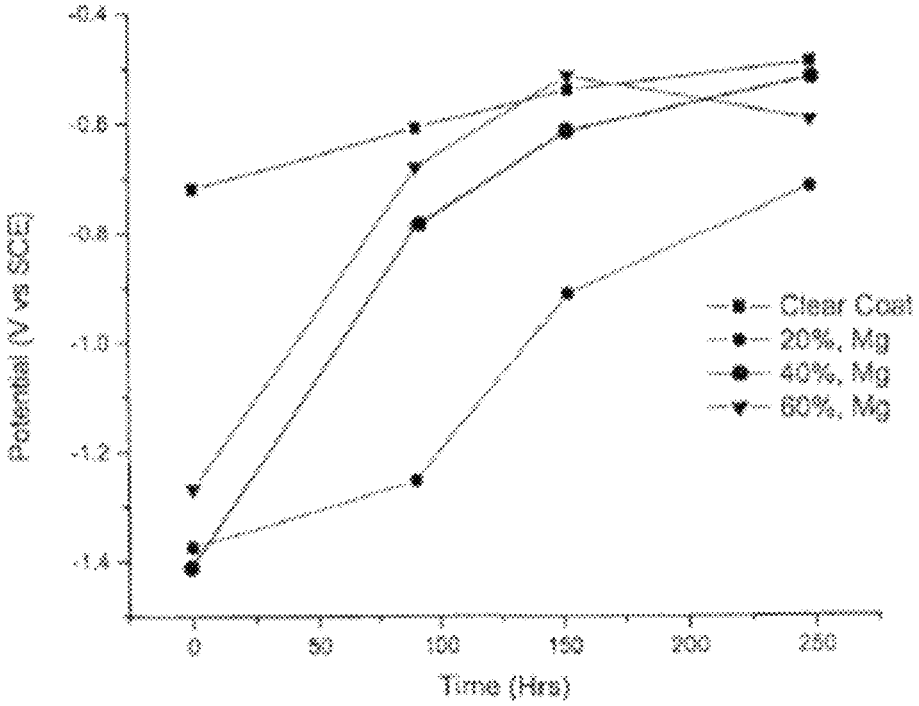
FIG. 28B PRIOR ART

Referring to FIG. 27A, the coatings showed good open-circuit potential ("OCP") in constant immersion experiments using Dilute Harrison's Solution, showing that the Mg in the coating is in contact with the aluminum substrate. Performance in exposure chamber experiments were not as good. Impedance studies in constant immersion using Dilute Harrison's Solution indicated that the primer initially provided protection to the substrate but that the protection is only temporary, as shown in FIG. 27B.

In a separate series of experiments, an unsaturated acrylic system was used as a UV-curable binder for two magnesium-rich primer formulations (20% PVC and 40% PVC).

The acrylic UV-curable magnesium-rich primer formulations were prepared from 2 g of polyoxyethylene tetraacrylate (Sartomer, SR494), 2 g of acrylate oligomer (Sartomer, CN929), 0.16 g of photoinitiator (Ciba, Darocur 1173), and either 0.68 g (20% PVC) or 1.37 g (40% PVC) of Mg powder (Ecka granules, Mg 3820).

The 20% PVC and 40% PVC formulations were coated and cured by exposure to UV radiation. Again, despite the heavy loading of magnesium, both formulations cured, and mechanically stable films were obtained.

Example 2

Development of Inorganic Binders for Magnesium-Rich Primers

In order for the magnesium particles to provide optimal cathodic protection of an aluminum alloy substrate, it is believed that they should be in electrical contact with the substrate. The silicate binder is electrically insulating and protects aluminum surfaces against corrosion. The magnesium particles in magnesium silicate primer may then be protected by the silicate and insulated from the aluminum surface. Magnesium silicates can be pigmented above the critical pigment volume concentration ("CPVC"). When pigmenting above the CPVC, the binder is not able to wet all the pigment particles, and there will be pores between the particles. This may be an advantage in magnesium-rich primers, since the presence of an electrolyte at the magnesium particle surface may enhance the anodic reaction and could also provide better adhesion, cohesion, and overcoatability with topcoat.

The traditional inorganic silicate, the tetraethyl orthosilicate ("TEOS"), though not an organic silicate, still can be used as film formation material, especially as the binder of the zinc-rich primers. TEOS could undergo hydration and condensation processes and form polysiloxane network in the air. The structure of polysiloxane is very complex, and its final hydration products are $SiO_2$ and water. The basic process is the hydration into silanol and condensation in the acidic condition. The film formed from TEOS only is usually brittle and other additives, for example, polyvinylbutyral ("PVB") can be added in the formula to improve the ductility of the film. It is believed that the incorporation of organic groups could make it possible to increase ductility and thickness and to reduce the micro-cracks, thus enhancing the electrolytic anti-corrosion performance. Several organic silanes, such as bis[3-(trimethoxysilyl)propyl) amine, 3-methacryloxypropyl-trimethoxysilane ("MAPTS"), and diethylphosphatoethyl-triethoxysilane, could be used, together with TEOS, as the binder for the magnesium particles.

Three coating formulations were prepared using the following materials: 3-(trimethoxysilyl)propyl methacrylate, 98% (M); tetraethyl orthosilicate, 99% (T); bis[3-(trimethoxysilyl)-propyl)amine, 90+% (B); ethyl alcohol (ethanol) 95%, denatured; and 0.05 molar acetic acid solution. In all of the formulations, the mole ratio of M to T was 4:1, and the mole ratio of B to M+T was 1:9. 50 ml of ethanol were placed into a glass jar. The jar was placed onto a magnetic stirrer, and the solution was stirred for about one hour. A small amount of 0.05M acetic acid was added to the ethanol solution, and the temperature of the solution was increased to 60.+−0.2° C. Chemical M and T were added to the solution, and stirring was continued at 60° C. for 1.5 hr. The jar was capped, and allowed to cool to ambient temperature to form a sol solution. Chemical B was added to the sol solution about 2 hr. before adding magnesium particles. Mg particles (Ecka granules, Mg 3820) were then added to the sol-solution, and stirring was continued for at least 0.5 hour for good dispersion of particles.

The resulting primers were sprayed onto Al 2024 T-3 panels, which had been previously sanded with 600 grit sanding paper and then cleaned by ethanol. The coated panels were put into oven at 100° C. for 15 hr. The panels were then cooled and, once cooled, were ready for testing.

Details regarding the coating formulations are set forth in Table A1.

TABLE A1

| | BMT501-20 | BMT501-40 | BMT501-60 |
|---|---|---|---|
| PVC | 20% | 40% | 60% |
| M | 25.5 ml | 19.1 ml | 12.7 ml |
| T | 6.0 ml | 4.5 ml | 3.0 ml |
| B | 4.9 ml | 3.7 ml | 2.5 ml |
| Ethanol | 50 ml | 50 ml | 50 ml |
| 0.5M Acetic Acid | 0.7 ml | 0.6 ml | 0.4 ml |
| Mg particles | 7.0 g | 13.9 g | 20.9 g |
| Total volume | 100 ml | 100 ml | 100 ml |
| Coating Thickness | 35 ± 3 μm | 65 ± 6 μm | 98 ± 10 μm |

In addition, a fourth Al 2024 T-3 panel was coated with a sol-solution containing no magnesium particles. The silicate clear coat panel had a coating thickness of 30.+−0.5 μm and a PVC of zero.

Thermal stability of the silicate clear coat was evaluated by thermogravimetry ("TG"). The TG curve showed only one weight loss during the heat treatment. There was no appreciable weight loss before 100° C., which would have been attributed to the volatilization of solvent (ethanol) and water. Stability at a temperature of around 240° C. was enhanced, probably due to the further condensation reaction between Si—OH together with the pyrogenic decomposition of organic components, especially the decomposition of organic groups incorporated by MAPTS in the formula.

FTIR-photoacoustic spectroscopy of the silicate clear coat showed C—H and C═O stretching bands, attributed to the organic components in the silicate. An absorption band in the region of 1000 $cm^{-1}$ to 1200 $cm^{-1}$ was observed, and this is believed to correspond to Si—O—Si stretching. It was reported that the absorption peak of Al—O—Si bonds should also be 1046 $cm^{-1}$ or 1014 $cm^{-1}$ in the silane pretreated aluminum system. This Al—O—Si was favorable for a stronger adhesion to the Aluminum alloy substrate.

Wet adhesion experiments were conducted by immersing the panels into deionized ("DI") water for 24 hrs., after which the panels were removed from the DI water and cross-scribed. All the samples showed no cracks and good adhesion. The high PVC sample (60%) showed white areas on the surface, which may be due to a reaction of the Mg particles with water during the immersion.

Scanning electron microscopy ("SEM") was used to observe the microstructure of the coatings' surfaces and cross-sections. The surface of the low PVC primer (20%) showed micro cracks, and Mg particles were buried into the binder, perhaps due to the high volume of silicate binder present. In contrast, the high PVC primer (60%) showed much rougher surface that was covered by Mg particles, which may form pores through the coat. The cross-sectional SEM images also showed the differences in thickness and uniformity of these two primers.

Potentiodynamic polarization experiments were carried out on bare aluminum and on the 0%, 20%, 40%, and 60% PVC panels. The silicate clear coated panel (0% PVC) provided a barrier property to the bare aluminum. All three Mg-rich primers offered cathodic protection to the substrate. The corrosion potential was around −1.4 VSCE, which is between pure magnesium and aluminum 2024 T-3. The low PVC primer (20% PVC) appeared to be best, probably due to the high fraction of binder offering a better barrier property.

The 0%, 20%, 40%, and 60% PVC panels were scribed in an "X" pattern (scribe length of 5 cm) and the scribed panels were exposed in Prohesion and B117 corrosion chambers for about 400 hours, OCP changes were monitored during exposure in the Prohesion and B117 corrosion chambers. The OCP changes that occurred during exposure in the corrosion chambers are presented in graphical form in FIG. 2A (Prohesion) and FIG. 2B (B117). Visual inspection of the panels and analysis of the OCP experiments reveal that all of the Mg primers (20%, 40%, and 60% PVC) provided corrosion protection greater than that provided by the silicate clear coat. The lower PVC primer (20%) exhibited better corrosion protection, despite its low thickness, and this observation is believed to be due to the fact that the panels were not topcoated. In general, we have observed that untopcoated samples tend to perform better at low PVC, since low PVC samples have a higher level of binder which is believed to provide better barrier protection. The higher PVC primers were thicker but may have pores through the coating that may accelerate the anodic reaction and consume magnesium particles more quickly. Conducting OCP and corrosion chamber experiments with topcoated panels at varying PVCs will readily permit optimization of the system.

Example 3

Development of Magnesium-Rich Primers for Ferrous Substrates

Coatings containing particles of three different Mg alloys were used to investigate the effect of primers containing Mg alloys on the corrosion of ferrous substrates. AM60, AZ91B, and LNR91 magnesium alloy were used in the coatings. AM60 alloy contains about 5% aluminum, AZ91B alloy contains about 9% aluminum, and LNR91 alloy contains about 50% aluminum.

The coatings were prepared by dispersing AM60 (particle size diameter of about 63 microns), AZ91B (particle size diameter of about 59 microns), and LNR91 (particle size diameter of about 56 microns) magnesium alloy particles in an epoxy polyamide binder at PVCs of from about 30% to 50%. The coatings were applied to low carbon steel panels by spraying, and the coated panels were put into oven at about 60° C. for about 3 hours. The panels were then cooled and, once cooled, were ready for testing. The coatings had thicknesses of about 80-100 microns.

A typical formulation (45% PVC) was prepared by mixing Parts A and B. Part A contained: 32.06 g of EPON™ Resin 828 (available from Resolution Performance Produce, Houston, Tex.); 1.78 g of TEXAPHOR™ 963 Dispersant (available from Cognis Corporation, Cincinnati, Ohio); 7.06 g of CAB-O-SIL™ TS-720 (available from Cabot Corporation); 85.99 g of Mg particles; 5.81 g of BEETLE™ 216-8 (available from Cytec Industries, Inc.); 5.99 g of MIBK (available from Shell Chemical Co.); 5.93 g of Acetone (available from Shell Chemical Co.); and 40.75 g of AROMATIC™ 100 (available from Exxon Chemical Co.). Part B contained: 43.39 g of EPI-CURE™ Curing Agent 3164 (available from Resolution Performance Produce, Houston, Tex.); 0.72 g of CAB-O-SIL™ TS-7620 (available from Cabot Corporation); 22.68 g of NICRON™ 402 tale (available from Luzenac America, Itaska, Ill.); 3.95 g of acetone (available from Shell Chemical Co.); and 3.83 g of n-butanol (available from Shell Chemical Co.).

The panels were scribed in an "X" pattern (scribe length of 5 cm), and the scribed panels were exposed in B117 corrosion chambers for about 300 hours. Images of a panel coated with AM60 magnesium alloy particles at 45% PVC after 24-hour, 66-hour, and 265-hour B117 exposure are shown in FIGS. 3A-3C, respectively.

Visual inspection of the AM60-coated panels showed that the AM60 coating provided corrosion protection for about 200 hours. Visual inspection of the AZ91B-coated and LNR91-coated panels showed that the AZ91B coating also provided corrosion protection for about 200 hours, while the LNR91 coating provided corrosion protection for about 50 hours. Of the PVCs used, 45% PVC showed the best corrosion protection.

Figure 29A:
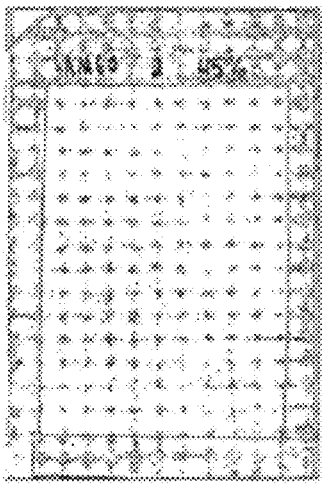
FIG. 29A PRIOR ART
FIGS. 29A-C are images of scribed ferrous metal substrate panels coated with AM60 magnesium alloy particles at 45% PVC after 24-hours, FIG. 29A, 66-hours, FIG. 29B, and 265-hours, FIG. 29C exposure in a B117 corrosion chamber.
Figure 29B:
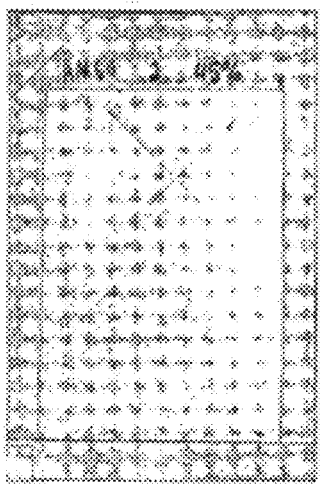
FIG. 29B PRIOR ART
Figure 29C:
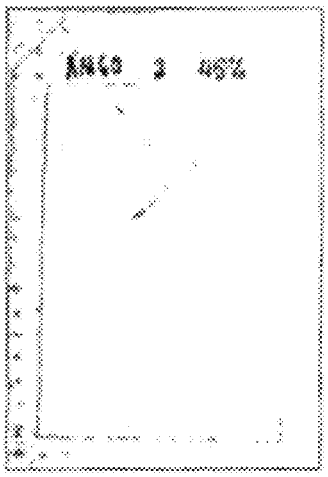
FIG. 29C PRIOR ART
Figure 29D:
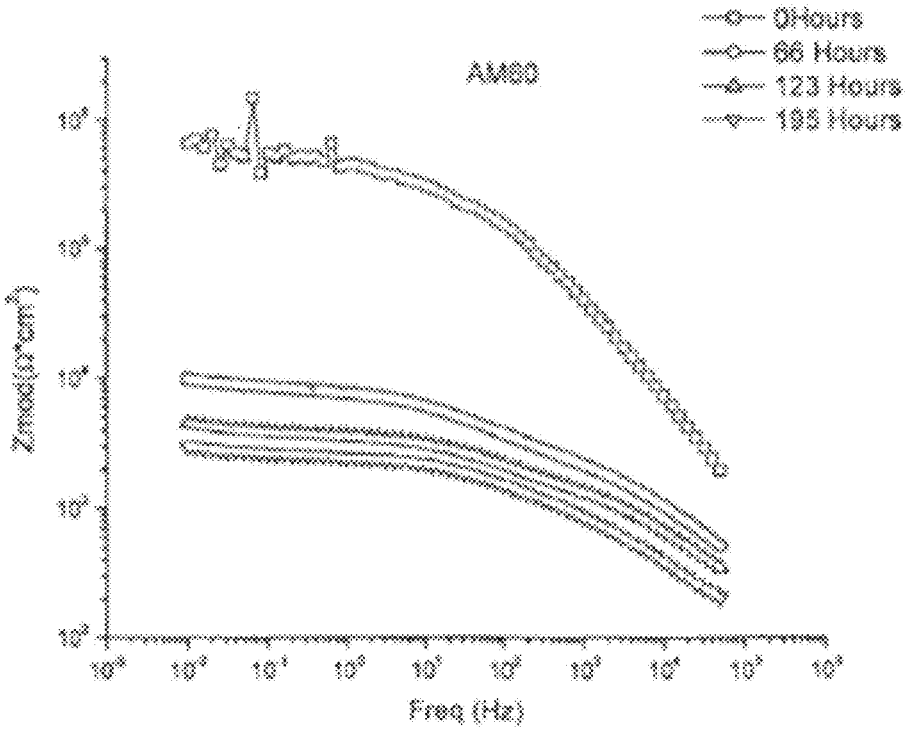
FIG. 29D PRIOR ART
FIGS. 29D and 29E are graphs showing [Z] modulus as a function of frequency at various exposure times in a B117 corrosion chamber for ferrous metal substrate panels coated with Mg-rich primers formulated with AM60, FIG. 29D and AZ91B, FIG. 29E magnesium allow particles.
Figure 29E:
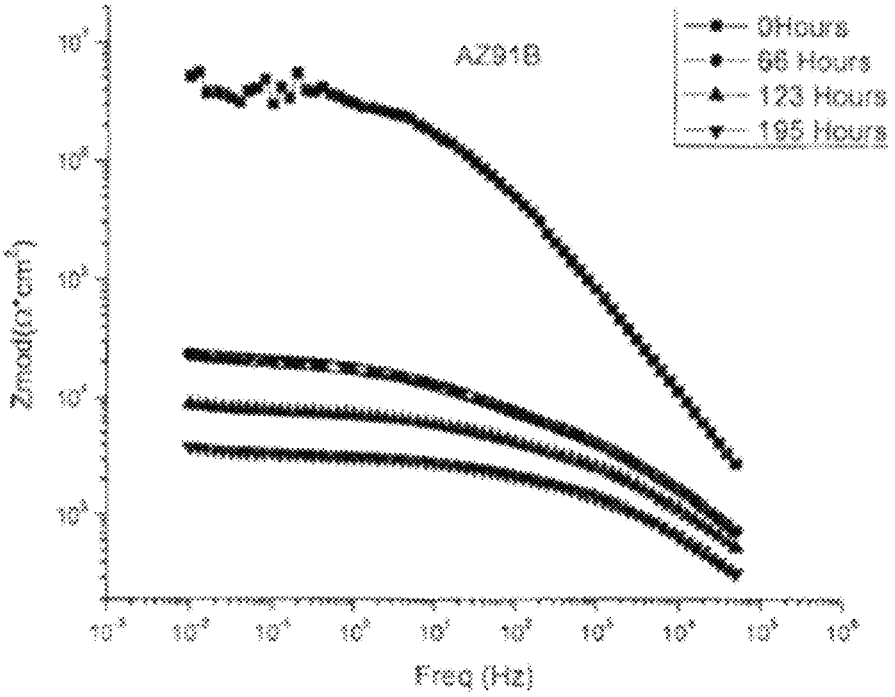
FIG. 29E PRIOR ART
Figure 29F:
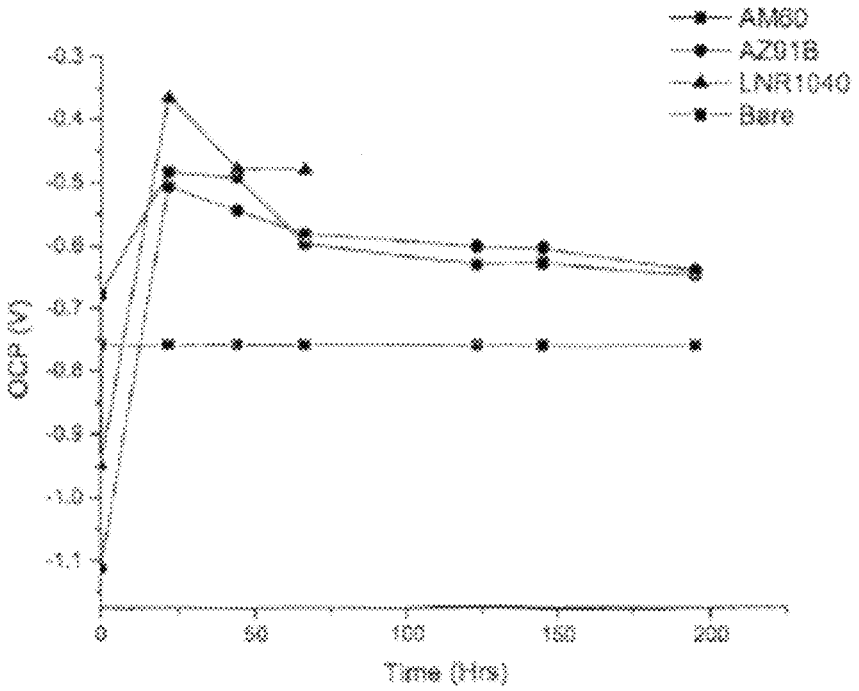
FIG. 29F PRIOR ART
FIG. 29F is a graph showing OCP changes that occurred during B117 exposure of ferrous metal substrate panels coated with Mg-rich primers formulated with AM60, AZ91B, and LNR91 magnesium alloy particles, as disclosed in US 20090155598.

The aluminum content in the magnesium alloy particles appears to have two distinct contributions: (1) at low aluminum content, the magnesium alloy behaves similarly to pure Mg but has an OCP that is slightly lower; and (2) at high aluminum content, the effect of the aluminum appears to be detrimental. Graphs showing |Z| modulus as a function of frequency at different exposure times (B117) for Mg-rich primers formulated with AM60 and AZ91B magnesium alloy particles are shown in FIGS. 29D and 29E. OCP changes were monitored during exposure in the B117 corrosion chamber, and the results for the AM60, AZ91B, and LNR91 coatings (along with results for bare substrate) are shown in FIG. 3F.

Example 4

Development of Magnesium-Rich Primers for Magnesium Alloy Substrates

Mg rich primer was applied on AZ91B magnesium alloy to investigate the possibility of providing cathodic protection on magnesium alloy substrates. The close proximity of the OCP of magnesium alloys and pure Mg particles suggest that the pure Mg particles may yield short term protection. However, even short-term protection would be valuable and suggests that, through optimization, longer term protection can be achieved.

Mg rich primer was prepared at 50% PVC in a silane-modified epoxy isocyanate hybrid binder, as described in International Publication No. WO 2005/051551, which is hereby incorporated by reference. The Mg rich primer was applied to the surface of AZ91B magnesium alloy panels by spraying; and the coated panels were put into oven at 60° C. for 3 hours. The panels were then cooled and, once cooled, were ready for testing. The coatings had thicknesses of about 50-80 microns. It was noted that, as an alternative to oven curing, curing could be achieved overnight at room temperature. Nine coated panels were weathered in the B117 exposure chamber (5% NaCl constant fog) for over 1200 hours, and the panels were characterized by OCP and EIS monitoring, as well as by periodic visual inspections.

The OCP experiments showed that the OCP was highly unstable, with considerable fluctuation, as one might expect for extremely active substrates, such as the Mg alloy substrates used in these experiments. Nevertheless, the overall OCP behavior was encouraging and leaves room for optimization.

Figure 30A:
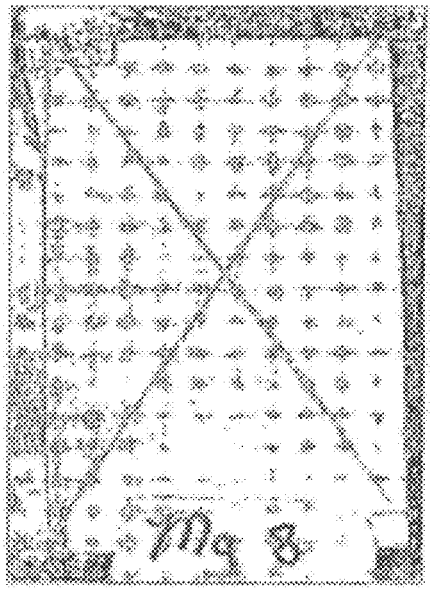
FIG. 30A PRIOR ART
FIGS. 30A and 30B, disclosed in US 20090155598, are images of two AZ91B Mg alloy substrate panels coated with Mg-rich primer after 2275 hours of exposure in a B117 corrosion chamber.
Figure 30B:
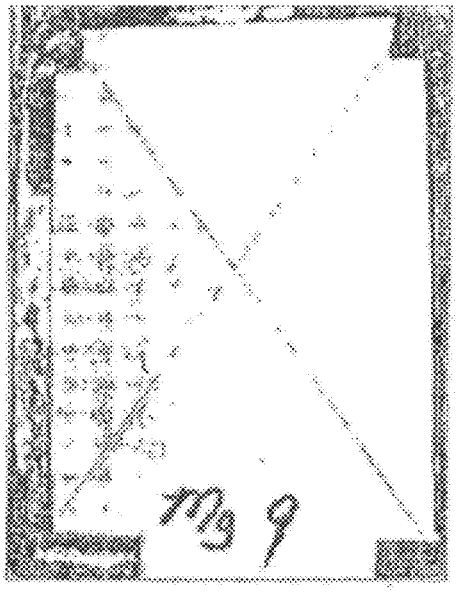
FIG. 30B PRIOR ART

Visual inspection showed that a majority of the samples exposed to weathering maintained a high degree of protection, as shown by the appearance of the scribed areas shown in FIGS. 30A and 30B. FIGS. 30A and 30B are images of two AZ91B Mg alloy substrate panels coated with Mg-rich primer after 2275 hours of weathering.

Figure 30C:
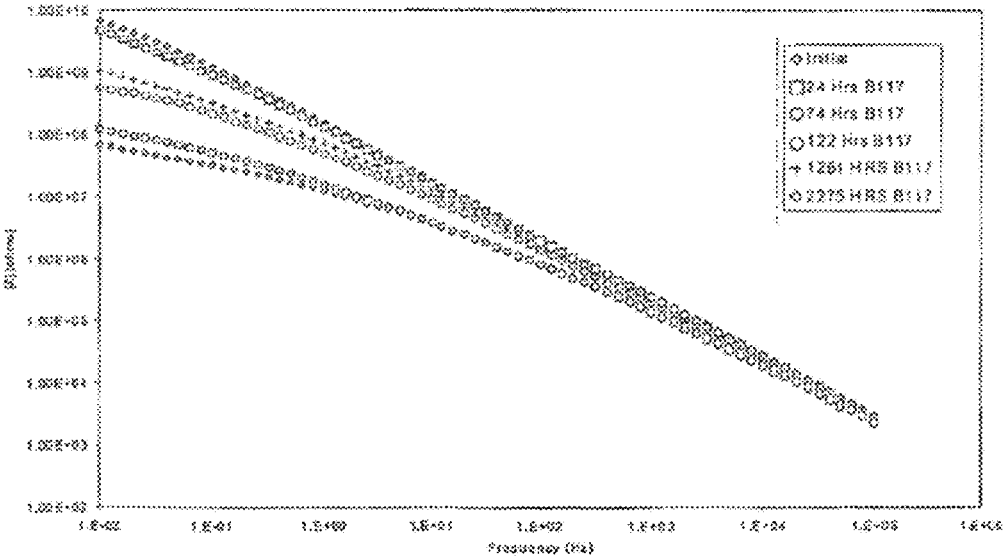
FIG. 30C PRIOR ART
FIG. 30C shows the evolution of the modulus of the electrochemical impedance as a function of frequency at various times while the panels were exposed to B117 weathering as disclosed in US 20090155598.

FIG. 30C shows the evolution of the modulus of the Electrochemical Impedance as a function of frequency over time as the samples were exposed to B117 weathering. Initially, the behavior is purely capacitive with $|Z| \sim 10^{-10}$, a sign that the topcoat is behaving as a pure barrier against the ingress of electrolyte. After some time, the |Z| decreases, a sign that the barrier properties are decreasing and that the electrolyte is starting to penetrate the coating. An intermediate value is reached around $10^9$, and there are some fluctuations in the values (a phenomenon that we have observed when using Mg-rich primers for other systems). It is believed the fluctuations are due to competing processes: decreases in |Z| is sign of a decrease in the barrier properties and subsequent increases in |Z| (while the OCP is decreasing) is a result of the activation of the Mg powder that starts providing cathodic protection.

The experiment was carried on until 2275 hours of exposure, and, at this time, the |Z| was about $10^8$, and half of the panels displayed clean scribes with no accumulation of corrosion products and no blisters away from the scribe.

Example 5

Use of Mg-Rich Primers for Protecting Various Substrates Effect of Substrate Composition, Binder, Pigment Volume Concentration, and Particle Size and Shape In order to demonstrate that the Mg-rich primers described in International Publication No. WO 2005/051551, which is hereby incorporated by reference, could be used with commercially available binders and are suitable for use on Al alloys other than 2024 T3 and 7075 T6, a two-component Mg-rich primer was applied on Al alloys 5052, 6061, and 2024 (as control) using a commercially available, two-component epoxy-polyamide as binder. The two-component Mg-rich primer was also applied on a titanium alloy (Ti4Al6V).

The coated samples were tested by exposure in a B117 corrosion chamber for about 3000 hours, and, at various times, the exposed samples were characterized (i) visually, (ii) by OCP monitoring, and (iii) by electrochemical impedance spectroscopy.

The samples on the titanium alloy failed during the first week of exposure. It is believed that the low level of protection afforded by the Mg-rich primer was due to a big difference in the open circuit potential between titanium alloy substrate and the Mg particles.

Figure 31A:
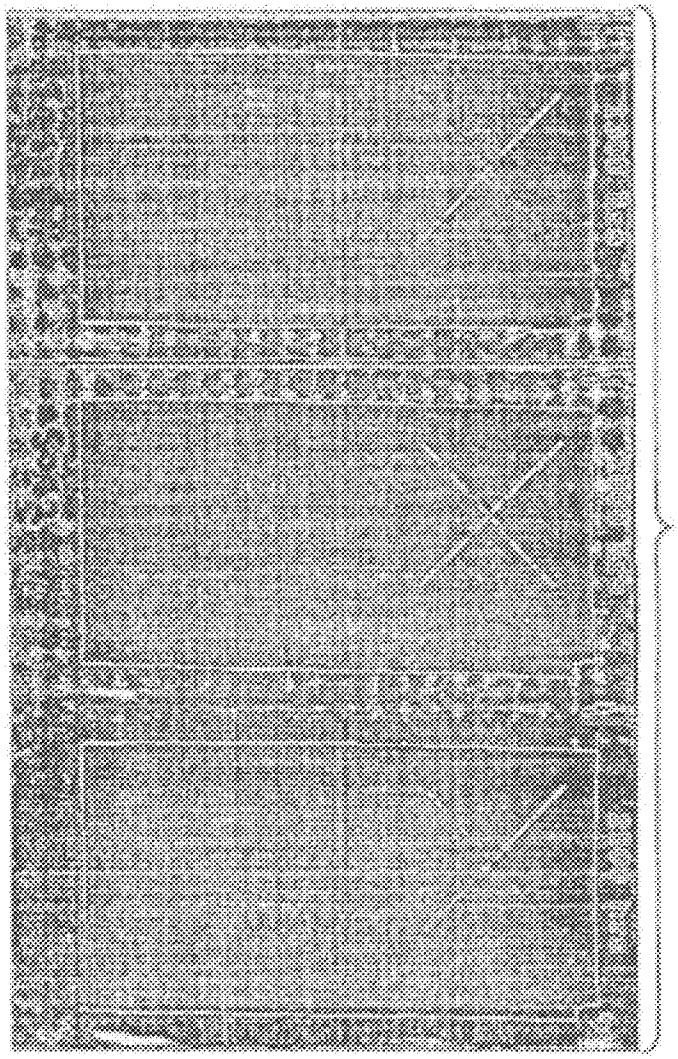
FIG. 31A PRIOR ART
FIGS. 31A and 31B are images of Al 5052, FIG. 31A and AI6061, FIG. 31B panels coated with a Mg-rich primer containing a two-component, commercially available epoxy-polyamide binder at various times during exposure in a B117 corrosion chamber.
Figure 31B:
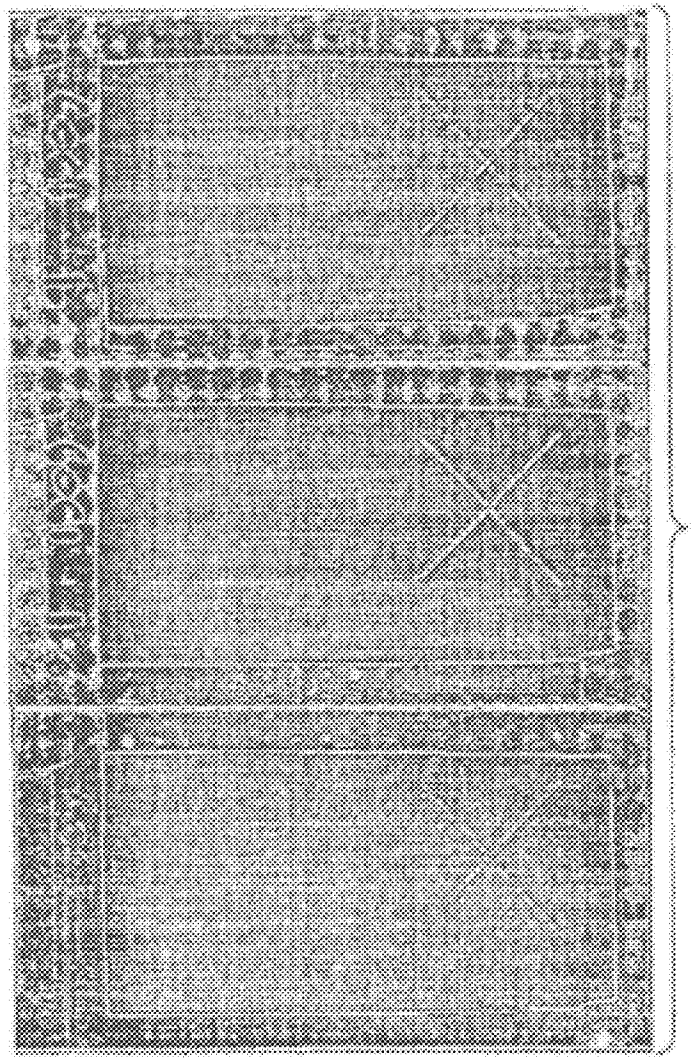
FIG. 31B PRIOR ART
Figure 31C:
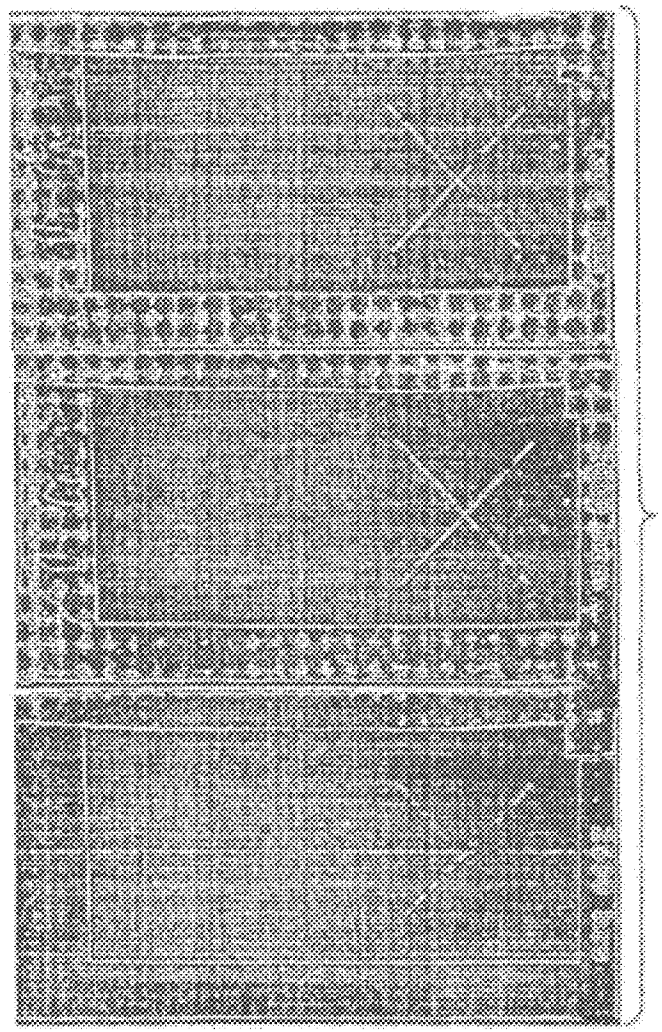
FIG. 31C PRIOR ART
FIGS. 31C and 31D are images of AI 2024 panels protected with Mg-rich primer containing the two component commercially available epoxy-polyamide binder, FIG. 31C and of AI2024 panels protected with Mg-rich primer containing a prior silane-modified epoxy isocyanate hybrid binder, FIG. 31D at various times during exposure in a B117 corrosion chamber.
Figure 31D:
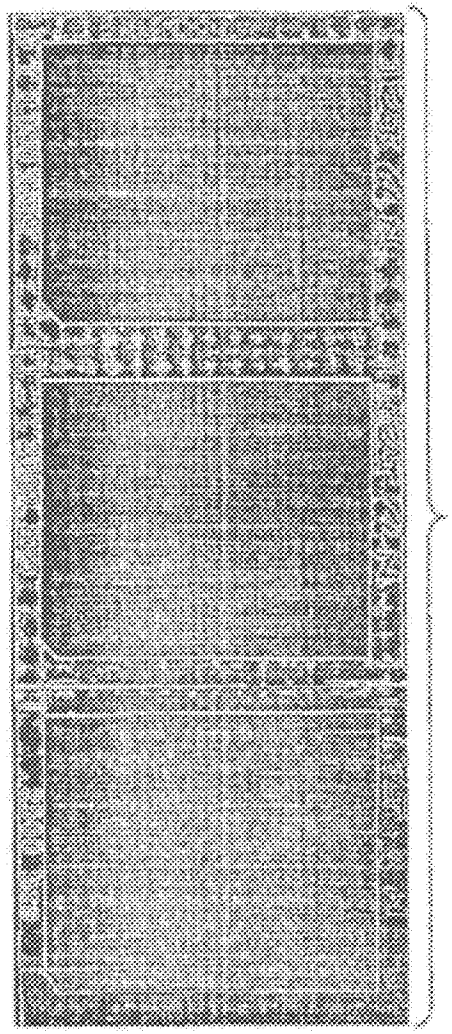
FIG. 31D PRIOR ART

Visual Inspection. Al 5052 (FIG. 31A) and Al 6061 (FIG. 31B) showed performances comparable to the performances previously observed for Al 2024 and Al 7075. Al 2024 panels protected with Mg-rich primer containing the two-component binder (commercially available epoxy-polyamide) (FIG. 31C) showed performances comparable to the performances of Al 2024 panels protected with Mg-rich primer containing the silane modified epoxy isocyanate hybrid binder described in International Publication No. WO 2005/051551, which is hereby incorporated by reference (FIG. 31D).

Figure 31E:
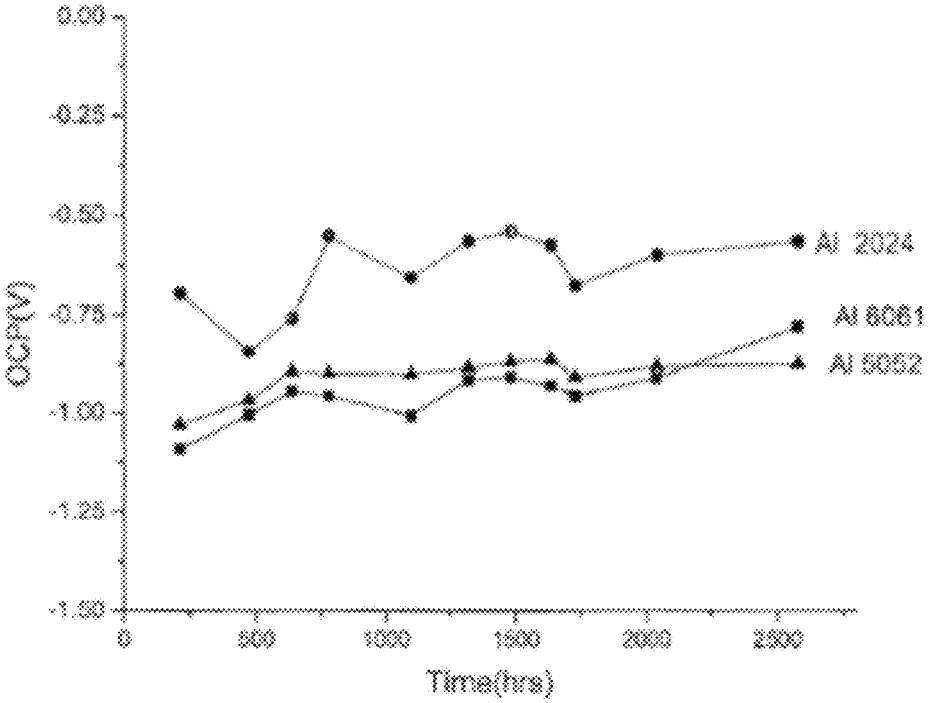
FIG. 31E PRIOR ART
FIG. 31E is a graph showing changes in OCP as a function of immersion time, B117, for topcoated Mg-rich primers containing an epoxy-polyaide binder on AI2023, AI5052 and AI6061 substrates, disclosed in US 20090155598.

OCP Monitoring. The OCP measurement is the most immediate way to understand if the Mg-rich primer provides cathodic protection to the substrate. FIG. 31E shows the evolution of the OCP for the coating system on Al 2024, Al 5052, and Al 6061. For all the substrates, the OCP is shifted on the negative side (cathodic), a sign that the primer is providing cathodic protection. There is a tendency for the OCP to drift towards the value of the bare substrate (about −600 mV for all of the aluminum alloys), and this drift can be controlled by the pigment volume concentration of the primer coating.

EIS Monitoring. Electrochemical impedance spectroscopy ("EIS") was used to characterize the performances of (i) the three sets of samples (Al 2024, Al 5052, and Al 6061) protected with the Mg-rich two-component binder (commercially available epoxy-polyamide) formulation and (ii) the one set of Al 2024 samples protected with the Mg-rich silane modified epoxy isocyanate hybrid binder (described in International Publication No. WO 2005/051551, which is hereby incorporated by reference) formulation. All samples showed low |Z| values after ~1000 hours of exposure and no corrosion after 3000 hours of exposure. The three substrates showed the same EIS behavior. However, the EIS data for the Al 2024 panel using the two-component binder sample ($|Z|\sim10^5$) differed from the EIS data for the Al 2024 panel using the silane modified epoxy isocyanate hybrid binder ($|Z|\sim10^8$).

Mg-rich primers using the two-component epoxy-polyamide binder were studied at different pigment volume concentrations ("PVC"). Al 2024 and Al 7075 substrate panels were coated with primers containing two different magnesium particle loadings (PVCs of 33% and 45%). The CPVC for the system was about 50%. The coated samples were tested by exposure in a B117 corrosion chamber for about 3000 hours, and, at various times, the exposed samples were visually characterized. For both the Al 2024 and Al 7075 panels, coatings with 45% PVC primer provided better protection than coatings with 33% PVC primer, which failed by blistering within the first 1000 hours.

Studies were carried out to investigate the effect of Mg particle size and shape on a Mg-rich primers ability to inhibit corrosion. The studies were conducted using magnesium flakes (<10 micron), magnesium powder of about 11 micron, magnesium granules of about 40 micron, and a mixture of magnesium granules (about 40 micron and about 60 micron), In was found that the magnesium granules of about 40 micron and the mixture of magnesium granules (about 40 micron and about 60 micron) provided the best corrosion protection, while the magnesium flakes and 11 micron powder did not protect as well, Interestingly, it was observed that, when magnesium flakes were used, 20% PVC samples outperformed 50% PVC samples.

Example 6

Development of Magnesium Alloy-Rich Primers for Aluminum Substrates

Magnesium alloy particles were used in magnesium-rich primer systems for the protection of aluminum substrates. Three different magnesium-alloy particles (AM60, AZ91B, and LNR91 were employed). Particle size and particle size distribution measurements for the three alloys were carried out using a Particle Sizing Systems Inc.'s Nicomp Particle Size Analyzer with acetone as the carrier. The mean, mode, and median of the particle size distribution experiments for each of the three alloys are set forth in Table A2.

TABLE A2

| | Mean (μm) | Mode (μm) | Median (μm) |
|---|---|---|---|
| AM60 | 63.00 | 63.46 | 60.12 |
| AZ91B | 58.96 | 74.61 | 55.45 |
| LNR91 | 56.21 | 87.72 | 49.78 |

Critical pigment volume concentration ("CPVC") for each of the three alloys was determined experimentally using the equation: $CPVC=[1+(((OA)(\rho))/93.5)]^{-1}$, where ρ is the density (sum of the percentage of Al times density of Al and the percentage of Mg times density of Mg) and where OA is the oil absorption (expressed grams of linseed oil/grams of pigment). OA was measured by adding linseed oil to a known weight of pigment until the point in which just enough oil is present to wet the surface of the pigment particles. The results for each of the three alloys are set forth in Table A3.

TABLE A3

| | AM60 | AZ91B | LNR91 |
|---|---|---|---|
| Composition | Al 5%, Mg 95% | Al 9%, Mg 91% | Al 50%, Mg 50% |
| Density (ρ) ($g/cm^3$) | 1.79 | 1.85 | 2.22 |
| OA (g/100 g of pigment | 43.76 | 47.04 | 25.94 |
| Theoretical CPVC | 54.41% | 51.79% | 61.88% |
| Experimental CPVC | between 31% and 34% | less than 36% | about 39% |

From the particle size experiments, it is seen that AM60 has a more uniform particle size than AZ91B and LNR91. However, the particle size in general is big, above 60 micrometers, and the particle size distribution of each pigment is fairly broad. SEM experiments showed that the shape of pigment powder is not very well controlled. This fact may be one of the reasons for the big difference between experimental and theoretical CPVC values for this type of system. When interpreting data from experiments carried out with these particles, one needs to bear in mind that the size and shape of the alloy particles were neither well-controlled not optimized.

Figure 32A:
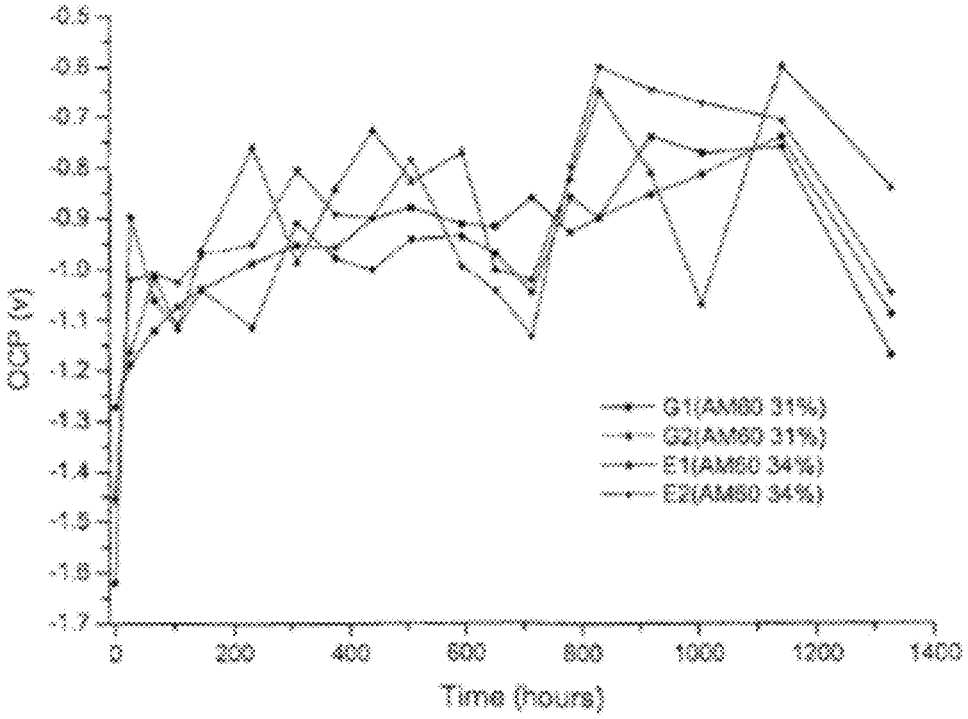
FIG. 32A PRIOR ART
FIGS. 32A, 32B, and 32C, disclosed in US 20090155598, are graphs showing the change in OCP as a function of immersion time, B117, for Mg-rich non-topcoated primers made with AM60, FIG. 32A, AZ91B, FIG. 32B, and LNR91, FIG. 32C, magnesium alloy particles in a two-component epoxy-polyamide binder.
Figure 32B:
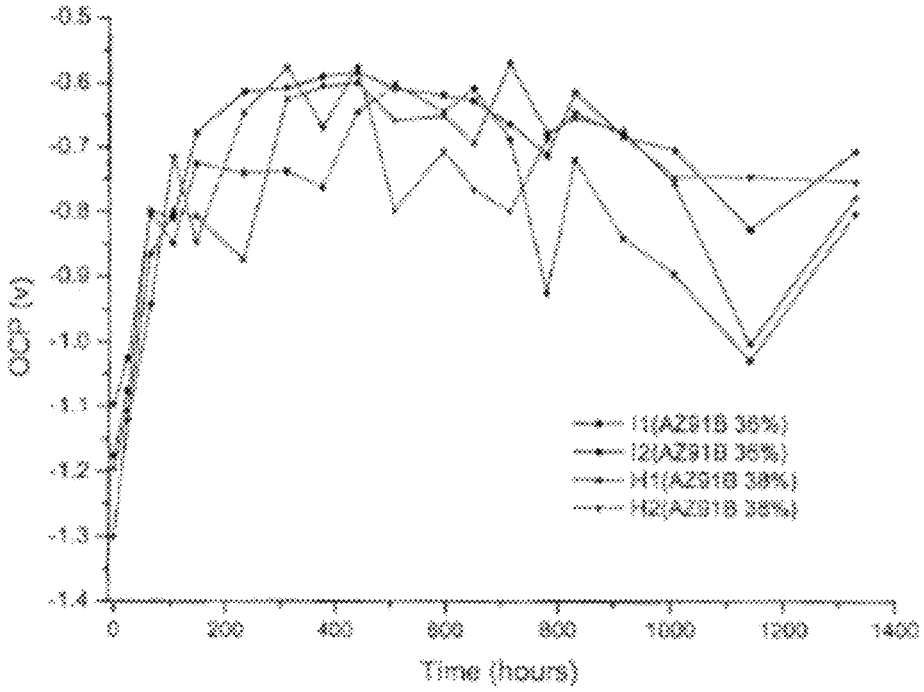
FIG. 32B PRIOR ART
Figure 32C:
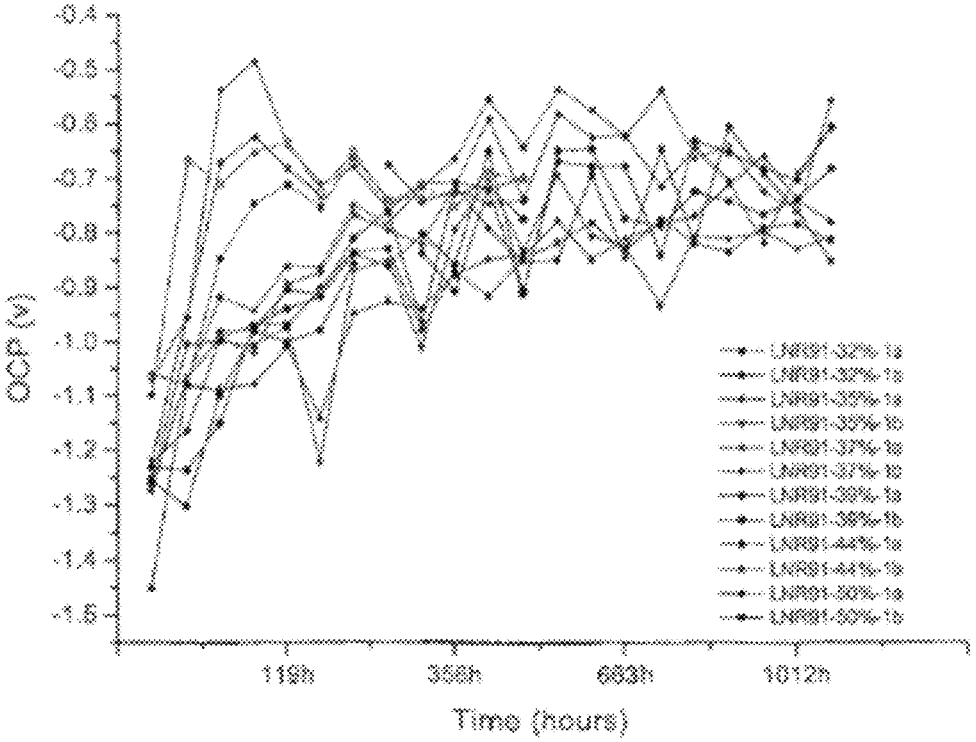
FIG. 32C PRIOR ART
Figure 32D:
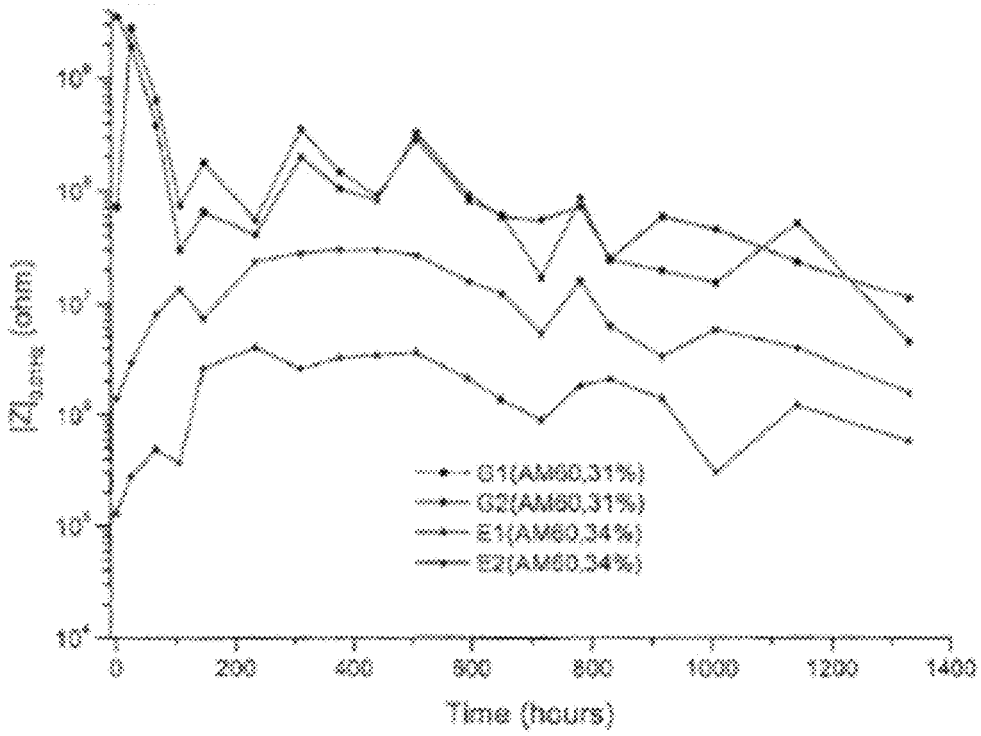
FIG. 32D PRIOR ART
FIGS. 32D, 32E, and 32F are graphs showing the modulus of electrochemical impedance at 0.01 Hz as a function of immersion time, B117, for AM60, AZ91B and LNR91 containing primers respectively, disclosed in US 20090155598.
Figure 32E:
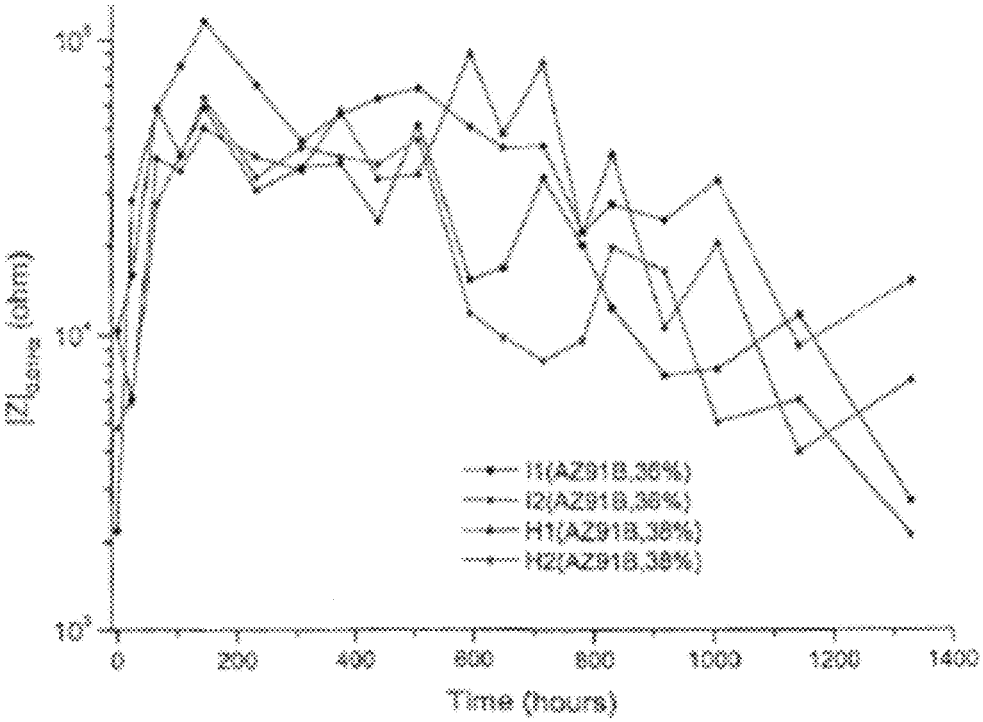
FIG. 32E PRIOR ART
Figure 32F:
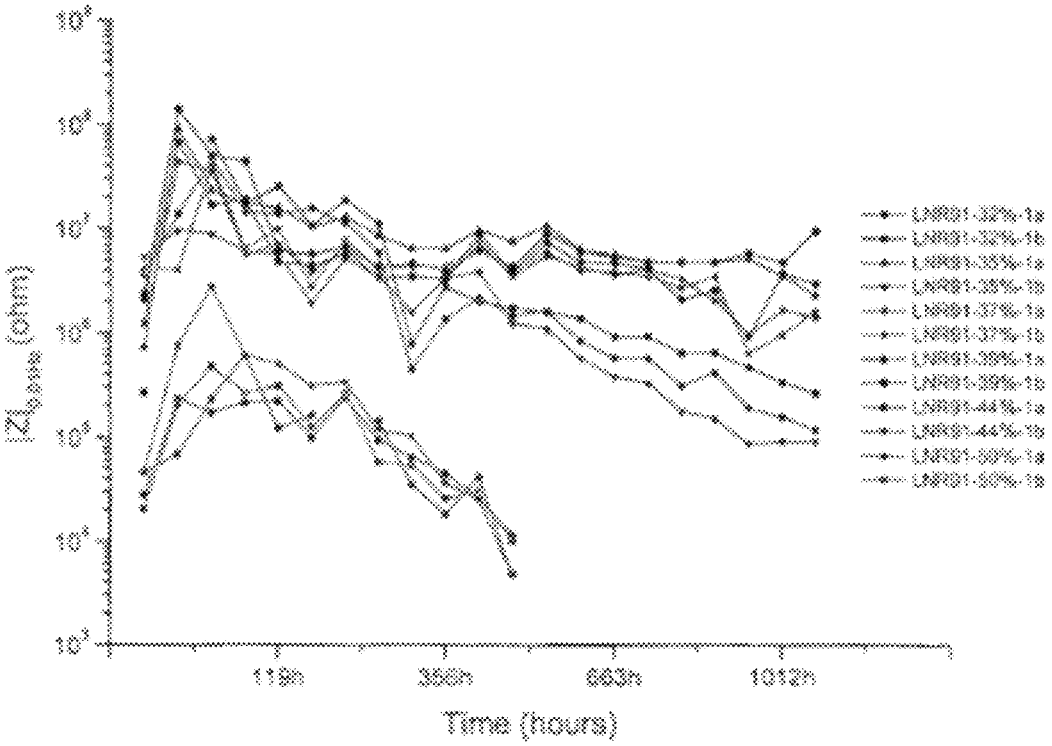
FIG. 32F PRIOR ART

FIGS. 32A, 32B, and 32C show the change in OCP during immersion time (B117) for the Mg-rich primers made with magnesium alloy particles having different aluminum content in a two-component epoxy-polyamide binder (Epon 828 and Ancamide 2453 in a weight ratio of 1.12:1). FIGS. 32D, 32E, and 32F show the modulus of electrochemical impedance at the lowest measured frequency (0.01 Hz) as a function of immersion time (B117) for these primers.

For the AM60 alloy, results from 4 samples are shown (two at 31% PVC and two at 34% PVC). For the AZ91B alloy, results from 4 samples are shown (two at 36% PVC and two at 38% PVC). For the LNR91 alloy, results from 12 samples are shown (two at 32% PVC, two at 35% PVC, two at 37% PVC, two at 39% PVC, two at 44% PVC, and two at 50% PVC). No topcoat was employed in these experiments.

Referring to the results from the OCP experiments (FIGS. 6A-6C), the potential is seen to be fluctuating around −1.0V, with a tendency to drift towards the value of bare aluminum. The fluctuation is thought to be influenced by the broad particle size. Narrowing the particle size distribution of the alloys should result in less OCP fluctuation, and may provide one way to optimize these. AM60 (FIG. 6A) shows a behavior similar to that of pure Mg, even if AM60 exhibits a high degree of fluctuation. Very interesting, but still not fully understood, are the values of OCP that seem to return at more negative levels, suggesting some degree of recovery of the system. This may be due to the presence of fresh granules, which remain protected from the corrosive environment, that become available to establish cathodic protection after many hours of immersion. As the aluminum content increases, the behavior changes slightly. Referring to FIG. 32B, AZ91B, the alloy with about 9% aluminum content, seems to follow the behavior of AM60 with lower signs of the recovery previously mentioned. Referring to FIG. 32C, LNR91/96, the alloy with 50% aluminum content, presents a constant drift from the mixed values (couple Mg—Al) towards the bare Al value, a sign that the amount of protection available is possibly limited.

Turning now to the results presented in FIGS. 32D-32F, it should be noted that the modulus of the electrochemical impedance at the lowest measured frequency is a useful parameter for monitoring the protection behavior of the Mg-rich primer. Referring to FIG. 32D, the behavior of the primer using AM60 as pigment is shown. As mentioned above, the primer was formulated at different PVCs, and the first thing worth mentioning is the different values of the |Z|. As expected, the samples with the higher alloy content present the lower value of |Z|. This may be the result of the lower polymeric content in the systems with higher alloy content, which may, in turn, result in a coating that is more porous and that does not provide high barrier properties. However, the high magnesium alloy load makes the formulas at high PVC the best candidates for providing long term protection via cathodic protection, especially in presence of a topcoat.

Figure 33A:
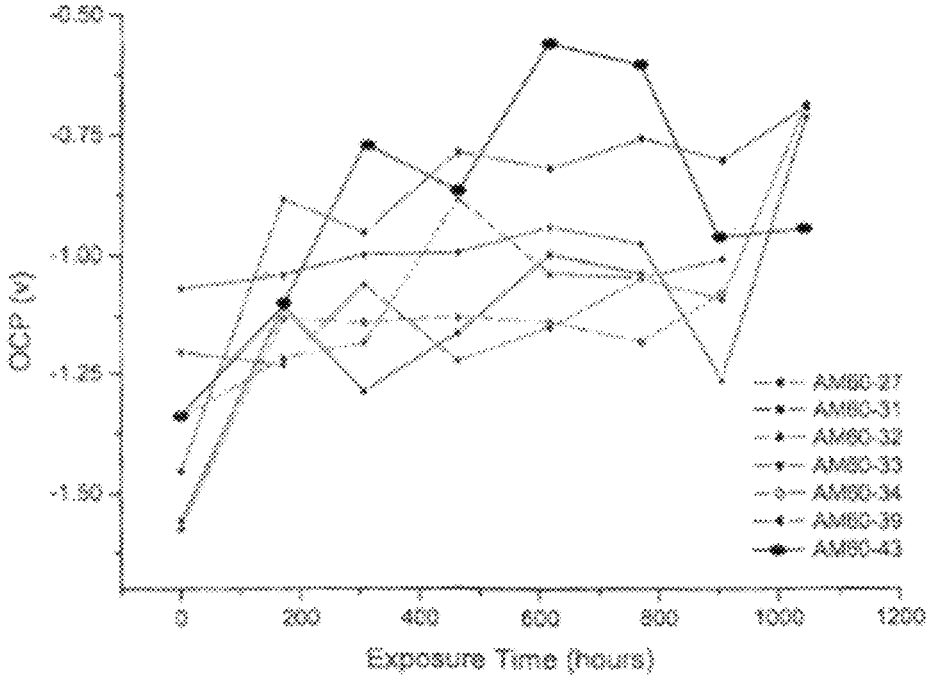
FIG. 33A PRIOR ART
FIGS. 33A and 33B are graphs showing the change in OCP as a function of immersion time (B117) for Mg-rich topcoated primers made with AM60 (FIG. 33A) and AZ91B (FIG. 33B) magnesium alloy particles in a two-component epoxy-polyamide binder.
Figure 33B:
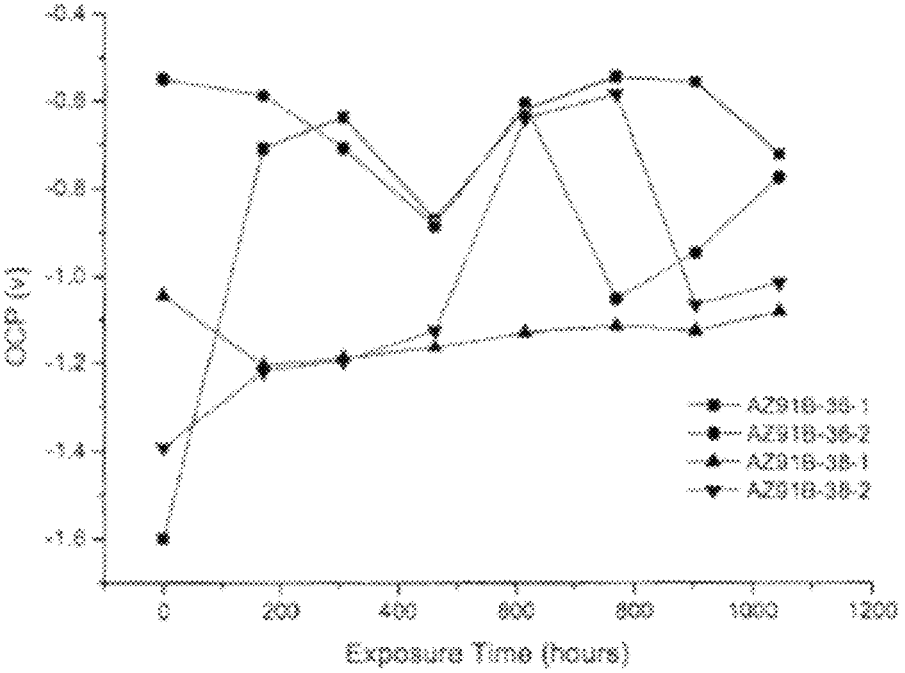
FIG. 33B PRIOR ART
Figure 33C:
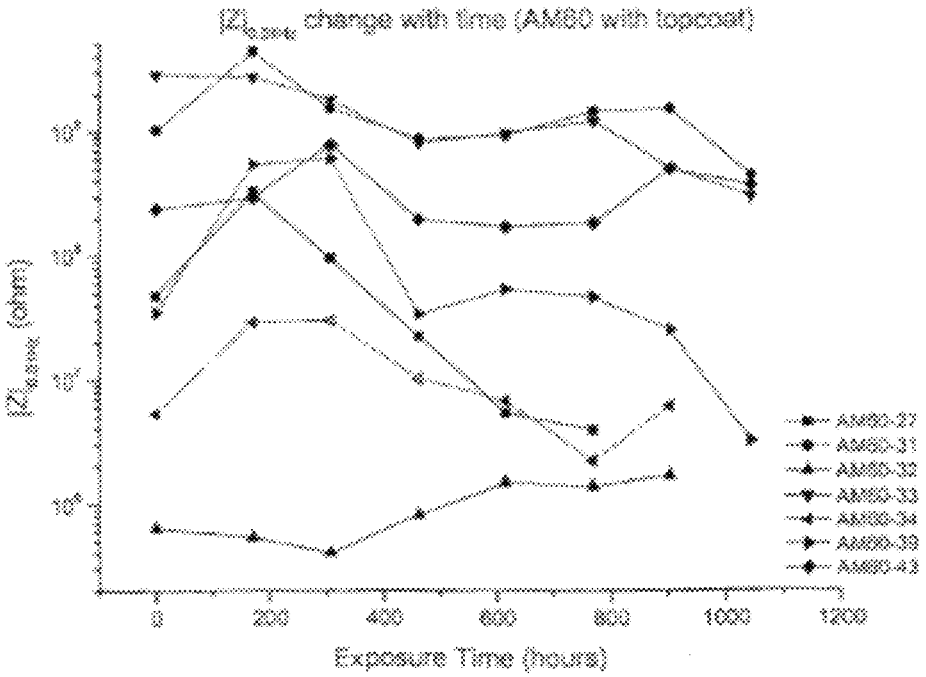
FIG. 33C PRIOR ART
FIG. 33C is a graph showing the modulus of electrochemical impedance at 0.01 Hz as a function of immersion time (B117) for the AM60-containing primer, disclosed in 20090155598.
Figure 34:
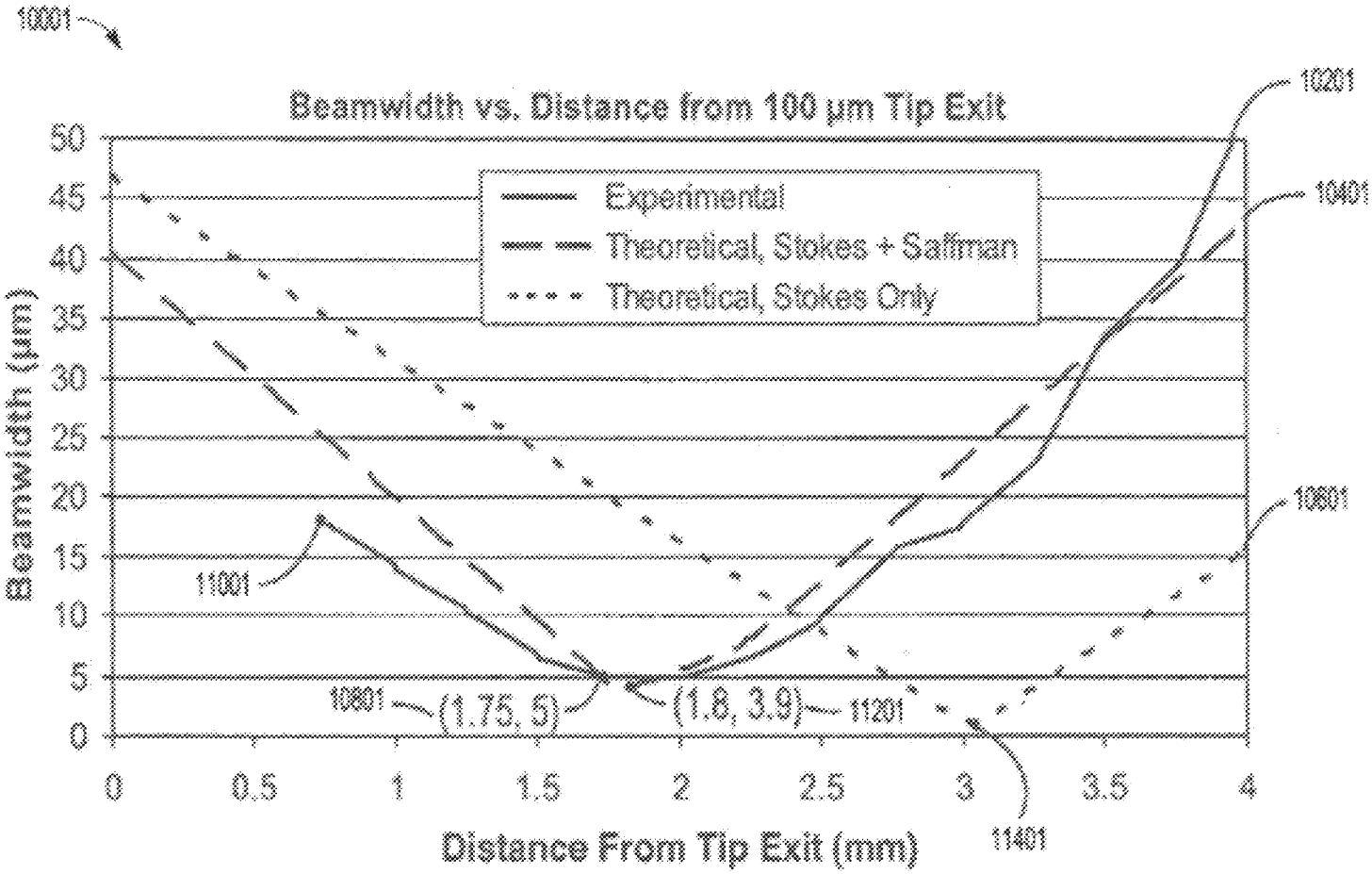
FIG. 34 PRIOR ART
FIG. 34 is a graph of beam widths versus distance from the 100-micron tip exit of: (a) experimental results with 0.6 microns particles diameter, 40 Standard Cubic Centimeters per Minute (SCCM0 total flow rate, 1600 kg/m(3) particle density; (b) theoretical model using drag forces only (Theoretical Stokes Only); and (c) a theoretical model using drag and lift forces, disclosed in US 20090053507.

As mentioned above, the above OCP and electrochemical impedance experiments were performed on samples that did not have a topcoat. The OCP and electrochemical impedance experiments were also performed with topcoated samples. FIGS. 7A and 7B show the change in OCP during immersion time (B117) for the Mg-rich primers made with AM60 and AZ91B particles in the two-component epoxy-polyamide binder. FIG. 33C shows the modulus of electrochemical impedance at the lowest measured frequency (0.01 Hz) as a function of immersion time (B117) for the AM60 primers. Topcoated LNR91 samples were not studied because the coarseness of the LNR91 powder yielded samples with a degree of roughness too high to be of relevance. For the AM60 alloy (FIGS. 33A and 33B), results from 7 samples are shown (one each of 27%, 31%, 32%, 33%, 34%, 39%, and 43% PVC). For the AZ91B alloy (FIG. 33C), results from 4 samples are shown (two at 36% PVC and two at 38% PVC).

Although the invention has been described in detail for the purpose of illustration, it is understood that such detail is solely for that purpose, and variations can be made therein by those skilled in the art without departing from the spirit and scope of the invention which is defined by the following claims.

A summary of the '507 patent is as follows:

The following terms are used herein and are thus defined to assist in understanding the description of the invention(s). Those having skill in the art will understand that these terms are not immutably defined and that that the terms should be interpreted using not only the following definitions but variations thereof as appropriate in the context of the invention(s).

Aerosol means a suspension of particles in a carrier fluid.

Carrier fluid means a generally nonreactive fluid suitable for suspending a flow of particles in an aerosol particle stream.

A convergent nozzle narrows down from a wider diameter to a smaller diameter in the direction of the flow. Convergent nozzles accelerate subsonic fluids. If the nozzle pressure ratio is sufficiently high the flow will reach sonic velocity at the narrowest point (i.e., the nozzle throat).

A divergent nozzle expands from a smaller diameter to a larger diameter in the direction of the flow. Divergent nozzles slow fluids if the flow is subsonic, but accelerate sonic or supersonic fluids.

Fluid means a substance that continually deforms (flows) under an applied shear stress regardless of how small the applied stress. All liquids and all gases are fluids. Fluids are a subset of the phases of matter and include liquids, gases, and plasmas. The term "fluid" is often erroneously used as being synonymous with "liquid".

Nanoparticles mean small objects that behave as individual units in terms of its transport and properties, and are sized between 1 and 100 nanometers, though the size limitation can be restricted to two dimensions (as in nanowires), or one dimension (as in nanocarpets).

Nanostructure means elements comprising: a single or multiwalled nanotube, nanowire, nanoropes comprising a plurality of nanowires, nanocrystals, nanohorns, nanocarpets; and constructs comprised of the foregoing elements and/or other nanoparticles.

Nozzle means a physical device or orifice designed to control the characteristics of a fluid flow as it exits (or enters) an enclosed chamber or pipe. A nozzle is often a pipe or tube of varying cross-sectional area that can be used to direct or modify the flow of a fluid. Nozzles are frequently used to control the rate of flow, speed, direction, mass, shape, and/or the pressure of the stream that emerges from them.

Sheath fluid means a generally nonreactive fluid generally surrounding the flow of aerosolized particles in a particle stream.

Spraying means a projecting a stream of particles in a carrier fluid as an aerosolized particle stream, which may be substantially collimated over a distance. The particles may be nanostructures or other atomic or molecular components, and may be comprised of a mixture comprising any of the foregoing. The carrier fluid carries the particles to be sprayed, which may be enclosed by a sheath fluid and focused into a substantially collimated particle stream (at least for a certain distance) with the help of the sheath fluid.

Throat means the narrowest part of a nozzle.

Introduction

It is known that when an aerosol expands through a converging nozzle, the particles may focus at a distance downstream from the nozzle. Focusing of aerosol results from inertial effects, where particles are accelerated through a converging nozzle, thus obtaining a radially convergent inward motion. This inward motion is somewhat retained downstream of the nozzle, even as the rapidly expanding propellant (or carrier) fluid diverges radially outward. This classic concept of aerodynamic focusing of aerosol beams is based on particle inertia and the Stokes force (which is drag of a particle in a fluid such as air or nitrogen gas) of interaction between particles and fluid flow. It is a correct approximation for the aerosol flow through the nozzle. However, for different geometries of the flow, the hydrodynamic fluid-particle interaction in the aerosol beam cannot be described by the Stokes force only.

In contrast, here, an invention is designed based upon utilizing the Saffman force acting on aerosol particles in gas flowing through a micro-capillary, which under proper conditions may cause migration of particles towards the center axis of the capillary. This approach is novel in contrast to the classical aerodynamic focusing method where only particle inertia and the Stokes force of gas-particle interaction are employed.

Near perfect collimation can theoretically be achieved with a long capillary of constant diameter. Such a long capillary could be used for collimating the aerosol particles; however, clogging of the long capillary would most likely result. To reduce nozzle clogging, the length of the portion of nozzle tip geometry at the smallest diameter needs to be reduced.

An arrangement of three nozzles in series allows for the length of the tip at its smallest diameter to be minimized. The particles flowing through such a set of nozzles will then become much more collimated, and in certain theoretical cases completely collimated.

Example 1

A thorough characterization of aerodynamic focusing was completed on a CoorsTek (formerly Gaiser Tool Inc., 4544 McGrath St. Ventura, Calif. 93003) aluminum oxide micro-capillary, 100 μm final diameter, part number 1551-40-750P-200 (1.5-F-20), under a flow rate of 30 SCCM carrier fluid, and 10 SCCM sheath fluid. Both the sheath and carrier gases were dry nitrogen. The beam width was determined at 0.25 mm intervals from the tip exit. A total of nine repetitions were carried out on different days to determine the deviation of beam width due to time variability. Data was taken via a Sony ExWave HAD CCD camera that is able to record 640×480-pixel pictures. The pictures were then transferred to MATLAB software where they were normalized. Beam width was measured using a minimum intensity at half max. Beam widths at ten different locations on the picture were determined, and the average of these ten locations was taken as the beam width.

The beam width vs. distance measurements were used as a comparison with the theoretical model. From the comparison, the physics of aerodynamic focusing was determined.

Refer now to FIG. 4, which is a graph 10001 of the beam width produced experimentally and theoretically as a function of distance in this Example 1. Here, the tip is 100 μm in diameter, with a 40 SCCM total flow rate. By using the graphed experimental data 10201 it may be inferred that the particle diameter is 0.6 μm with a 1600 kg/m$^3$ particle density. The experimental width uses half max data, and the theoretical width is determined with: 1) Saffman (fluid induced lift) and Stokes (fluid induced drag) forces applied 10401; and 2) only Stokes (fluid induced drag) force applied 10601.

It can be seen from the experimental data 10201 that a focal distance appears at approximately 1.75 mm from the tip exit with a beam width of about 5 μm 10801. Measured data closer than 0.75 mm from the tip exit could not be analyzed due to light reflections from the tip 11001. The theoretical model fit best for both cases when the particle size was 0.6 μm, and the density of the particles was 1600 kg/m$^3$.

A theoretical model using both the Saffman and Stokes forces 10401 most closely resembled the experimental data 10201 with an $r^2$ value of 0.93, where the apparent trend of focusing is very similar. Maximum focusing occurs at about 1.8 mm past the tip with a beam width of 3.9 μm 11201.

The theoretical model using only Stokes force 10601 does not correlate well to the experimental data 10201 with an $r^2$ value of 0.05. In the Stokes force model 10601, the beam focus is at 3 mm past the tip with a beam width of 0.9 μm 11401. The focal distance of the aerosol beam is increased without considering the Saffman force because forces acting tangential to the axis of the tip on the aerosol particles are reduced without Saffman force. With Stokes forces only, focusing occurs due to the geometry of the tip, which in this case would allow for the focal point to be no closer than 2.8 mm from the end of the tip. The focal distance could be greater, depending on the lag of the aerosol particles following the streamlines.

Saffman forces are indeed acting on the aerosol particles in this flow situation to obtain the current focusing, as may be concluded by the comparisons of: 1) the measured data 10201, 2) the plot of the Saffman (fluid induced lift) and Stokes (fluid induced drag) forces applied 10401; and 3) the plot of only the Stokes (fluid induced drag) force applied 10601.

Figure 35:
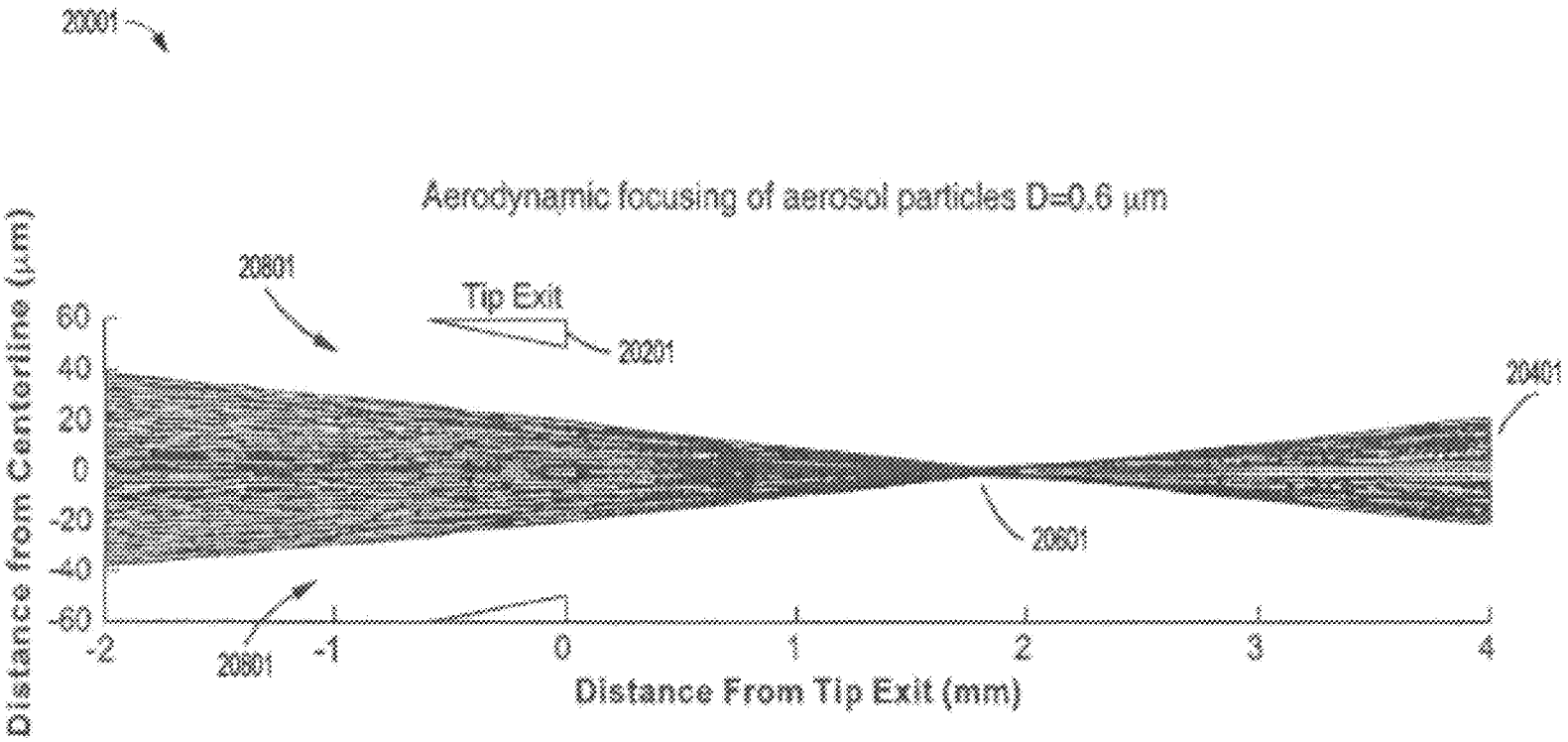
FIG. 35 PRIOR ART
FIG. 35 is a cross-sectional view of test setup for testing the particles beam flow of aerosol particles leaving a 100-micron tip exit, at 40 SCCM total flow, and 1600 kg/m(3) particle density. Focusing of the particle beam is observed as disclosed in US 20090053507.

Refer now to FIG. 35, which is a cross section 20001 of the theoretical trajectories of the aerosol particles across the axis of rotation based on the inclusion of both the Saffman and Stokes forces. Here, the convergent nozzle tip 20201 produces aerodynamic focusing of the particle beam 20401 producing a minimal beam throat 20601 at a distance of about 1.75 mm from the end of the convergent nozzle tip 20201.

The particle beam 20401 is comprised of a carrier fluid, which is typically, but not exclusively nitrogen. The particle beam 20401 is further geometrically shaped by the action of a sheath fluid 20801, also typically, but not exclusively nitrogen. Characteristics of both the sheath and carrier fluids are that they tend not to be chemically reactive with either the particles in the particle beam 20401, or the intended substrate target.

To further improve the tip design to produce less overspray and thinner deposited lines, two main characteristics of the aerosol particulate flow must be improved: beam width, and beam collimation.

The first potential improvement is the beam width, which has a direct relationship with the deposited line width. The beam width can be minimized by improving the focus of the beam. If focusing is used, there will be a single stand-off distance at which the smallest line widths may be obtained, but only if the aerosol particles are monodisperse, that is, having very nearly the same particle size. Otherwise focusing will be greatly reduced, and line widths will inversely be increased.

The second potential improvement is the collimation of the beam. Beam collimation reduces overspray, and decreases the dependence of the deposited line width on the tip-to-substrate or stand-off distance. Overspray is reduced because aerosol particles are now moving together in a straight line.

When the tip is designed to focus the aerosol particles, aerosol particles of different size will focus at different focal points. Focusing is most effective with monodisperse particles, but it is generally difficult to achieve perfectly monodisperse particles.

Figure 36:
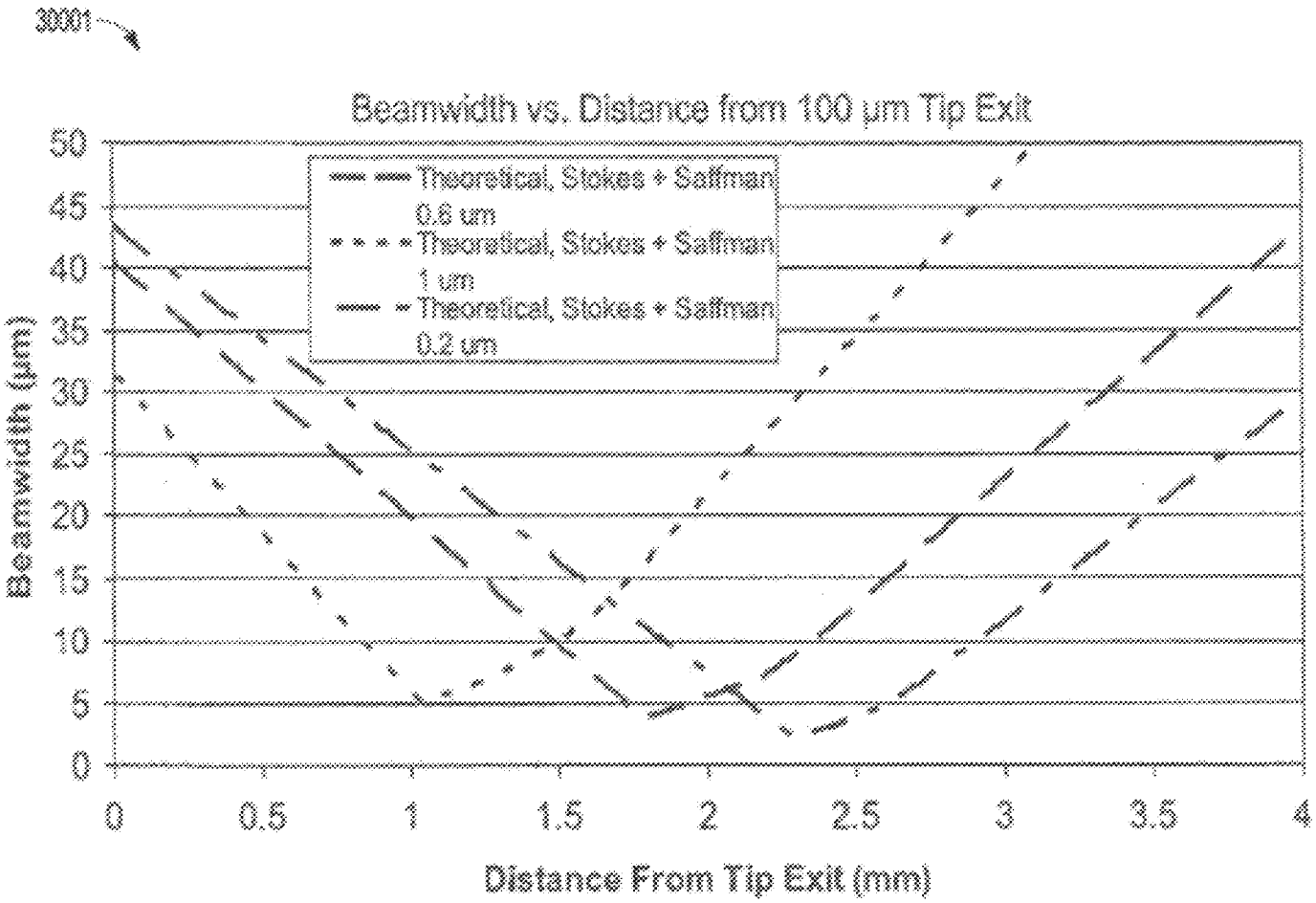
FIG. 36 PRIOR ART
FIG. 36 is a graph of theoretical beamwidth versus distance from 100-micron top exit for particle diameters of 0.2 microns, 0.6 microns, and 1 micron disclosed in US 20090053507.

Refer now to FIG. 36, which models the effect of particle size on focusing distance. Here, theoretical models of particles using both the Saffman and Stokes forces are modeled for particle sizes of: 0.2, 0.6, and 1.0 μm. Notice that if a beam were to have all three particle sizes that the beam width would be much wider than each individual particle size. Also, the range of distance that the particles are focused is much less, with a maximum focusing occurring at approximately 1.7 mm from the tip exit.

Near perfect collimation can be achieved with a long capillary of constant diameter. This can be used for collimating the aerosol particles, but clogging of the long capillary would likely result. To reduce clogging, the length that the tip geometry at its smallest diameter needs to be reduced, thereby reducing the length having a higher probability of clogging. The length where the tip has its smallest diameter may be minimized by arranging three nozzles in series. The particles will then become much more collimated, and in certain theoretical cases may become completely collimated.

Figure 37:
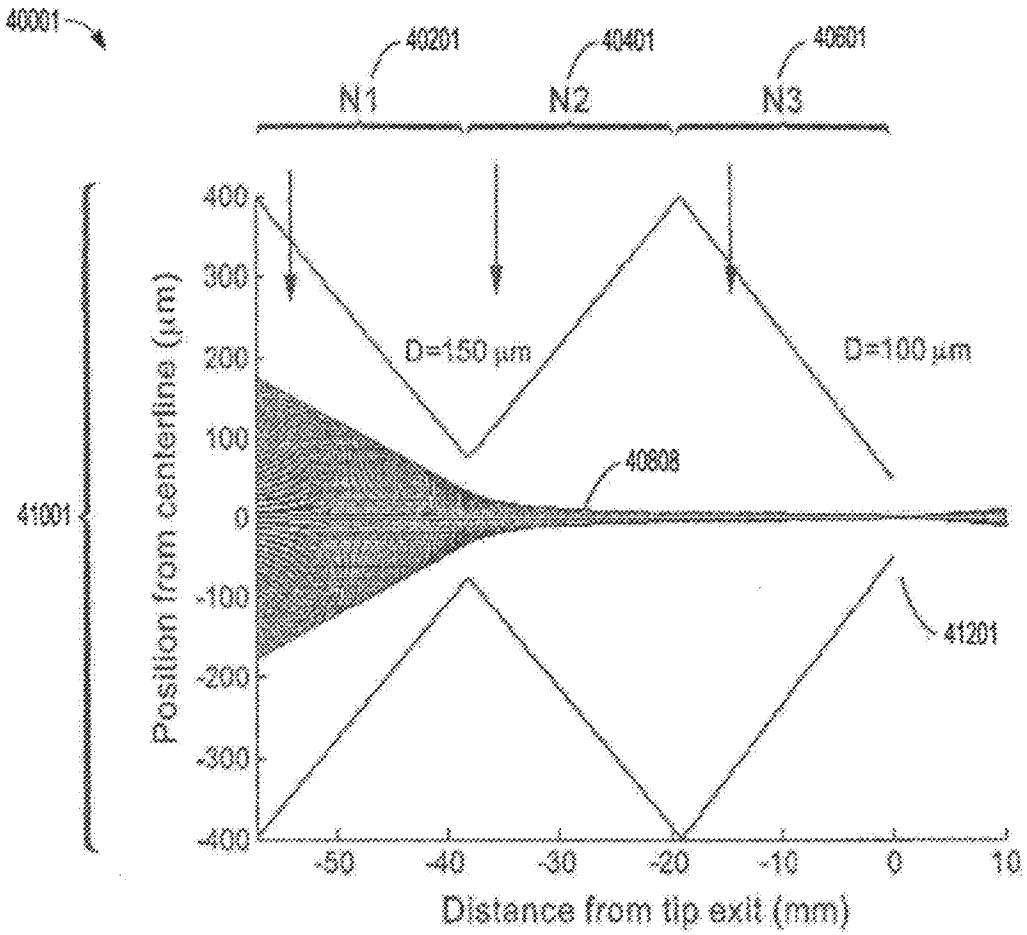
FIG. 37 PRIOR ART
FIG. 37 is a cross-section view of a Convergent-Divergent-Convergent (CDC) nozzle comprising three coaxially juxtaposed nozzles, showing the nozzle profiles and trajectories of the aerosol particles comprising the particle beam disclosed in US 20090053507.

Refer now to FIG. 37, which shows the geometry of a Convergent-Divergent-Convergent (CDC) system comprising 3 nozzle stages in series 40001. Here, there is a first nozzle 40201 (N1), a second nozzle 40401 (N2), and a third nozzle 40601 (N3). Notice that by the time the particle beam 40808 reaches the third nozzle 40601 (N3) it is already focused to about 6% of the total diameter 41001 (800-μm diameter, at the entrance the first nozzle 40201 (Ni). The third nozzle 40601 (N3) does not appear to focus the particles, but mainly serves to accelerate the particle beam 40801. The third nozzle 40601 (N3) may not be necessary if the nozzle is spraying into a substantially low vacuum (e.g., 100 milliTorr or less) ambient pressure. If the particles that comprise the particle beam 40801 were not accelerated with the third nozzle 40601 (N3), they would exit at a velocity on the order of 1 m/s. With such a low velocity, the particles would be subject to airflows outside the two-nozzle system (the third nozzle 40601 (N3) missing in this instance), and possibly deflected prior to reaching an intended substrate at the proper location. With high velocities (on the order of 100 m/s) the particles will eject out of the tip exit 41201 of the third nozzle 40601 (N3) with their trajectories likely being much less affected by the ambient atmospheric pressure or bulk fluid movement.

Although not detailed here, the three nozzles may be constructed monolithically, or may be separately constructed and joined together to form the CDC nozzle. Alternatively, the nozzles may be constructed of shaped ceramic, and joined together with a plastic coupling.

Figure 38:
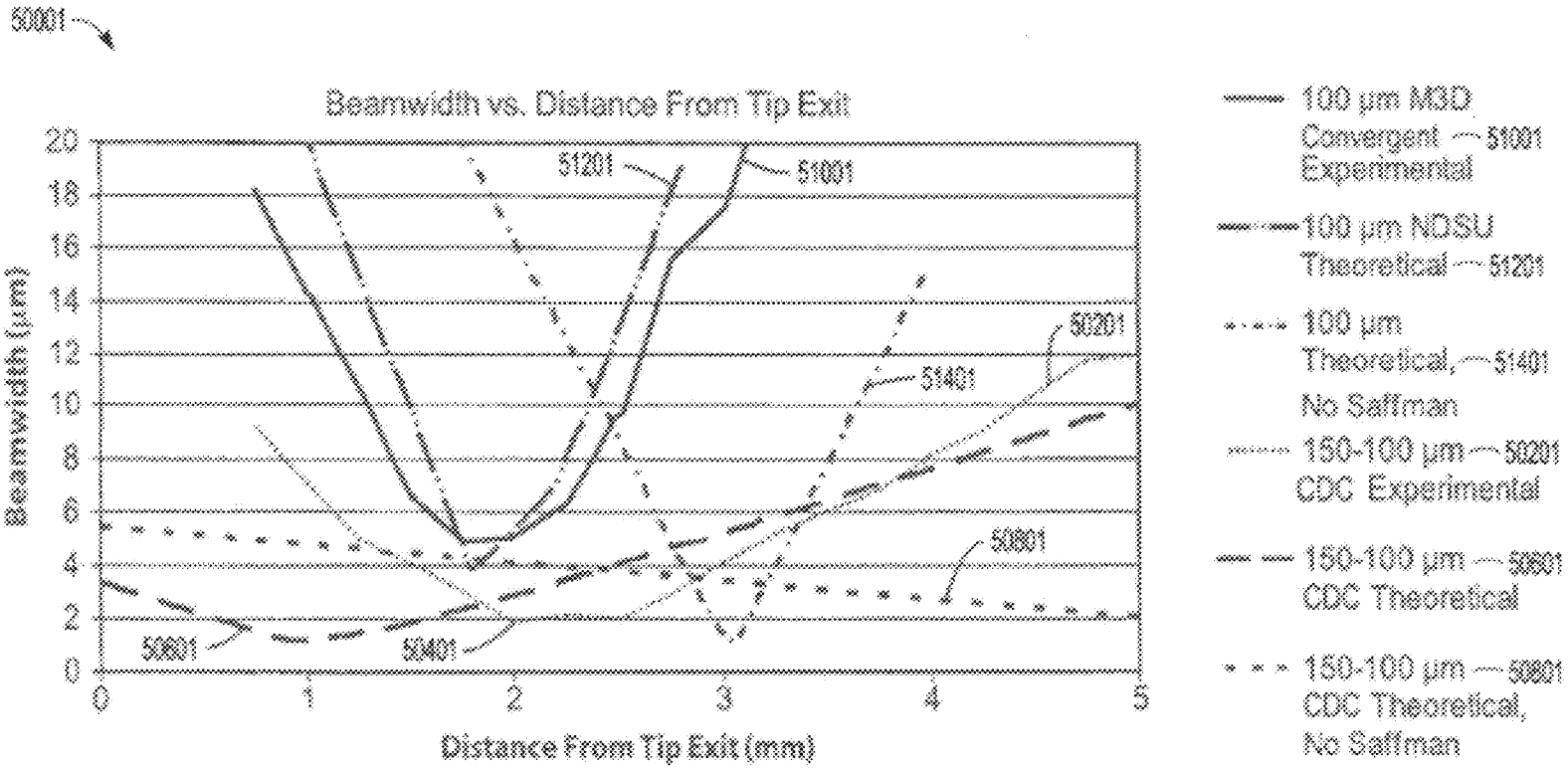
FIG. 38 PRIOR ART
FIG. 38 is a graph of beam widths versus distances from the tip exit for the CDC nozzle with 150-μm and 100-μm nozzle throats, and the 100-μm M3D nozzle, plotted with experimental results, as well as theoretical results with Saffman and Stokes forces, and with just the Stokes force modeled. It should be noted that the 100-μm M3D nozzle curves were previously presented in FIG. 2, and are incorporated here for comparison purposes only disclosed in US 20090053507.

Refer now to FIG. 38, which is an experimental and analytical analysis graph 50001 of the performance of the Convergent-Divergent-Convergent (CDC) nozzle 40001 of FIG. 37.

The particle flow beam width leaving the new nozzle design 40001 of FIG. 37 was also analyzed and compared to the old nozzle tip 20201 design of FIG. 35. It appears in FIG. 38 that the beam width of the new CDC nozzle 40001 of FIG. 37 is thinner and more collimated than the old nozzle tip 20202 design of FIG. 35.

Still referring to FIG. 38, the beam width remains small even to 5 mm past the tip where it has a width of only 12 Gm. A CDC nozzle with a 150-μm diameter at the second nozzle 40401 minimum diameter (or throat) of FIG. 37, and 100-μm diameter at the third nozzle 40601 throat is referred to as a 150-100-μm nozzle. With the 150-100-μm nozzle, the beam width appears 50401 to be about 1.9 μm at about 2 mm past the tip exit.

When the 150-100-μm nozzle experimental results 50201 are compared to the theoretical curves for both Saffman forces and Stokes forces 50601, and Stokes only forces 50801, it can be seen that again the curve for Saffman+ Stokes forces 50601 most closely matches the experimental curve 50201, however the variance $r^2$ value is only 0.44.

Similarly, the convergent single nozzle 20201 results of FIG. 35 were previously shown in FIG. 3, and have been rescaled to fit the scales of FIG. 38 to allow for a comparison between the performances of both the convergent single nozzle 20201 and the CDC nozzle 40001 of FIG. 37. On FIG. 38, these rescaled plots are shown as the 100 μm Convergent Experimental 51001 plot, the 100 μm Saffman+ Stokes Theoretical 51201 plot, and the 100 μm Stokes-only Theoretical 51401 plot. As these various plots have already been described previously regarding FIG. 3, they will not be reconsidered here.

One possible reason for the deviation between the experimental 50201 curve and theoretical values with the Saffman force 50601 is because the 3-nozzle tip is only a prototype. The fluid connection between each of the three nozzles may not be perfect, and the centerlines of the nozzles may not be in perfect alignment. Additionally, the diameters may not be axisymmetric. Improvements in tip geometry and construction would likely improve the correlation between the theoretical 50601 and experimental 50201 results. Additionally, the theoretical model could be re-analyzed to determine if the rate of change of the nozzle diameter might affect the assumed Poiseuillian profile.

The collimation of the beam width should be advantageous for depositions in which the vertical thickness of the deposition at a specific distance across the width changes significantly. To test the performance of the CDC nozzle 40001 of FIG. 37 compared to the single-nozzle convergent tip 20201 of FIG. 5 over a varying stand-off distance, an experiment was devised where a line was to be written over a 1 mm step moving from a standoff distance of 2 mm to 3 mm or vice versa.

Figure 39:
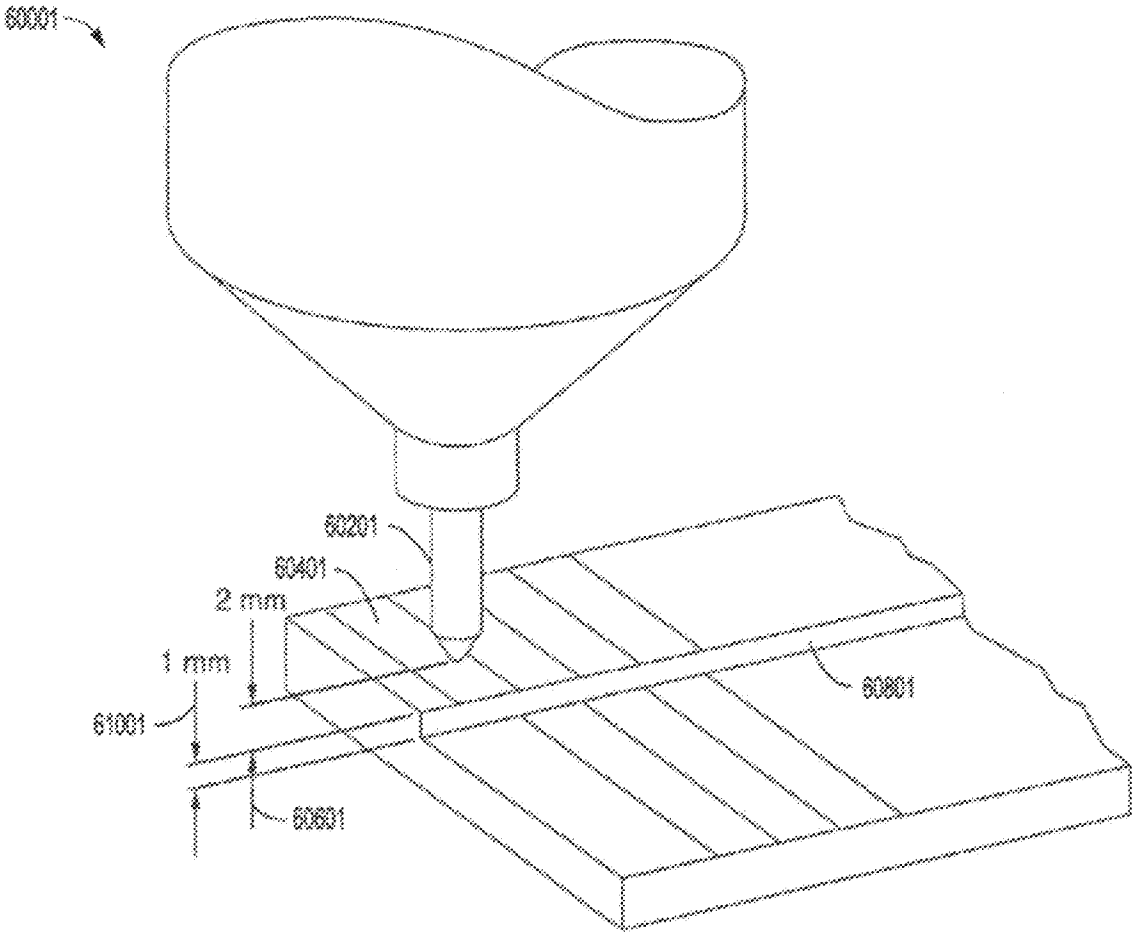
FIG. 39 PRIOR ART
FIG. 39 is a perspective view of an experimental substrate with a 1 mm vertical surface step, prepared for direct write fabrication of lines deposited on the substrate with a test nozzle in place disclosed in US 20090053507.

Refer now to FIG. 39, which is a perspective view of the geometry of the 1 mm step writing experiment 60001. The initial stand-off height from the CDC nozzle 60201 to the substrate 60401 was 2 mm 60601, and when the CDC nozzle 60201 tip passed the 1 mm vertical 60801 step 61001, the stand-off distance increased to 3 mm.

From the experimental results shown for the single nozzle 51001 and CDC nozzle 50201 of FIG. 38, it should be apparent that the beam width greatly increases for the single-nozzle design, while beam width remains nearly constant for the CDC design. The increase in beam width should result in an increased line width as a fixed beam passes over a substrate with increasing surface distance. In this instance, as the initial nozzle to substrate distance increases from 2 mm to 3 mm, increases in line width should result.

Figure 40:
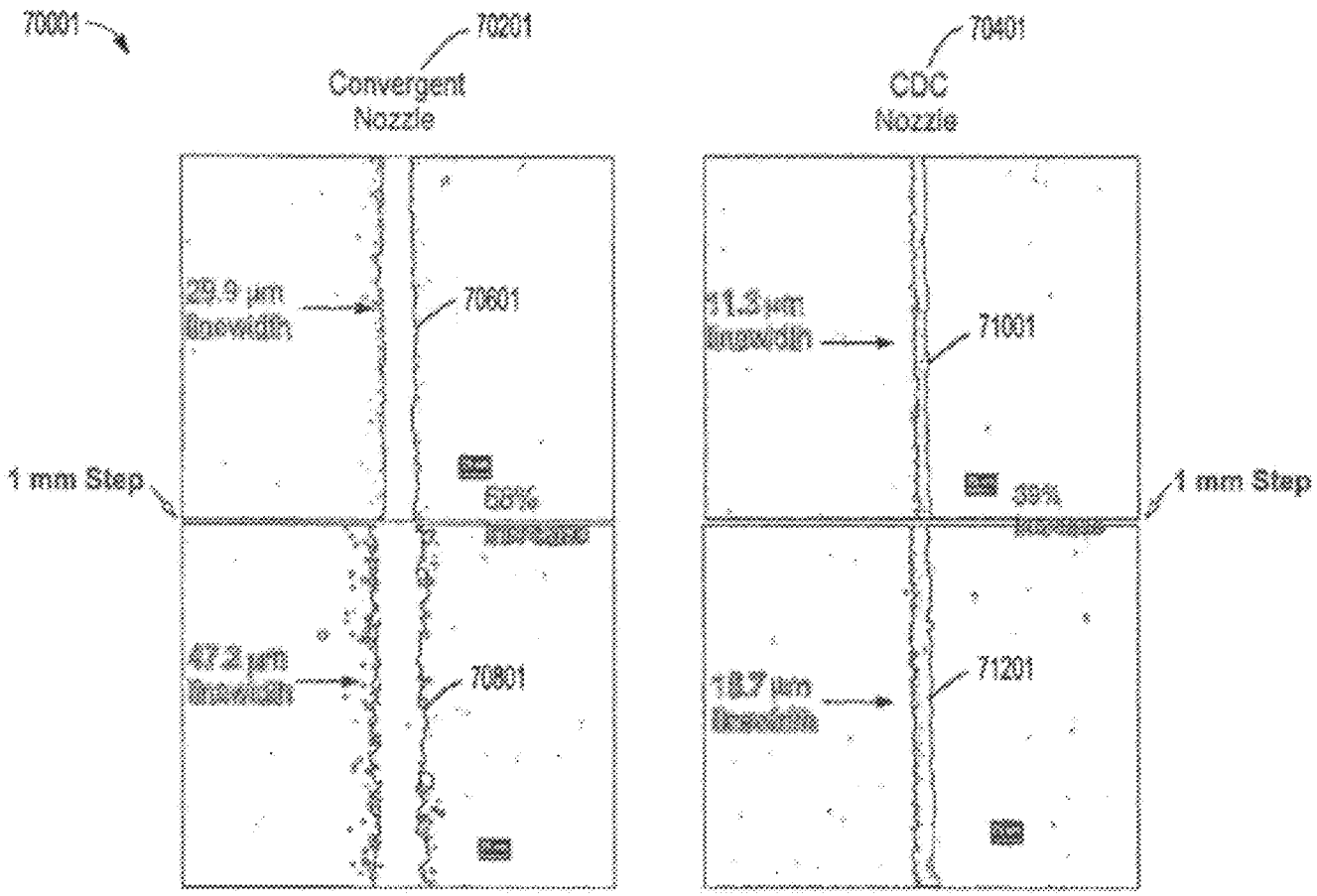
FIG. 40 PRIOR ART
FIG. 40 is a photomicrograph showing the lines written by the 100-μm M3D nozzle of FIG. 2 and the CDC nozzle of FIG. 4, as both nozzles pass over the substrate with the 1 mm surface step of FIG. 6 disclosed in US 20090053507.

Refer now to FIG. 40, where the results of the deposited lines from the test geometry of FIG. 39 may be seen 70001. Both the convergent nozzle 70201 and the CDC nozzle 70401 used a 100-μm diameter as the final nozzle orifices, and the CDC design used a 150-μm diameter for convergent constriction between the first and second nozzles. These nozzles correspond to those previously discussed as the convergent nozzle 20201 of FIG. 2, and the CDC nozzle 40001 of FIG. 37.

Harima ink product code NPS-J (from Harima Chemicals, 4-4-7 Imabashi, Chuo-ku, Osaka 541-0042 Japan), with 50 nm silver particle size (57-62 wt. %) in n-tetradecane solvent (27-34 wt. %) and proprietary dispersant molecules (8-12 wt. %) was used with 25 SCCM of carrier fluid, sheath fluid flow of 15 SCCM, and a substrate stage velocity of 30 mm/s. The resulting precursor lines were measured both before (unsintered) and after subsequent processing. Both the carrier fluid and the sheath fluid were dry nitrogen.

The convergent nozzle 70201 created precursor lines 29.9-μm wide 70601 at a stand-off distance of 2 mm. When the stand-off distance was increased to 3 mm, line width 708 increased to 47.2 μm, a 58% increase in line width.

The CDC nozzle 70401 produced precursor lines 11.3-μm wide 71001 at a stand-off distance of 2 mm, and 15.7-μm wide lines 712 at a stand-off distance of 3 mm. The CDC nozzle 70401 design had a line width increase of only 39% despite a 1-mm jump in CDC nozzle-to-substrate distance.

The results after subsequent processing of the precursor Harima ink are even more promising: the convergent nozzle 70201 had line widths of 23.8 μm and 42.8 μm for a stand-off distance of 2 mm and 3 mm respectively. The convergent nozzle line width therefore increased by 80%. The CDC nozzle 70401, by comparison, achieved line widths of 10.7 μm and 13.6 μm for stand-off distances of 2 mm and 3 mm respectively. The CDC nozzle 70401 achieved a line width increase of only 27%.

Experimental results of the deposited line width comparison experiment of FIG. 40 confirm that the CDC nozzle is indeed more collimated and has a thinner resulting line width than the single convergent nozzle. The lines produced by the CDC nozzle 70401 were approximately 60% thinner than those produced by the convergent nozzle 70201. Also, the change in line width over the 1 mm step detailed in FIG. 6 was up to 53% less for the 3-nozzle tip vs. the single-nozzle tip. Additional improvements to the design of the CDC nozzle could be accomplished once the aerosol particle size distribution, particle density, and particle velocity field exiting the tip are characterized. Also, the ability to design CDC nozzles with varying geometry would be greatly beneficial.

Example 2

Refer now to FIGS. 41-45, which show the results of steps taken to improve line widths and qualities.

Figure 41:
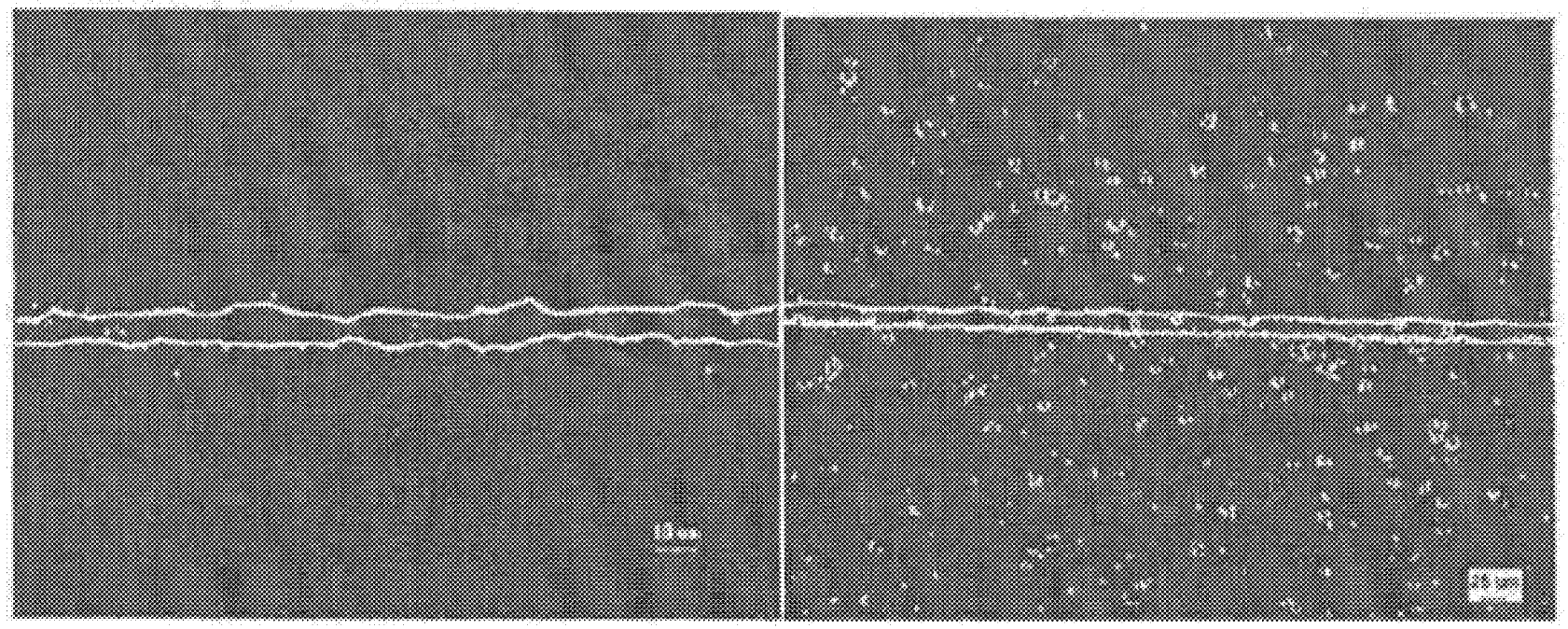
FIG. 41 PRIOR ART
FIG. 41 is a photomicrograph of an 8.7-μm-wide line written by the CDC nozzle with 25 SCCM carrier gas, 15 SCCM of sheath gas, with a stage translation velocity of 30 mm/s (left frame), and the same nozzle with 20 SCCM of carrier gas, 25 SCCM of sheath gas, and a roughly 25-μm-wide line written with 5 mm/s stage translational velocity (right frame) disclosed in US 20090053507.

Refer now to FIG. 41. Improved deposited line-widths were achieved by using the CDC nozzle design with modified gas flow rates, which resulted in lines as thin as 8 μm in the left frame. The lines were created with 15 SCCM carrier fluid, 25 SCCM sheath fluid, a substrate translational speed of 10 mm/s, using Nano-Size silver nano-particle ink. The conductor precursor ink used was produced by Nano-Size LTD. (Migdal Ha'Emek, Israel) is a solid-in-liquid dispersion with 30-50 wt. % silver particles (with 50 nm diameters) in a solvent mixture of water and ethylene glycol with up to 3 wt. % dispersants. An example of a line produced by the new nozzle can be seen in FIG. 8. The edge definition in this case is not optimized given the irregular wetting of the ink with the surface as shown in the left frame of FIG. 8. Lines of 25 μm can also be created where the overspray is markedly reduced as seen in the right frame of FIG. 41.

Figure 42:
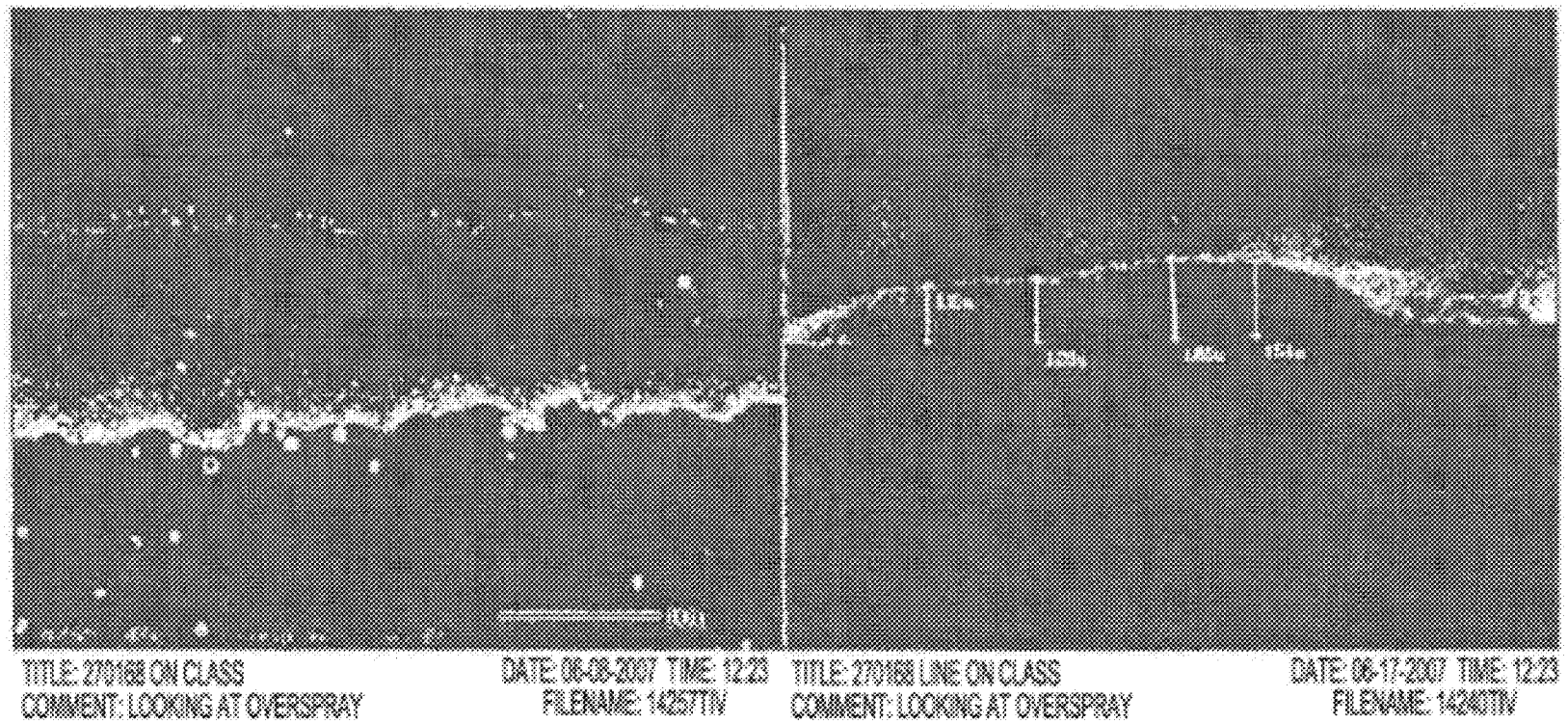
FIG. 42 PRIOR ART
FIG. 42 is an angled overhead Scanning Electron Micrograph (SEM) view of a line written by the CDC nozzle of FIG. 4 on glass with 10 SCCM carrier gas, a total of 20 SCCM sheath gas (10 SCCM was introduced first into the carrier gas stream), and a stage translation speed of 5 mm/s. The line width is about 11 μm (on left panel), and a cross section of the same line (on right panel) shows line heights of 1.15, 1.28, 1.65, and 1.54 μm respectively, measured left to right disclosed in US 20090053507.

Refer now to FIG. 42, where increased magnification SEM images visualize the lines shown in FIG. 8. The left frame shows a small degree of overspray and a degree of irregular border to the line. The right frame shows a cross section of the line, which reveals that the line is between about 1 μm and 1.65 μm in thickness, and about 11-μm wide. The measured locations on the cross section are about 1.15, 1.28, 1.65, and 1.54 μm thick respectively, left to right. Note that these lines in the SEM pictures were drawn on glass and have not been subsequently processed.

Figure 43:
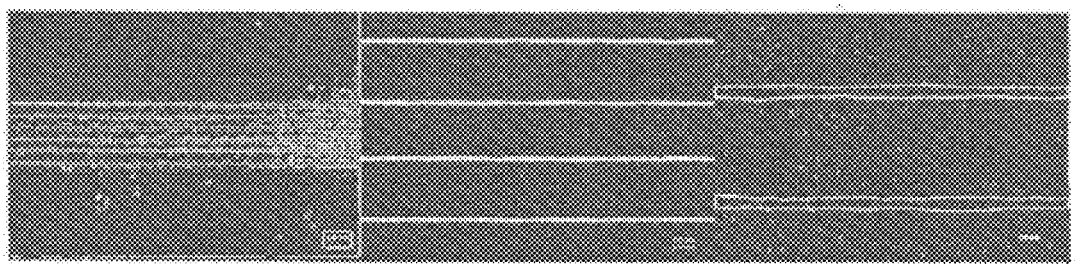
FIG. 43 PRIOR ART
FIG. 43 is an overhead photomicrographic view of lines from FIG. 9 that were written onto double sided tape, with three magnifications increasing from the left to right views. The flow rates used here were 20 SCCM for the sheath gas, and 10 SCCM for the carrier gas. Line widths appear here to be approximately 3.7 μm disclosed in US 20090053507.

Refer now to FIG. 43, where the lines shown in the SEM micrographs above were also written on double-sided tape (e.g., soft polymer or polymer/polyimide material). It was noted that the lines were visibly smaller than lines written on glass. Optical photomicrographs can be seen in the left frame FIG. 43, and increase in magnification from the left to right frames. It was determined that the line widths of the lines in view were approximately 3.7 μm.

Figure 44:
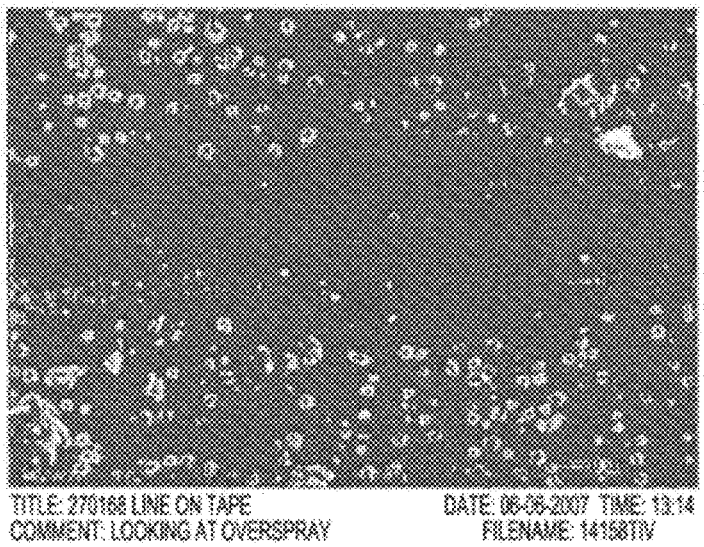
FIG. 44 PRIOR ART
FIG. 44 is a SEM image of a line printed in a fashion similar to that of FIG. 10 with a line width of approximately 5.3 μm, where significant overspray was observed disclosed in US 20090053507.

Refer now to FIG. 44, which is a SEM image of one of the lines of FIG. 43. In the SEM image, the line width appears slightly larger than those shown in FIG. 43, with a width of approximately 5.3 μm. Notice that the edge is also more difficult to distinguish due to substantial overspray.

Figure 45:
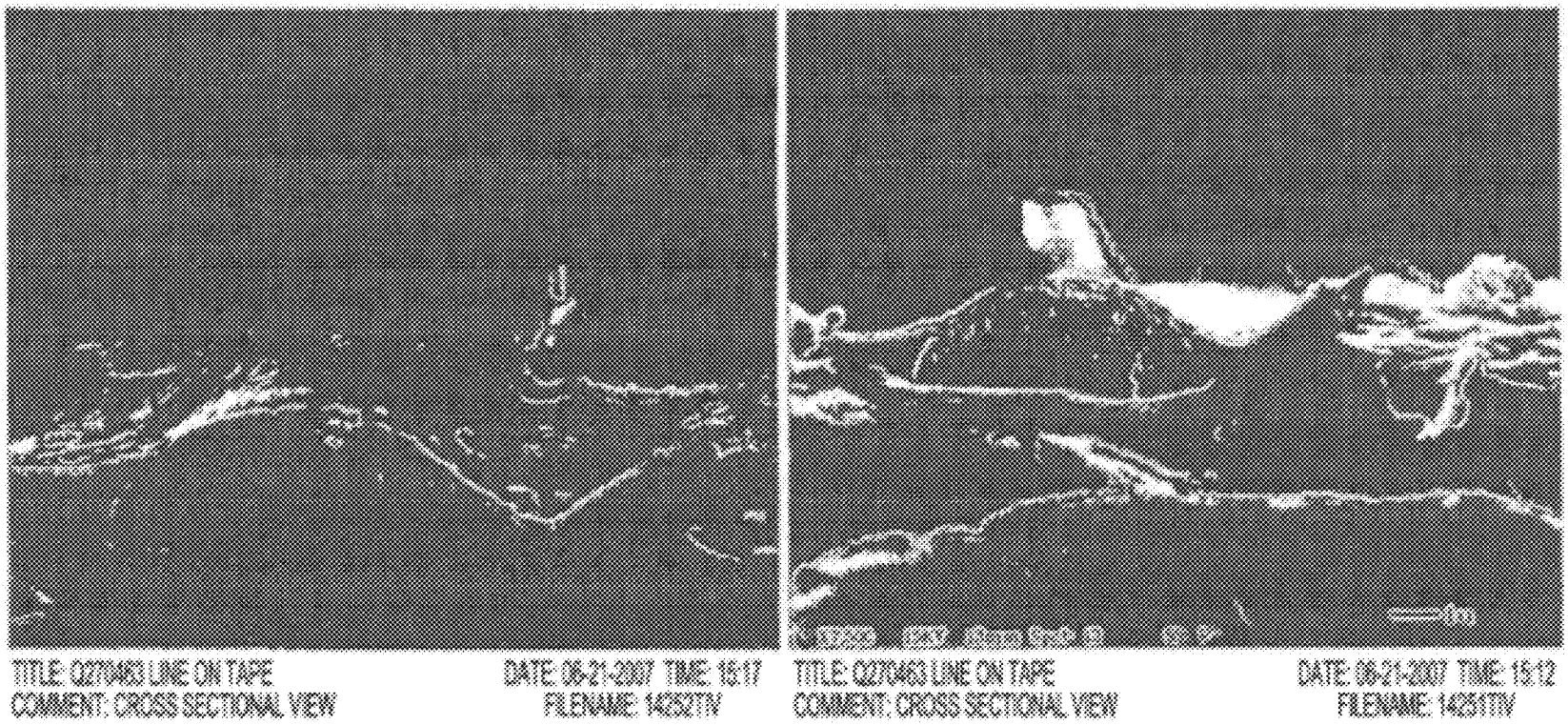
FIG. 45 PRIOR ART
FIG. 45 is a SEM image of cross sections of one of the lines of FIG. 10 written on double-sided tape, with an approximate width of 6.2 μm, where it appears that the line has formed a trench within the substrate through a particle-substrate interaction disclosed in US 20090053507

Refer now to FIG. 45, which is a SEM image of a line (previously shown in FIG. 43) on double-sided tape that has been cross-sectioned. It was noticed that the line formed a trough as it deposited on the substrate. Apparently, the trough is formed through some form of particle-substrate interaction. The trough is approximately 1-μm deep and extends horizontally underneath the trough increasing the line-width to approximately 6.2 μm. The trough has the function of decreasing line-width, improving edge definition, and increasing the line aspect ratio (line height/line width).

The concept of simultaneously creating a trough while printing a line is novel, and can produce thinner lines, with a shape closer to (although still far from) a cylindrical shape.

Experimental research continues to improve these troughing techniques. It is hoped that such techniques, while useful in and of themselves, might also prove extremely beneficial to high frequency resonance structures. It is known that spattering of the line material outside the confines of the intended line causes eddy current losses, reducing Q, and reducing performance of such structures.

These structures might be simply inductive lines, but may be formed in multiple layers as both capacitors and inductors.

CONCLUSION

In further examples, lines were successfully written on doped- and undoped-silicon, as well as on glass, polyimide, and polymers, which demonstrates that the invention is not limited to any particular print media.

It will also be appreciated that, while a tip having 3 nozzles in series represents a one aspect of the invention, any configuration using at least 3 series nozzles is also within the scope of the present invention. In another aspect of the invention, the number of nozzles is a higher order odd number (i.e., an odd number of nozzles greater than one).

Additionally, the tip can be formed from juxtaposed separate nozzles or as a single monolithic structure.

It is further contemplated that, with the tip described herein, an aerosol of liquid or liquid particle suspension generated and mixed with a sheath gas would be input into the tip and patterned on a target.

All patents, publications and other references cited herein are incorporated herein by reference in their entirety.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

The embodiments are described in sufficient detail to enable those skilled in the art to practice the invention. Other embodiments may be utilized and formulation and method of using changes may be made without departing from the scope of the invention. The detailed description is not to be taken in a limiting sense, and the scope of the invention is defined only by the appended claims, along with the full scope of equivalents to which such claims are entitled.

While examples and drawings have generally been represented as rectangles, it is understood that other shapes, both regular and irregular, can be used to produce panels that can be tiled together to give other finished forms of luminaires, such as circles, ovals, spirals, lines, and other shapes known to those of ordinary skill in the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the present description.

What is claimed is:

1. A device for providing high-intensity illumination, comprising:

a flexible substrate;

a first plurality of bus-bar conductors deposited on the substrate to form part of a circuit, wherein a plurality of gaps separate the plurality of bus-bar conductors from one another, wherein the first plurality of bus-bar conductors includes a first bus-bar conductor, a second bus-bar conductor, and a third bus-bar conductor, wherein the plurality of gaps includes a first gap and a second gap;

a first plurality of light emitting diodes (LEDs) that are connected in parallel and form part of the circuit, wherein each LED of the first plurality of LEDs is connected between the first bus-bar conductor and the second bus-bar conductor across the first gap;

a second plurality of LEDs that are connected in parallel and form part of the circuit, wherein each LED of the second plurality of LEDs is connected between the second bus-bar conductor and the third bus-bar conductor across the second gap; and a first electrical connector and a second electrical connector each connected to the circuit in order to provide electrical power to the first plurality of LEDs and the second plurality of LEDs.

2. The device of claim 1, wherein each of the plurality of bus-bar conductors has a sheet resistance of one ohm/square or lower.

3. The device of claim 1, wherein a loss in luminous efficacy through ohmic heating is less than 10%.

4. The device of claim 1, wherein the first plurality of LEDs displays two or more colors.

5. The device of claim 1, wherein the first electrical connector and the second electrical connector are positioned in opposite corners diagonally opposite one another.

6. The device of claim 1, wherein the first bus-bar conductor and the first gap are each substantially rectangular, and wherein the first bus-bar conductor has a width that is at least six times a width of the first gap.

7. The device of claim 1, wherein the first bus-bar conductor and the second bus-bar conductor each have a width that is at least six times a width of the first gap.

8. The device of claim 1, wherein the first plurality of bus-bar conductors includes copper.

9. The device of claim 1, wherein the first plurality of LEDs and the second plurality of LEDs form a group of LEDs that display more than one color.

10. A method of making a high-power light module using additive circuitry, comprising:

providing a flexible substrate;

applying a deposition-prevention oil on the flexible substrate in a predetermined masking pattern of a plurality of gap areas covered by the deposition-prevention oil that are to remain free of metal;

depositing metal on conductive bus-bar areas of the flexible substrate not covered by the deposition-prevention oil using a vapor-deposition process to form a plurality of bus-bar conductors;

connecting a first and second plurality of LEDs to the plurality of bus-bar conductors such that each one of the first and second plurality of LEDs is in contact with two of the plurality of bus-bar conductors and located across one of a plurality of gaps defined by the plurality of gap areas in order to form a circuit; and adding an electrical connector to the circuit.

11. The method of claim 10, further comprising testing the high-power light module.

12. The method of claim 10, wherein the plurality of bus-bar conductors includes a first bus-bar conductor, a second bus-bar conductor, and a third bus-bar conductor, wherein the plurality of gaps includes a first gap and a second gap, wherein the first bus-bar conductor and the first gap are substantially rectangular, and wherein the first bus-bar conductor has a width that is at least six times a width of the first gap.

13. The method of claim 10, wherein the plurality of bus-bar conductors includes a first bus-bar conductor, a second bus-bar conductor, and a third bus-bar conductor, wherein the plurality of gaps includes a first gap and a second gap, wherein the applying of the deposition-prevention oil and the depositing of metal includes:

separating the first bus-bar conductor from the second bus-bar conductor by the first gap, and separating the third bus-bar conductor from the second bus-bar conductor by the second gap.

14. The method of claim 10, wherein the plurality of bus-bar conductors includes a first bus-bar conductor, a second bus-bar conductor, and a third bus-bar conductor, wherein the plurality of gaps includes a first gap and a second gap, wherein the depositing of metal includes separating the first bus-bar conductor from the second bus-bar conductor by the first gap, and separating the third bus-bar conductor separated from the second bus-bar conductor by the second gap; and wherein the connecting of the first and second plurality of LEDs includes:

connecting the first plurality of LEDs between the first bus-bar conductor and the second bus-bar conductor across the first gap, and connecting the second plurality of LEDs between the second bus-bar conductor and the third bus-bar conductor across the second gap.

15. The method of claim 10, wherein the plurality of bus-bar conductors includes a first bus-bar conductor, a second bus-bar conductor, and a third bus-bar conductor, wherein the plurality of gaps includes a first gap and a second gap, wherein the depositing of metal includes separating the first bus-bar conductor from the second bus-bar conductor by the first gap, and separating the third bus-bar conductor from the second bus-bar conductor by the second gap; and wherein the connecting of the first and second plurality of LEDs includes connecting the first plurality of LEDs between the first bus-bar conductor and the second bus-bar conductor across the first gap, connecting the second plurality of LEDs between the second bus-bar conductor and the third bus-bar conductor across the second gap; and adding a phosphor glob-top to each of the first plurality of LEDs.

16. The method of claim 10, wherein the plurality of bus-bar conductors includes a first bus-bar conductor, a second bus-bar conductor, and a third bus-bar conductor, wherein the plurality of gaps includes a first gap and a second gap, wherein the depositing of metal includes separating the first bus-bar conductor from the second bus-bar conductor by the first gap, and separating the third bus-bar conductor from the second bus-bar conductor by the second gap, and wherein the first bus-bar conductor has a width that is at least six times a width of the first gap.

17. The method of claim 10, wherein providing of the flexible substrate includes providing the flexible substrate in roll form; and wherein the connecting of the first and second plurality of LEDs includes picking and placing the first and second plurality of LEDs for LED attachment.

18. The method of claim 10, wherein the depositing of the metal includes depositing copper.

19. A module for distributing electrical power to a plurality of electrical devices over an area, comprising:

a flexible substrate;

a plurality of bus-bar conductors deposited on the flexible substrate and separated from one another by a plurality of gaps to form a sheet, wherein the plurality of bus-bar conductors includes a first bus-bar conductor, a second bus-bar conductor, and a third bus-bar conductor, wherein the plurality of gaps includes a first gap and a second gap; and a first plurality of devices and a second plurality of devices each mechanically and electrically connected to the sheet to form a circuit, wherein each device of the first plurality of devices is connected between the first bus-bar conductor and the second bus-bar conductor across the first gap, and wherein each device of the second plurality of devices is connected between the second bus-bar conductor and the third bus-bar conductor across the second gap.

20. The module of claim 19, wherein the plurality of bus-bar conductors is deposited on the flexible substrate by a vapor deposition process.

21. The module of claim 19, wherein a material of the plurality of bus-bar conductors includes vapor-deposited copper.

22. The module of claim 19, wherein the first plurality of devices includes a first plurality of light emitting diodes (LEDs), and wherein the second plurality of devices includes a second plurality of LEDs.

* * * * *